US012168161B2

(12) United States Patent
Clark et al.

(10) Patent No.: US 12,168,161 B2
(45) Date of Patent: Dec. 17, 2024

(54) MODULAR EXERCISE APPARATUS, SYSTEM, AND METHODS

(71) Applicants: Andrew F. Clark, Englewood, CO (US); Richard Gangl, Golden, CO (US); Deborah Lessen, New York, NY (US)

(72) Inventors: Andrew F. Clark, Englewood, CO (US); Richard Gangl, Golden, CO (US); Deborah Lessen, New York, NY (US)

(73) Assignee: Andrew F. Clark, Englewood, CO (US)

( * ) Notice: Subject to any disclaimer, the term of this patent is extended or adjusted under 35 U.S.C. 154(b) by 122 days.

(21) Appl. No.: 17/728,959

(22) Filed: Apr. 25, 2022

(65) Prior Publication Data

US 2022/0323819 A1 Oct. 13, 2022

Related U.S. Application Data

(63) Continuation-in-part of application No. 17/079,409, filed on Oct. 23, 2020, which is a continuation-in-part of application No. 16/660,636, filed on Oct. 22, 2019, now Pat. No. 11,324,990.

(60) Provisional application No. 63/179,140, filed on Apr. 23, 2021, provisional application No. 62/925,118, filed on Oct. 23, 2019, provisional application No. 62/749,120, filed on Oct. 22, 2018.

(51) Int. Cl.
*A63B 21/00* (2006.01)
*A63B 21/02* (2006.01)

(52) U.S. Cl.
CPC ..... *A63B 21/4031* (2015.10); *A63B 21/023* (2013.01); *A63B 21/4047* (2015.10); *A63B 2208/0233* (2013.01)

(58) Field of Classification Search
CPC ..... A63B 21/4031; A63B 21/023; A63B 21/4047; A63B 2208/0233; A63B 21/0442; A63B 21/16; A63B 23/03525; A63B 23/03541; A63B 23/0429; A63B 21/00065; A63B 21/00069; A63B 21/4034; A63B 21/0421
See application file for complete search history.

(56) References Cited

U.S. PATENT DOCUMENTS 1,973,945 A * 9/1934 Chavin ..... A61G 13/009 482/130
4,728,150 A * 3/1988 Gaudreau, Jr. ..... A47C 1/023 297/383
5,002,271 A * 3/1991 Gonzales ..... A63B 23/0494 482/130
D490,868 S * 6/2004 Tornabene ..... D21/690
6,971,977 B1 * 12/2005 Chen ..... A63B 22/16 482/121
6,981,932 B1 * 1/2006 Huang ..... A63B 21/4035 482/121
7,381,171 B2 * 6/2008 Chen ..... A63B 21/045 482/142

(Continued)

*Primary Examiner* — Loan B Jimenez
*Assistant Examiner* — Andrew M Kobylarz
(74) *Attorney, Agent, or Firm* — Armstrong Teasdale LLP

(57) ABSTRACT

An exercise system includes a base module having a seat with a seat depth, and a vertically adjustable back configured to fixedly engage with the base module at a first seat depth and a second seat depth different from the first seat depth.

20 Claims, 42 Drawing Sheets

(56) References Cited

U.S. PATENT DOCUMENTS

| | | | | |
|---|---|---|---|---|
| 7,833,143 | B1 * | 11/2010 | Tsai | A63B 21/4047 482/142 |
| 8,241,190 | B2 * | 8/2012 | Van Straaten | A63B 21/4029 482/130 |
| 2004/0138034 | A1 * | 7/2004 | Endelman | A63B 22/0056 482/121 |
| 2007/0129225 | A1 * | 6/2007 | Hammer | A63B 23/0211 482/121 |
| 2010/0255965 | A1 * | 10/2010 | Chen | A63B 21/1609 482/130 |
| 2013/0157818 | A1 * | 6/2013 | Lalaoua | A63B 21/152 482/123 |
| 2017/0087405 | A1 * | 3/2017 | Walkama | A63B 23/0405 |
| 2022/0183466 | A1 * | 6/2022 | Lu | A47C 13/00 |

* cited by examiner

MODULAR EXERCISE APPARATUS, SYSTEM, AND METHODS

RELATED APPLICATIONS

This application is a continuation in part of U.S. patent application Ser. No. 17/079,409, filed Oct. 23, 2020. U.S. patent application Ser. No. 17/079,409 is a continuation in part of U.S. patent application Ser. No. 16/660,636, filed Oct. 22, 2019. U.S. patent application Ser. No. 17/079,409 claims the benefit of and priority to U.S. Provisional Patent Application Ser. No. 62/925,118, filed Oct. 23, 2019. U.S. patent application Ser. No. 16/660,636 claims the benefit of and priority to U.S. Provisional Patent Application Ser. No. 62/749,120, filed Oct. 22, 2018. The present application also claims the benefit of and priority to U.S. Provisional Patent Application Ser. No. 63/179,140, filed Apr. 23, 2021. The disclosures of all of these applications are herein incorporated by reference in their entireties.

FIELD OF THE DISCLOSURE

The field of the disclosure relates generally to exercise equipment, and more specifically to a modular exercise apparatus and system for multi-functional use and performance.

BACKGROUND

Many conventional exercise apparatuses are designed for a user to perform a particular fitness exercise. Fitness studios and exercise gyms often maintain a significant amount of floor space to accommodate the multiple various separate devices that are devoted to each individual exercise. Some exercise apparatuses are designed for multi-functional use, but such multi-functional apparatuses typically represent an amalgamation of several separate devices that are joined together and require a significant footprint of the studio/gym floor space. Other conventional exercise apparatuses obtain multi-functional capability within a smaller footprint, but often at the expense of the quality of the individual functional capabilities. Some exercise apparatuses are convertible from one type of device into another, but the conversion process is often time-consuming, difficult for the average user to easily perform, and may require special tools.

These challenges are particularly significant with respect to Pilates exercise equipment. Pilates is a generic term that is commonly used to refer to a physical fitness system named after Joseph Pilates, and for which several well-known types of exercise devices are often employed. Among these known Pilates devices are a Pilates chair, a Pilates high-back chair (sometimes referred to as a Pilates electric chair), a Pilates tower, and Pilates reformer. The Pilates chair and the Pilates reformer typically constitute the foundational exercise equipment of a Pilates studio. These apparatuses, however, are relatively large, and smaller studios are limited in their ability to accommodate multiple apparatuses, or a variety of different apparatuses.

Some conventional solutions have integrated two different Pilates apparatuses together. For example, conventional Pilates chairs have been designed that convert into high-back Pilates chairs. However, one such convertible apparatus merely fixes a back panel onto a standard Pilates chair. This seat portion of this converted Pilates chair is the same depth with the attached back panel as it is without. Another such convertible apparatus provides a seat-and-back top cover that fits over the seat portion of the standard Pilates chair, fixed to the side panels thereof. The top cover, however, does not integrate with the Pilates chair seat portion, but instead completely covers the seat with its own seat portion, and does not allow any adjustability thereof.

Another conventional solution integrates a Pilates tower into a standard Pilates high-back chair. These conventional integrated tower/high-back chair combinations, however, typically require that the high-back chair portion be fixedly secured to the ground (similar to a standard Pilates tower) to prevent the assembly from tipping when vertical forces are applied to the tower portion. Such fixed attachments render it very difficult to conveniently move the assembly to different locations as desired. Additionally, the tower portion of conventional tower/high-back chair combination assemblies are known to experience a significant amount of play with respect to the high-back chair portion, that is, the tower portions are known to wiggle somewhat in relation to the chair portion when pulling forces are exerted against the tower according to known Pilates exercise routines.

Lastly, the majority of Pilates exercise apparatuses have been manufactured according to substantially the same standard design for several decades. This standard design includes solid side panels for the Pilates chair (typically made of heavy wood) and solid back panels for the Pilates high-back chair. Even when disassembled, this standard design is a very heavy and bulky to ship from one location to another. This standard design also makes customization difficult without significant expense.

Accordingly, an improved exercise apparatus design is needed for integrating multi-functional capability into a single system, which uses a significantly smaller footprint, while also providing the same quality to each individual component that would be experienced using an apparatus having only the functionality of that single component.

SUMMARY

In an embodiment, an exercise system includes a base module having a seat with a seat depth, and a vertically adjustable back configured to fixedly engage with the base module at a first seat depth and a second seat depth different from the first seat depth.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, and such ranges are identified and include all the sub-ranges contained therein unless context or language indicates otherwise.

Throughout the following description, like parts among the several drawings are labeled by the same numbering, for ease of explanation.

Figure 1A:
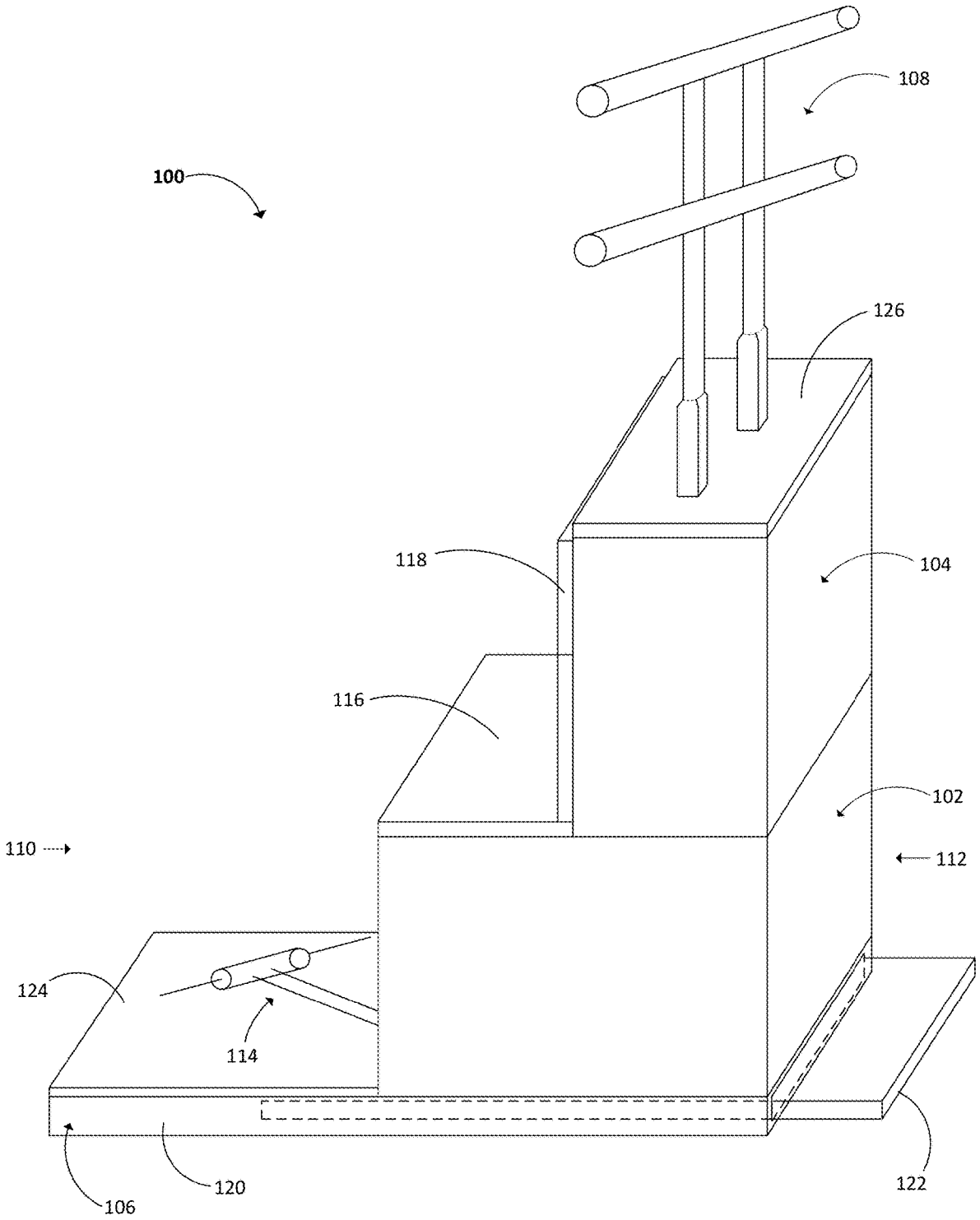
FIG. 1A is a perspective view of a modular exercise system, according to an embodiment.

FIG. 1A is a perspective view of a modular exercise system 100. In an exemplary embodiment, modular exercise system 100 includes a base module 102, a back module 104, a platform module 106, and a tower module 108. Modular exercise system 100 is particularly useful, for example, with various fitness exercises, and particularly for Pilates-based physical exercises. As described further herein, and for ease of explanation, the various components of modular exercise system 100 are described with respect to a front end 110 and a rear end 112.

In an embodiment, base module 102 is configured to function, with or without the other components of system 100, as a Pilates chair, includes a foot paddle unit 114 and a first seat pad 116. Similarly, back module 104 may include a back rest 118. As described further below, some of the components of system 100 are operably functional without inclusion of other components. In the exemplary embodiment, platform module 106 includes a front stabilizer portion 120, a rear stabilizer portion 122, and a platform cover 124. Where platform module 106 is implemented, rear stabilizer portion 122 may be movable, and operably nested within front stabilizer portion 120 and under platform cover 124. Where tower module 108 is implemented, back module 104 may further include a tower mating unit 126.

Figure 1B:
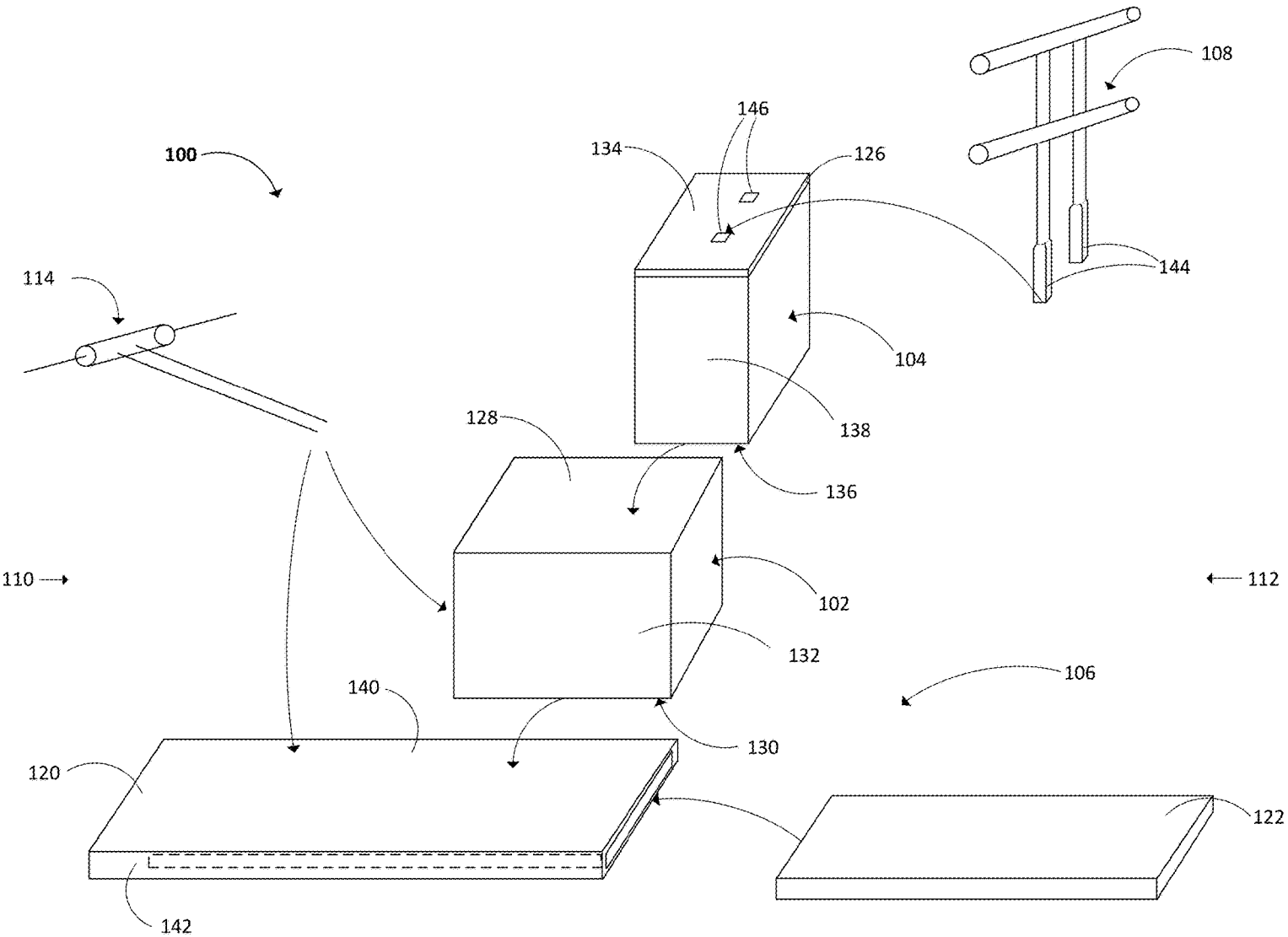
FIG. 1B is an exploded view of the modular exercise system depicted in FIG. 1A.

FIG. 1B is an exploded view of modular exercise system 100, FIG. 1A. In the exploded view, additional details of the several components may be seen. For example, base module 102 includes a base top 128, a base bottom 130, and two opposing base sides 132. Similarly, back module 104 includes a back top 134, a back bottom 136, and two opposing back sides 138.

When integrated together, back bottom 136 of back module 104 is coupled to base top 128 of base module 102, towards rear end 112. In in at least one embodiment, back module 104 is coupled to base module 102 such that the two modules are flush at rear end 112. As described further below with respect to FIGS. 2A-B, back module 104 is optionally configured to be horizontally adjustable across base top 128 at different fixed positions. In some embodiments, back module 104 is entirely removable from base module 102, such that base module 102 may operate as a standard Pilates chair.

Platform module 106 includes a platform top 140 and two opposing platform sides 142. In an embodiment, base bottom 130 of base module 102 is coupled to platform top 140 at rear end 112 as separate modules. In at least one embodiment, base bottom 130 is integrally constructed with platform top 140 as a single unit (described further below with respect to FIG. 3F).

In an exemplary embodiment, tower module 108 of modular exercise system 100 is integrally coupled to back module 104 to be securely positioned above back top 134. In this example, tower mating unit 126 is disposed at back top 134, and tower feet 144 of tower module 108 enter through tower mating unit 126 at tower openings 146, thereby allowing tower feet 144 two extend through back top 134 into back module 104.

In one embodiment, first seat pad 116 may be coupled to base top 122 towards forward end 110 of base module 102 and extending towards rear end 112. First seat pad 116 extends toward rear end 112 up to back module 104; however, first seat pad 116 may cover other lengths of the top of base module 102 and, when exercise system 100 does not include back module 104, first seat pad 116 may cover part of or all of base top 128. Additionally, back rest 118 of back module 104 may couple to back sides 138 facing forward end 110. In some embodiments, back rest 118 may cover all or part of the back side 138 facing forward end 110. A top back board 154 may be coupled to back top 134 of back module 104, under tower mating unit 126. In some embodiments, tower mating unit 126 may cover all or part of back top 134. Similarly, platform cover 124 may cover all or part of platform top 140. In some embodiments, platform cover 124 covers only the portion of platform module 106 that extends forward of base module 102. In other embodiments, platform cover 124 extends the entire length of platform module 106, or may be custom fit to accommodate various additional components, as described in greater detail below.

Figure 2A:
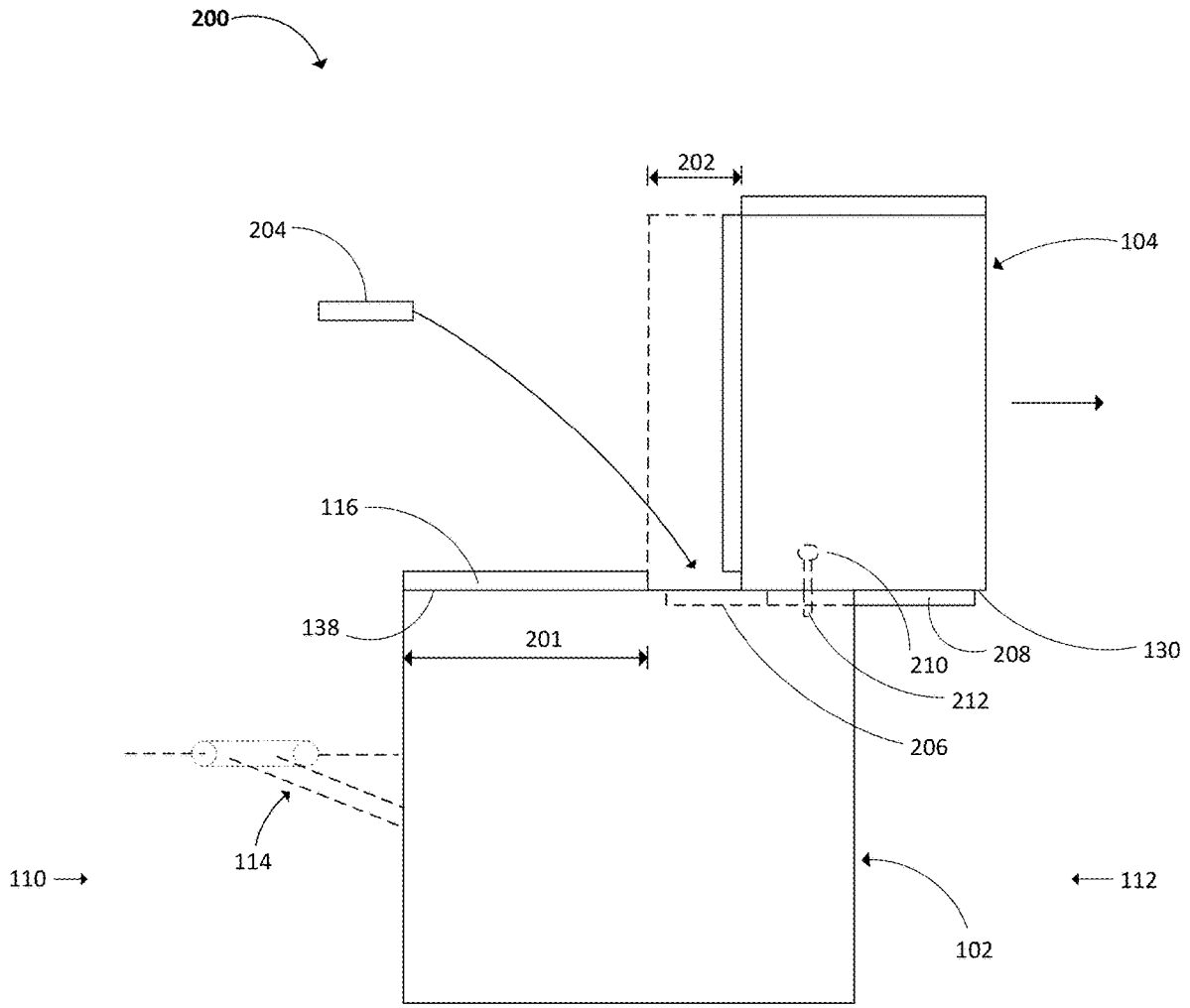
FIG. 2A is a side view of an adjustable high-back chair formed of the base module and the back module of the modular exercise system depicted in FIG. 1A, illustrating an operational adjustability between the respective components, according to an embodiment.

FIG. 2A is a side view of an adjustable high-back chair 200 formed of base module 102 and back module 104 of modular exercise system 100, FIG. 1A, illustrating an operational adjustability between the respective components. In exemplary operation of high-back chair 200, a user sits on first seat pad 116 facing toward front end 110, with the user's back against back rest 118. In this position, the user's legs are positioned toward foot paddle unit 114 (e.g., with legs bent), enabling the user to press down on foot paddle unit 114 with their feet to perform leg exercises (i.e., utilizing a resistance element or spring of foot paddle unit 114, described further below).

However, as described above, conventional high-back chairs have only a single depth to the seat portion between the front end of the chair and the back rest. These high-back chairs are unable to accommodate users having longer legs, or of wider girth in the case where a user performs sideways exercises (described further below with respect to FIG. 2B). High-back chair 200 advantageously overcomes this obstacle by configuring back module 104 to be horizontally adjustable in a direction A with respect to base module 102. More specifically, back module 104 is horizontally adjustable toward rear end 112 of base module 102, but while keeping back rest 118 substantially perpendicular over a range of horizontal adjustability.

In an exemplary embodiment, back module 104 is fixedly coupled to base module 102 at a first seat depth 201. In exemplary operation, back module 104 may be freed from a fixed coupling with base module 102, and slidably moved in direction A over a seat extension depth 202, at which position, back module 104 may also be fixedly coupled to base module 102. In at least one embodiment, when back module 104 is positioned to seat extension depth 202, a second seat pad 204 may be placed on base module 102 between first seat pad 116 and back module 104 such that part or substantially all of seat extension depth 202 is covered by second seat pad 204. In these examples, first and second seat pads 116, 204 may consist of a solid material suitable for supporting weight, such as, but not limited to, wood, plastic or metal. Additionally, in some further embodiments, filler seat board 204 may be coupled to other materials, such as, but not limited to, fabric and/or padding material.

In an exemplary embodiment, back module 104 engages with base module 102 by the mating of one or more grooves 206 into one or more respective runners 208 configured to matingly couple with grooves 206. In some embodiments, the coupling of runners 208 into grooves 206 is configured to form a tight fit such that back module 104 is secure above base module 102, but does not experience play from various forces exerted against the several components. In in an embodiment, back module 104 is additionally, or alternatively, coupled to base module 102 by one or more fasteners 210 that extend vertically through back bottom 136 and engage with fastening means 212 disposed within or opposite back top 134. Fasteners 210, for example, may include screw threads to mate with corresponding threading of fastening means 212, to allow for repeated engagement and disengagement of back module 104 to and from base module 102. One, both or other similar configurations may be used to secure back module 104 to base module 102 when the back module is shifted to additional seat depth 202.

Figure 2B:
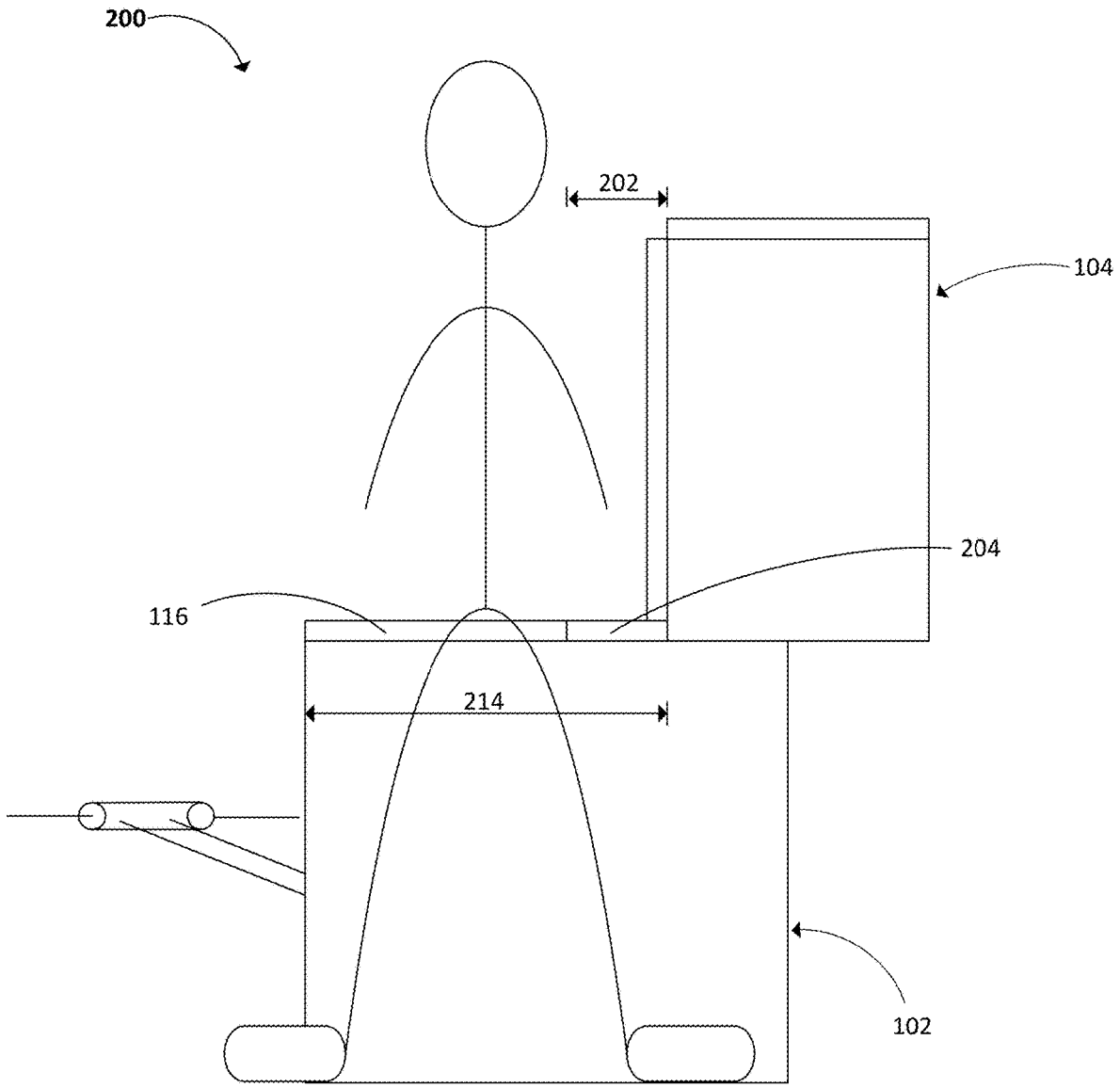
FIG. 2B illustrates an operational principle of the embodiment depicted in FIG. 2A.

FIG. 2B illustrates an operational principle of the embodiment depicted in FIG. 2A. In an alternative implementation of adjustable high-back chair 200, a user sits sideways, with one arm directed toward front end 110, and the other arm directed toward rear end 112, such as in the case where foot paddle 114 is used for arm exercises. The conventional one-size-fits-all high-back chairs are only able to accommodate users up to a certain user with, i.e., up to first seat depth 201. Users having a wider girth are generally prevented from using the conventional high-back chair for such exercises.

According to the innovative features of high-back chair 200 though, back module 104 is adjustable from first seat depth 201 to a second seat depth 214. In the exemplary embodiment, second seat depth 214 is illustrated to represent a fixed position; however, a second seat depth 214 may also represent a range of available depths to which back module 104 may be smoothly adjusted and fixed. That is, when back module 104 is horizontally adjusted, a user is provided with additional depth to sit on base module 102. The user, for example, may lean on foot paddle unit 114 with one arm and press down to engage oblique muscles and other muscles. Adjustable high-back chair 200 is therefore particularly useful for larger individuals who are not able to use standard conventional Pilates exercise equipment. In at least one embodiment, back module 104 may be entirely removed from base module 102, and second seat pad 204 may be alternatively configured to cover the entire base top 128 beyond first seat pad 116. In some embodiments, second seat pad 204 may be a plurality of second seat pads configured to cumulatively accommodate increasing discrete second seat depths 214.

Figure 3A:
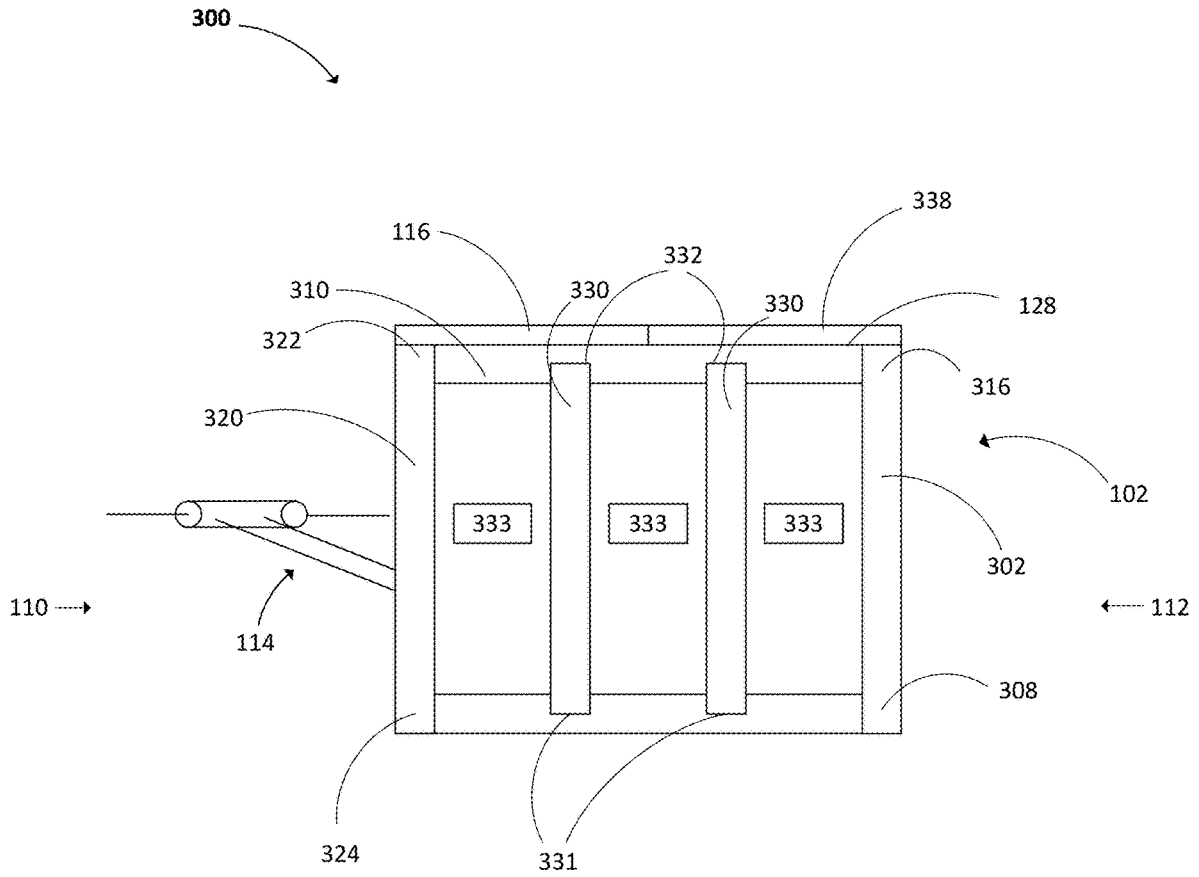
FIG. 3A is a side view of the base module depicted in FIG. 1A, illustrating an exemplary structural framework.
Figure 3B:
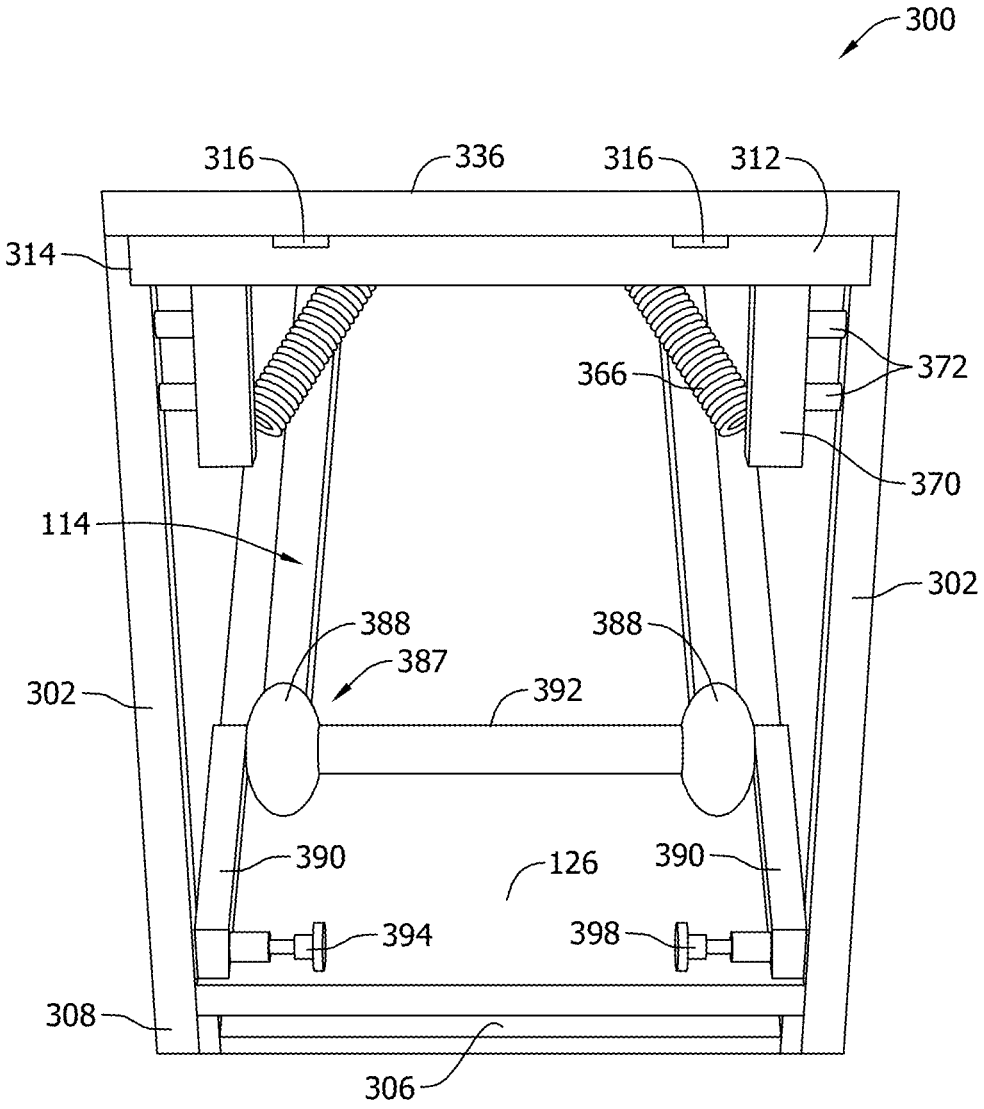
FIG. 3B is a rear perspective view of the base module depicted in FIG. 1A, according to an embodiment.
Figure 3C:
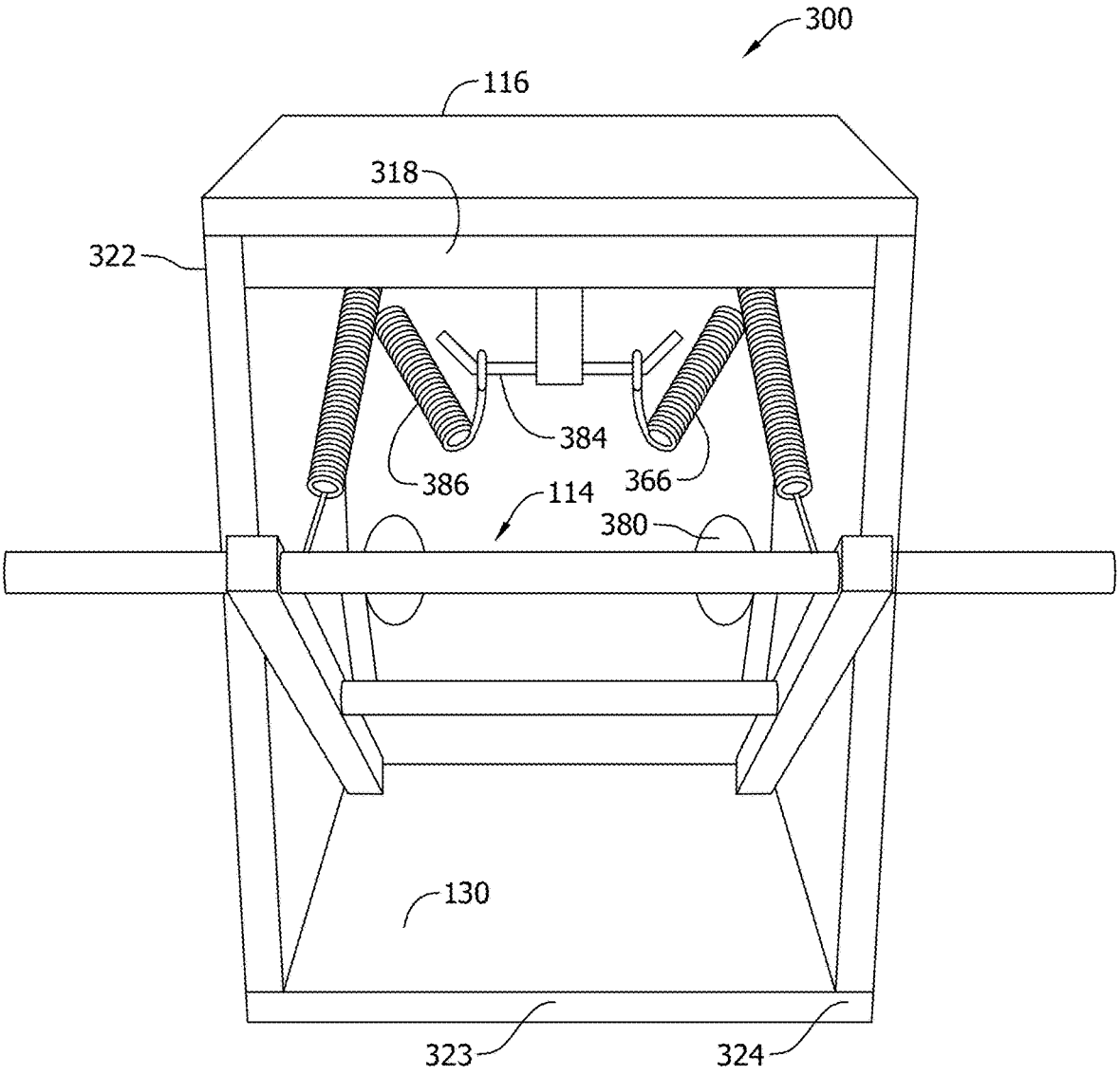
FIG. 3C is a front perspective view of the base module depicted in FIG. 1A, according to an embodiment.
Figure 3D:
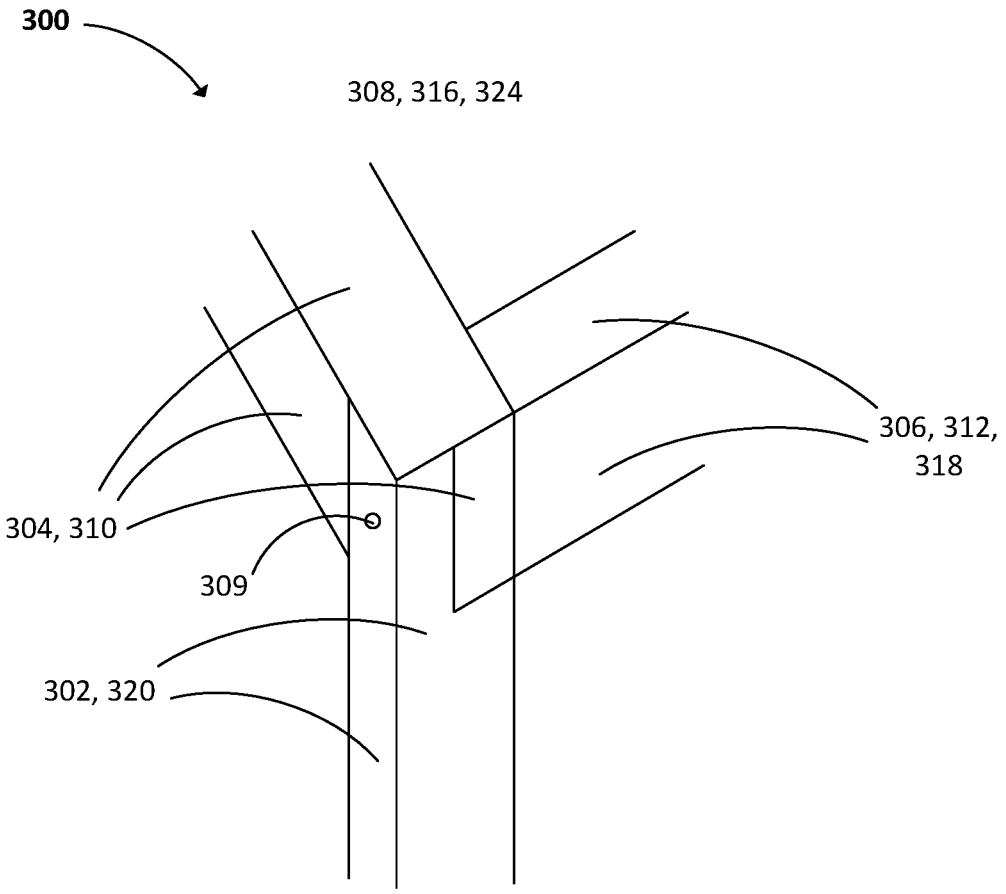
FIG. 3D is a partial view of a portion of the structural framework depicted in FIG. 3A, according to an embodiment.
Figure 3E:
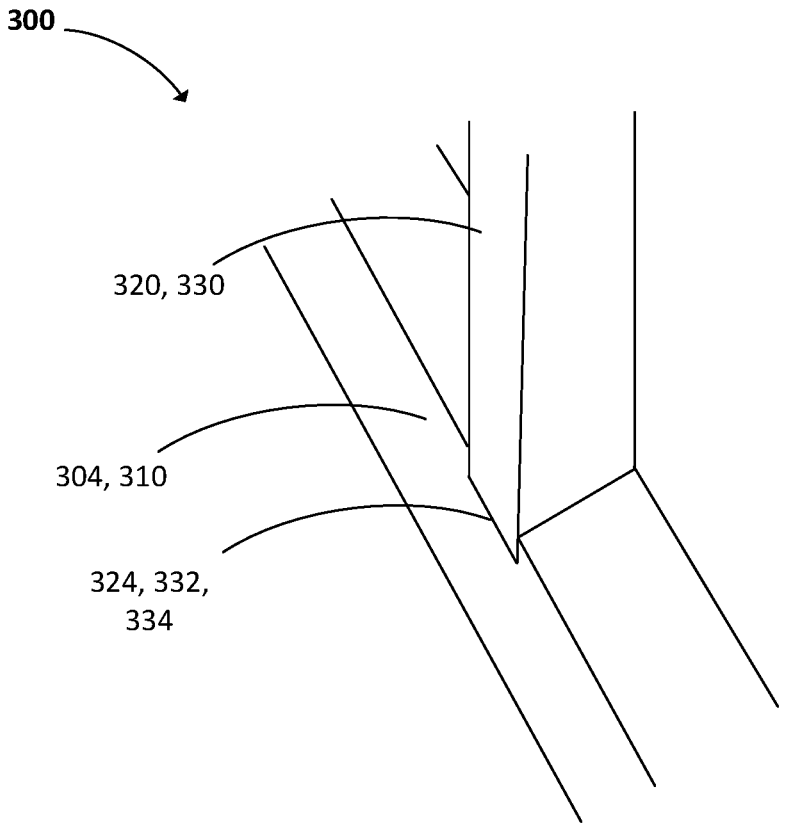
FIG. 3E is a partial view of another portion of the structural framework depicted in FIG. 3A, according to an embodiment.
Figure 3F:
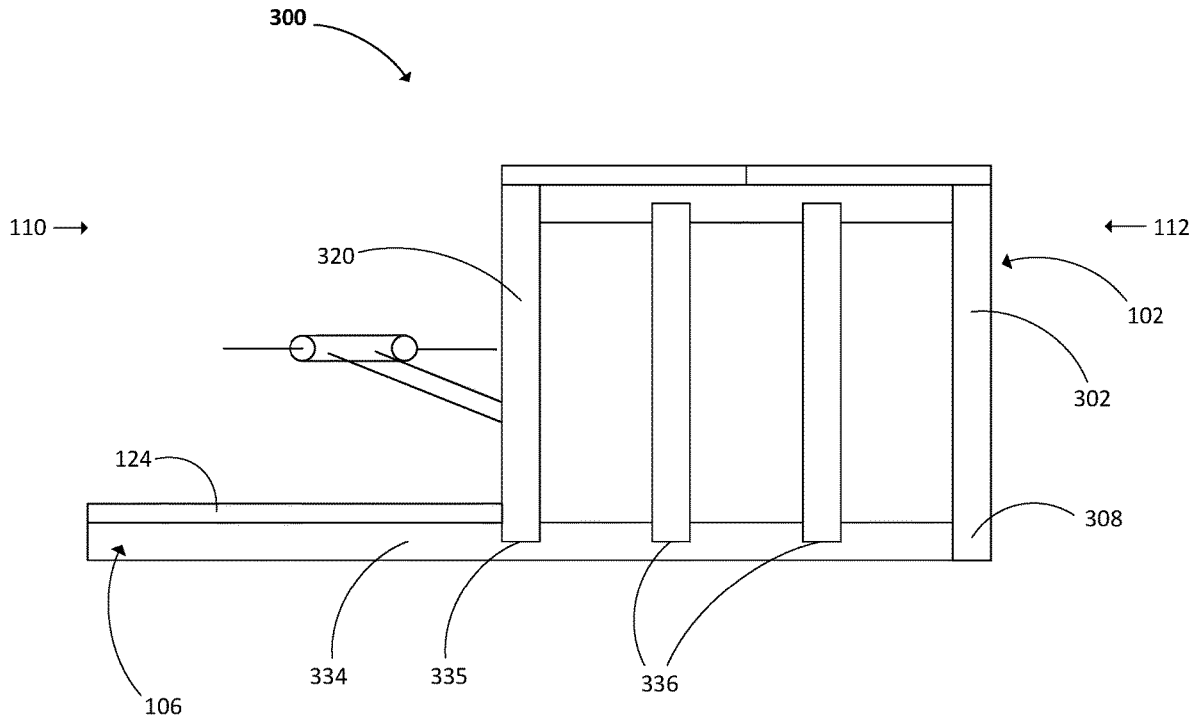
FIG. 3F is a side view of the base module and the platform module of the modular exercise system depicted in FIG. 1A, according to an embodiment.
Figure 3G:
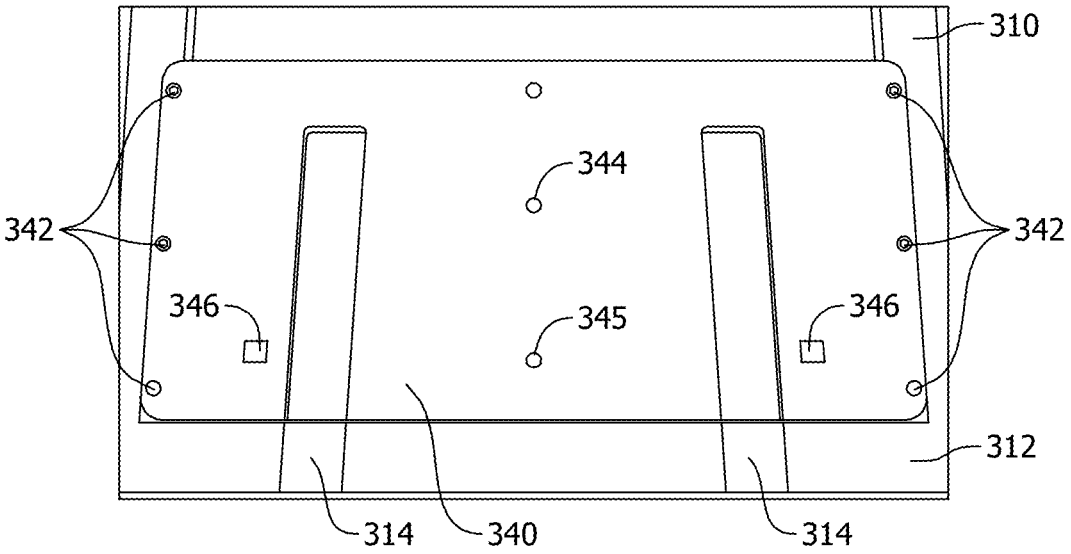
FIG. 3G is a top view of the base module depicted in FIG. 1A, according to an embodiment.
Figure 3H:
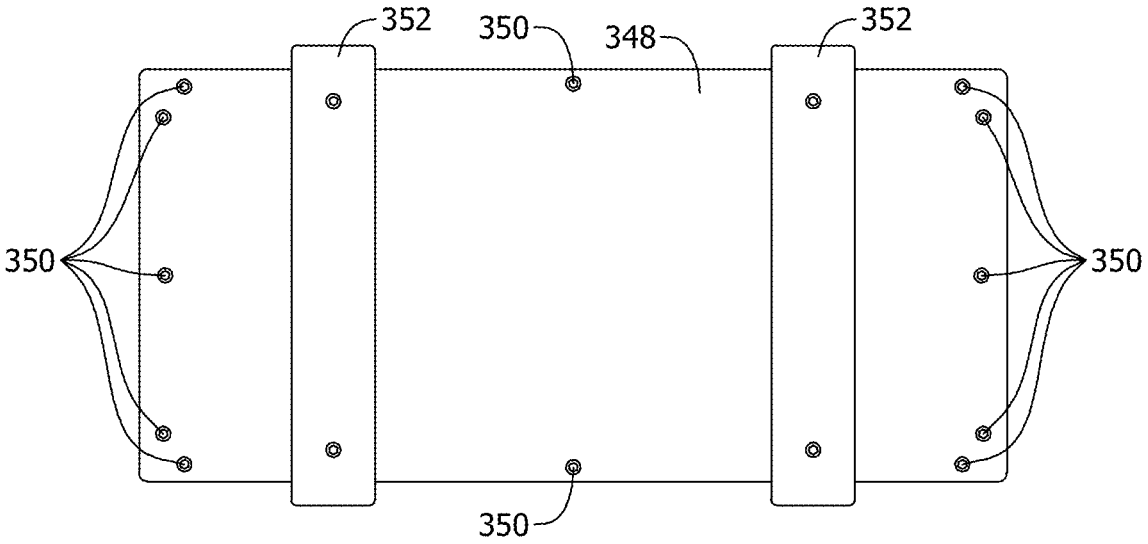
FIG. 3H is a bottom view of the back module depicted in FIG. 1A, according to an embodiment.
Figure 3I:
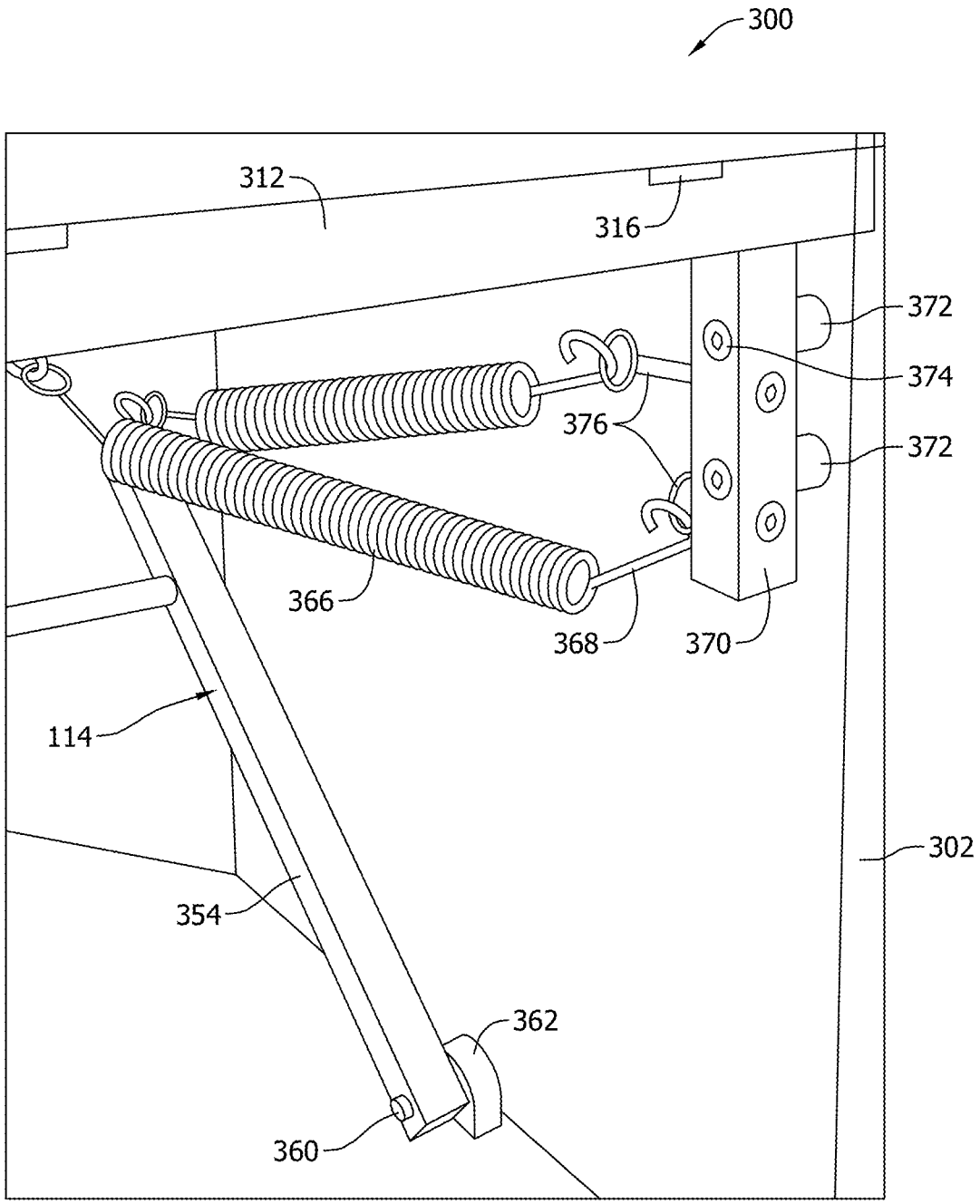
FIG. 3I is a partial perspective view illustrating internal components of the base module depicted in FIG. 1A, according to an embodiment.
Figure 3J:
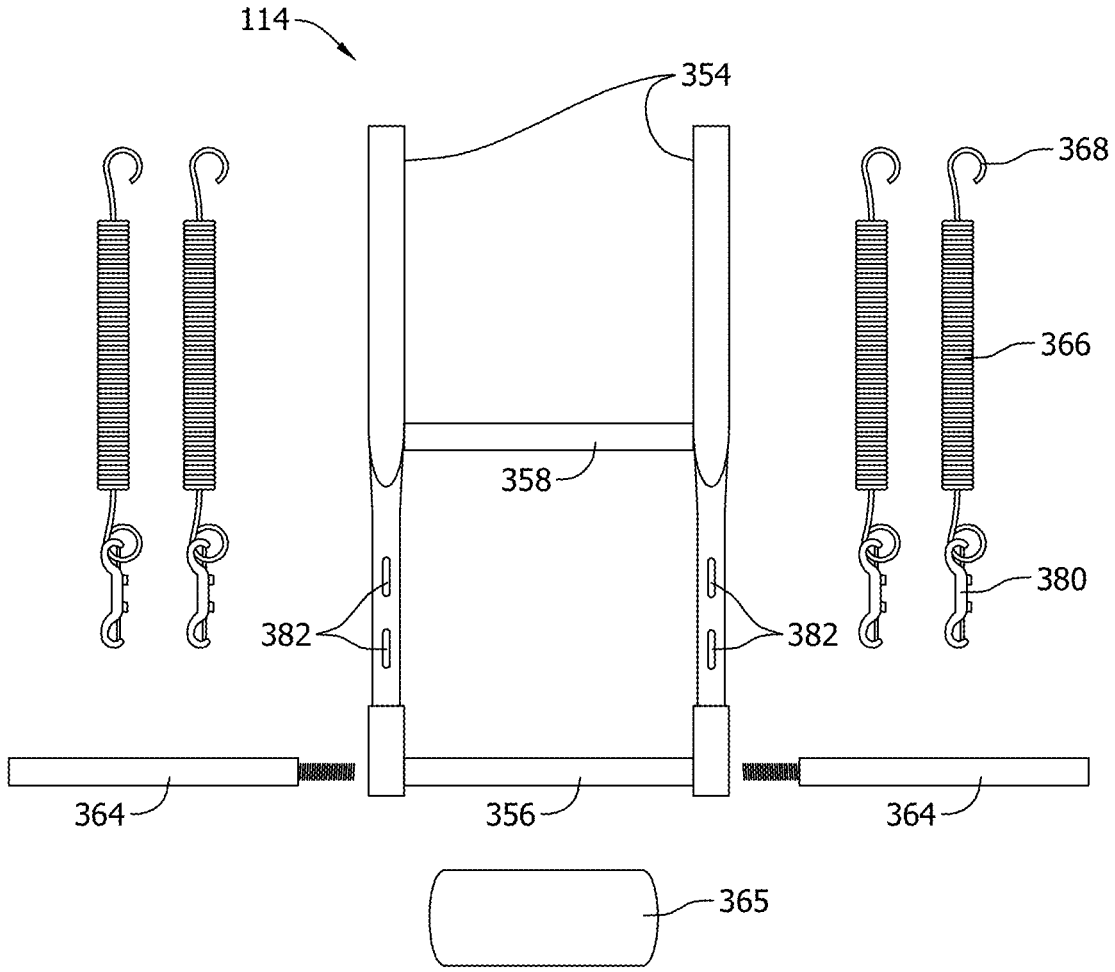
FIG. 3J is an exploded view of the foot paddle unit of the base module depicted in FIG. 1A, according to an embodiment.
Figure 3K:
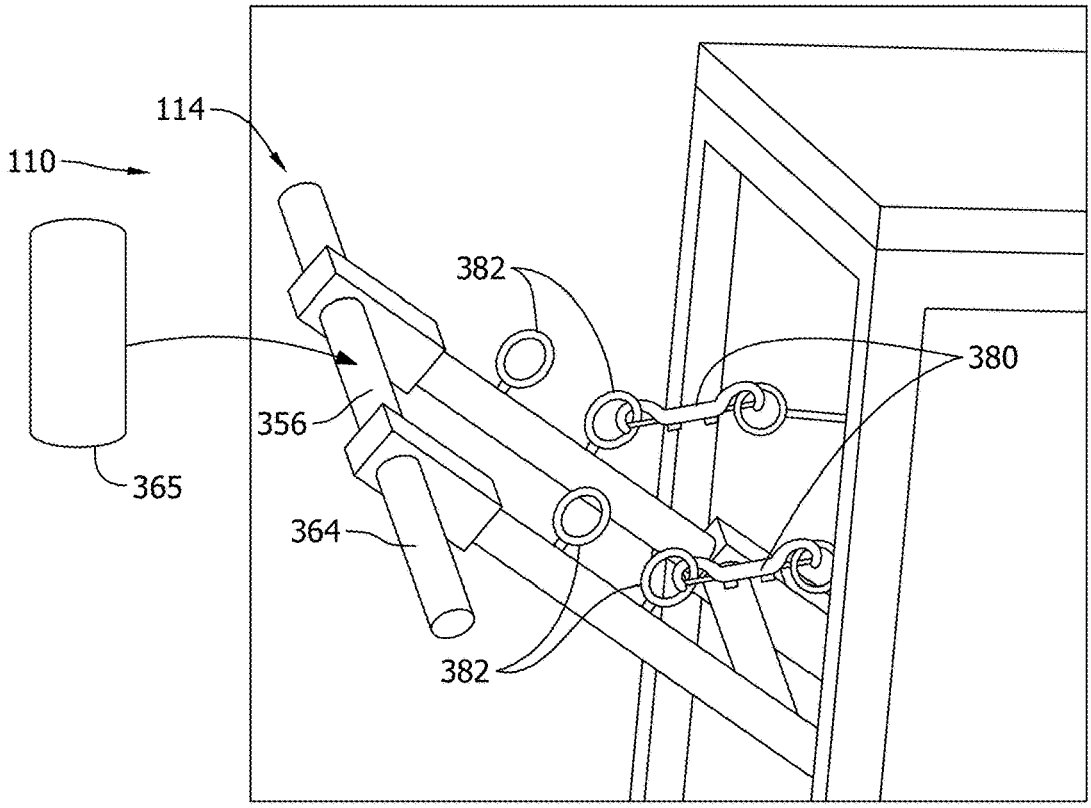
FIG. 3K is a perspective view illustrating an operational relationship of the foot paddle and the base module depicted in FIG. 1A, according to an embodiment.
Figure 3L:
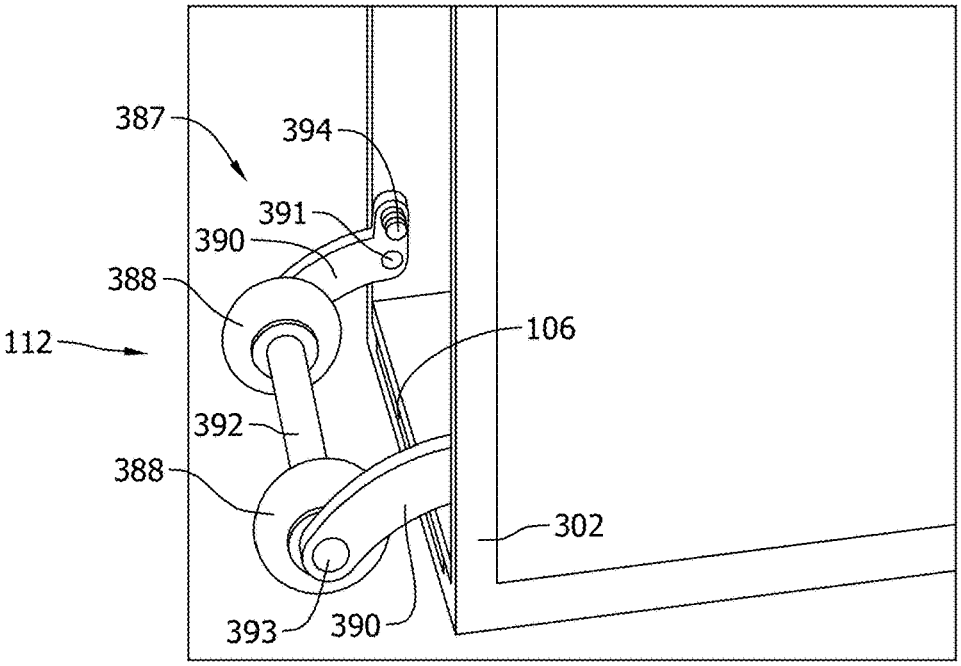
FIG. 3L is a partial perspective view of the base module depicted in FIG. 1A, according to an embodiment.
Figure 3M:
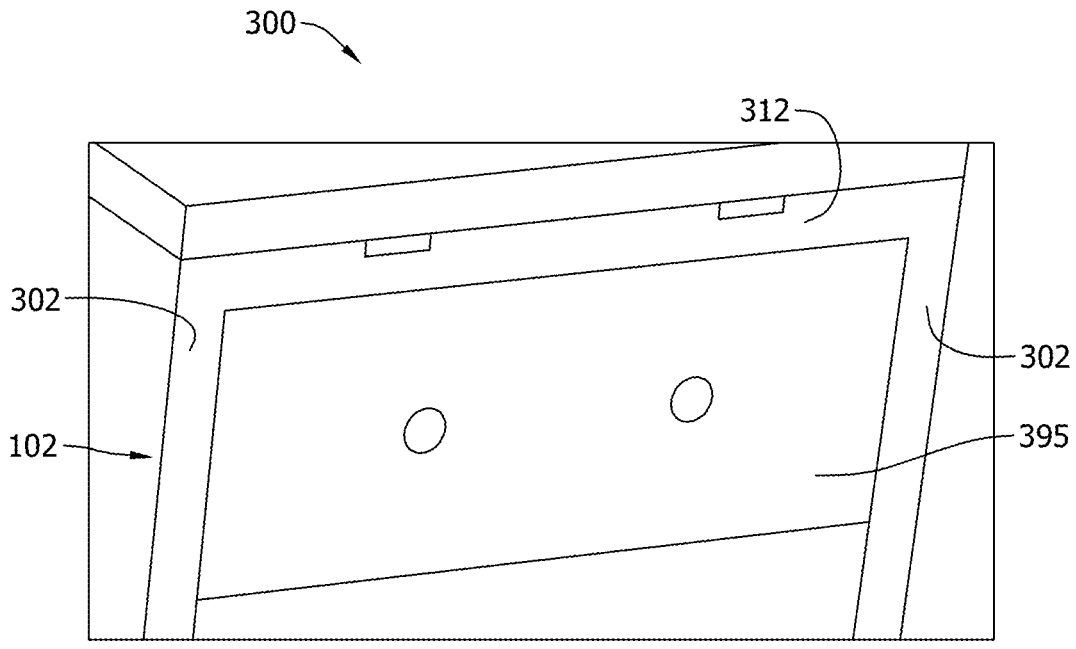
FIG. 3M is a rear partial perspective view of the base module depicted in FIG. 1A, according to an embodiment.
Figure 3N:
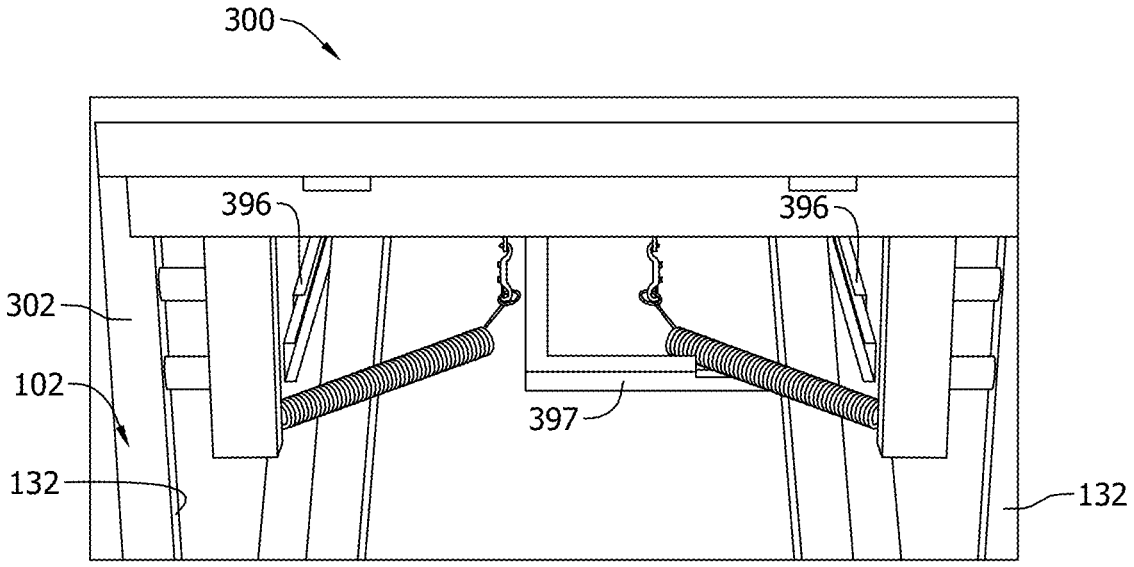
FIG. 3N is a front partial perspective view illustrating additional internal components of the base module depicted in FIG. 1A, according to an embodiment.
Figure 3O:
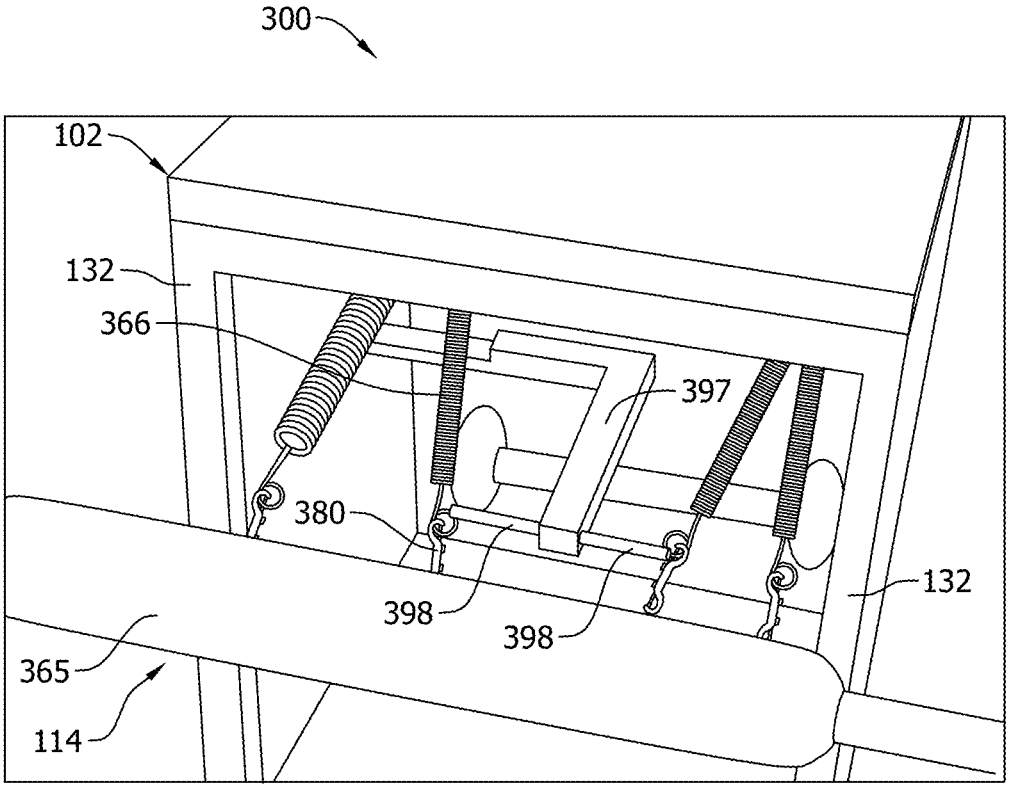
FIG. 3O is an additional front partial perspective view of the embodiment depicted in FIG. 3N.

FIGS. 3A-3O illustrate several views, embodiments, and details of base module 102, both alone, and coupled with platform module 106 in some instances. FIG. 3A is a side view of base module 102, FIG. 1A, illustrating an exemplary structural framework 300. Structural framework 300 advantageously provides easy assembly and disassembly of the modular exercise system 100 for both efficient shipping, and to provide a flexible construction design that easily lends itself to customization.

In an exemplary embodiment, framework 300 includes vertical rear base bars 302 (i.e., a pair of vertical rear base bars 302 on either opposing side of base module 102), side base bars 304, lower rear base bar 306, and lower rear base connection points 308. Rear base bars 302 extend vertically from connection points 308 and connect at base top 128 to a side seat bar 310 and a rear seat bar 312 at rear seat connection points 314 in the same manner as connection point 308. Structural framework 300 of base module 102 thus provides significant structural integrity two base module 102 throughout the variety of intended uses thereof, but while substantially reducing the weight of the overall structure that is typically seen with conventional Pilates chairs that employ, for example, solid wood panels. The versatility of framework 300 further enables a variety of construction design configurations according to weight tolerances and aesthetic considerations. For example, additional vertical base bars 330 may be perpendicularly coupled between side seat bars 310 and side base bars 304 for additional structural integrity.

In in an exemplary embodiment, the structural components of base module 102, back module 104, and platform module 106 may be fabricated primarily from a metal, such as, but not limited to, aluminum or an aluminum alloy. In some embodiments, other portions of system 100 may be formed from continuous metal sheets (or what if desired) and/or may contain additional discrete metal bars providing structural support for the several separate modules 102, 104, 106, as described in greater detail below. As also described below, the innovative design of framework 300 enables particular adjacent modules to be integrally formed as a single unit, or separately detachable in a convenient manner as desired.

FIG. 3B is a rear perspective view of base module 102, FIG. 1A. In this example, base module 102 is illustrated to have a rectangular, cuboid shape, to enable easy modular interconnection, adjustability, and detachability. As seen in the rear perspective of FIG. 3B, opposing vertical rear base bars 302 are each coupled to two respective opposing side base bars 304 and to a lower rear base bar 306. In this configuration, vertical rear base bars 302 extend vertically from connection point 308 and side base bars 304 extend towards forward end 110 along base bottom 130.

FIG. 3C is a front perspective view of base module 102, FIG. 1A. As best seen from the front perspective, in some embodiments, base module 102 may further include a clip bar 384 extending down from a forward seat bar 318 towards base bottom 130. Clip bar 384 may contain one or more handle bars 386 and, in some embodiments, handle bars 386 may extend from clip bar 384 toward vertical forward base bar 320. According to this advantageous configuration, when foot paddle springs 366 are not attached to paddle eyebolts 382 (described further below with respect to FIGS. 3J-K), foot paddle clips 380 may alternatively be easily hooked to the one or more handle bars 386. By this configuration, minimal force applied to securely stow paddle springs 366 of the way, thereby preserving the elasticity of paddle springs 366 while also significantly improving the ability to easily stow and retrieve the springs.

FIG. 3D is a partial view of a portion of structural framework 300, FIG. 3A. In this embodiment, an exemplary joining of the respective bar components at connection point 308 is illustrated. That is, this example, the bar stock forming vertical rear base bar 302 may be configured to include right-angle chisel cutouts such that vertical rear base bar 302 mates with respective portions of the bar stock forming side base bar 304, forming substantially a right angle between therebetween. Further to this example, side base bar 304 is shown to also abut lower rear base bar 306 at connection point 308, thereby creating substantially right angles between all three bars 302, 304, 306. In an exemplary embodiment, a fastener 309 may fixedly join all three bars 302, 304, 306 together in a secure manner.

In an embodiment, rear seat bar 312 may include one or more grooves 316 in the upper portion thereof. Thus, from rear seat connection point 314, side seat bars 310 extend horizontally towards front end 110, in a substantially parallel manner with side base bars 304. Additionally, at front end 110, side seat bars 310 similarly join a forward seat bar 318 and two vertical forward base bars 320 at forward seat connection points 322. Furthermore, from forward seat connection points 322, vertical forward base bars 320 extend toward side base bars 304 and base bottom 130. At base bottom 130, vertical forward base bars 320 and side base bars 304 are coupled together, and also with lower forward base bar 323 at a base lower forward base connection point 324 in a manner similar to that described with respect to connection point 308.

In this example embodiment, the use of aluminum or other similar, light-weight metals, fixedly and securely joined together in the manner described above, creates a light-weight but sturdy structure for base module 102. Through the innovative structural design of framework 300, the individual manufactured components of the module may be more easily shipped then the conventional solid wood panels, and easily assembled at a separate location. Accordingly, in some embodiments, the individual modules may be shipped separately, and added to other modules after the fact. The particular configuration of framework 300 described herein is provided by way of example, and is not intended to be limiting. Other framework configurations are available within the scope of the present application.

FIG. 3E is a partial view of another portion of structural framework 300, FIG. 3A. The partial view depicted in FIG. 3E is similar to the partial view depicted in FIG. 3D, except that where FIG. 3D illustrates a "corner" joining of respective bar ends, FIG. 3E illustrates an exemplary "mid-bar" joining of one framework component to another. More particularly, in this example, side base bars 304 and side seat bars 310 are configured to include bar grooves 331, 332. In this configuration, vertical base bars 330 may then mate with side base bars 304 at side base grooves 331 and to side seat bars 310 at side seat grooves 332. Vertical base bars 330 may thus be included for aesthetic reasons, and/or to provide additional structural integrity for base module 102. Whether provided for structural or aesthetic purposes, this configuration of framework 300 enables one or more panels 333 to be provided between vertical rear base bars 302, vertical forward base bars 320, and additional vertical base bars 330. Panels 333 may then serve to partially or fully conceal internal components of base module 102 from external view, and/or may provide additional aesthetic advantages. In at least one embodiment, panels 333 may include some individual structural integrity, and include hand grips (not shown) within reach of a user. In an alternative embodiment, at least one panel 333 is not included in framework 300, thereby allowing a user to grip an underside of side seat bar 310 for a hand purchase.

FIG. 3F is a side view of base module 102 and the platform module 106 of modular exercise system 100, FIG. 1A. In the embodiment illustrated in FIG. 3F, base module 102 is configured to integrally mate with platform module 106 as a unitary structure. In an exemplary embodiment, base module 102 is integrated with platform module 106 by substituting side base bars 304 with opposing platform side bars 334. Similarly, lower rear base bar 306 may be substituted with an equivalent rear platform bar (not separately shown), and lower forward base bar 323 may be optionally excluded, with platform module 106 alternatively providing such support. Thus, in this embodiment, platform side bars 334 of platform module 106 joining with vertical bars 302, 320 at connection points 308, 335, respectively, in a manner as described above.

Also in a similar manner, vertical base bars 330 may alternatively join side platform bars 334 at respective side platform grooves 336. According to this configuration, Additionally, opposing platform side bars 334 may join together through implementation of a forward platform bar (not shown). It will be appreciated by one of ordinary skill in the art that the construction of the integrated framework structure of base module 102 and platform module 106 is provided by way of example, and not in a limiting manner. It will additionally be appreciated that, according to the embodiment illustrated in FIG. 3F, base module 102 and platform module 106 may be constructed as separate modules, a single integrated module, or as separate modules configured for alteration to integrate together in a unitary construction (i.e., removal of bar 304).

Additionally, base module 102 is shown to include first seat pad 116 coupled to base top 128. In at least one embodiment, first seat pad 116 may extend the entire depth-based top 128. In other embodiments, first seat pad 116 is configured to cover only a front portion of base top 128 and second seat pad 204 covers the remaining portion of base top 128. First and second seat pads 116, 128 as may be formed of a solid material suitable for supporting weight, such as, but not limited to, wood, plastic or metal, and may include other materials, such as, but not limited to, fabric and/or padding material.

FIG. 3G is atop view of base module 102, FIG. 1A. In an exemplary embodiment, base module 102 further includes a rear base plate 340 at base top 128 for coupling with back module 104. Rear base plate 340 may be configured to abut rear seat bar 312, and may be disposed between two opposing side seat bars 310 such that grooves 316 extend from rear seat bar 312 into rear base plate 340. In some embodiments, rear base plate 340 is coupled to side seat bars 310 by one or more base plate screws 342. In at least one embodiment, rear base plate 340 further includes a forward eyehole 344, a rear eyehole 345, and/or one or more knob slots 346, which are described below in greater detail.

FIG. 3H is a bottom view of back module 104, FIG. 1A. In an exemplary embodiment, second seat pad 204 includes a seat board 338 coupled to a seat plate 348. Coupling of seat board 3382 seat plate 348 may be accomplished, for example, using one or more seat plate screws 350. In the exemplary embodiment, seat plate 348 includes runners 352 configured to meet with grooves 316 in rear seat bar 312 and rear base plate 340. In one embodiment, runners 352 may be fabricated from, but not limited to, a rubber- or plastic-containing material. Accordingly, an extended seating area for base module 102 is provided when seat board 338 is coupled with rear base plate 340. This configuration may be particularly advantageous for larger individuals who wish to use the exercise system, but have been excluded by the traditional designs of conventional Pilates equipment.

FIG. 3I is a partial perspective view illustrating internal components of base module 102, FIG. 1A. In an exemplary embodiment, foot paddle unit 114 is coupled to platform top 140 within base module 102 in the forward direction. Alternatively, foot paddle unit 114 may be coupled to base bottom 130, within base module 102, and extend toward front end 110. In at least one embodiment, foot paddle unit 114 is coupled to opposing base sides 132 (e.g., structural framework bars thereof) proximate to base bottom 130 or platform top 140. Other configurations for coupling foot paddle unit 114 contemplated within the scope of the present application.

FIG. 3J is an exploded view of the foot paddle unit 114 of base module 102, FIG. 1A. In an exemplary embodiment, foot paddle unit 114 includes two forward extending bars 354 connected by crossbars 356, 358, with a forward crossbar 356 forward of a middle crossbar 358. Where foot paddle unit 114 is, for example, coupled to platform top 140 or to base bottom 130, forward extending bars 354 may each be further coupled with at least one tombstone screw 360, to respective opposing tombstone pieces 362 attached to platform module 106 or base module 102. In some embodiments, tombstone pieces 362 each contain at least one internal ball bearing (not shown) enabling the foot paddle to rotate about an axis. Conventional foot paddle units utilize piano hinges or pivot joints attached to wooden structural members, and are therefore bulky, and subject to wear over repeated use. According to the present embodiments though, the ball bearing joint within tombstone pieces 362 enables smoother movement in operation of foot paddle unit 114, which is a significant improvement. The structural configuration of tombstone pieces 362 to solid metal frame components further increases the longevity of the hinge. Moreover, the modular construction of system 100 allows for easy removal of foot paddle unit 114 and tombstone pieces 362 when desired, such as for replacement, disassembly, or to make room for other internal components. Foot paddle unit 114 may further include paddle extenders 364 and a foot pad 365, which may be disposed to cover a substantial portion of forward crossbar 356 and/or middle crossbar 358.

In the exemplary embodiment, foot paddle unit 114 further includes one or more foot paddle springs 366. Foot paddle springs 366 may vary diameter, coil wire thickness, and length, to achieve the desired elasticity and length of foot paddle springs 366 in operation of exercise system 100. Foot paddle spring 366 may further include a hook loop 368 for coupling to base module 102, and base module 102 may include at least two spring connection blocks 370 coupled to base module 102 through base connectors 372, which may be fixed using base connection screws 374. Spring connection blocks 370 may each be coupled to a respective connector eyebolt 376 extending from spring connection block 370 toward forward end 110. In one embodiment, the pair of connector eyebolts 376 are substantially the same length. In another embodiment, one of the pair of connector eyebolts 376 is closer to spring connection block 370 then the other. In some embodiments, one or more foot paddle springs 366 may be couple at one end to hook loops 368. Hook loops 368 for the one or more foot paddle springs 366 may connect with connector eyebolts 376.

FIG. 3K is a perspective view illustrating an operational relationship of foot paddle unit 114 and base module 102, FIG. 1A. In some embodiments, one or more foot paddle springs 366 may be coupled at one end to foot paddle clips 380. In this example, foot paddle unit 114 includes at least one paddle eyebolt 382. In other embodiments, two paddle eyebolts 382 are connected to each forward extending bar 354, with paddle eyebolts 382 facing toward the base module 102 and rear end 112. Paddle eyebolts 382 may thus be configured to receive at least one foot paddle clip 380.

In a resting position, that is, when foot paddle springs 366 are in resting position (e.g., with some tension in the foot paddle springs 366), foot paddle unit 114 creates an obtuse angle relative to platform module 106 or base bottom 130. In operation, a user sits on first seat pad 116 with legs facing towards front end 110. The user places a foot or feet on forward crossbar 356 or foot paddle extenders 364 with knees bent, and may then apply force to foot paddle unit 114 by pressing down on foot paddle unit 114. As foot paddle springs 366 stretch, foot paddle unit 114 moves downward towards platform module 106. The number of foot paddle springs 366 attached to foot paddle unit 114 may increase the amount of force necessary to move foot paddle unit 114. Similarly, as noted above, foot paddle springs 366 may vary in diameter, coil wire thickness, and length to achieve desired elasticity. Thus, the advantageous modular construction of system 100 enables variance of the number of foot paddle springs 366, or the type of foot paddle spring 366, to increase or decrease the resistance applied to foot paddle unit 114 as desired.

FIG. 3L is a partial perspective view of base module 102, FIG. 1A. In an exemplary embodiment, base module 102 further includes a nested wheel assembly 387. Wheel assembly 387 includes one or more wheels 388 coupled to a pivot bar 390 (e.g., kidney-shaped, in this example). In the exemplary embodiment, bars 390 are secured to vertical rear base bars 302 by a wheel rotating pin 391, and wheels 388 may be coupled together by a wheel connection rod 392. Wheels 388 may be secured both to wheel connection rod 392 and pivot bar 390, for example, by a wheel screw 393.

In operation, pivot bars 390 are configured to pivot about wheel rotating pin 391, thereby allowing wheels 388 to be adjustably deployed in a number of positions with respect to base module 102. In one such position, wheels 388 may be housed within base module 102 and secured in position by wheel locking spring 394, to allow convenient storage of wheel assembly 387 when not in use (e.g., FIG. 3B). In a fully deployed position though, wheel assembly 387 is configured to pivot about wheel rotating pin 391 such that a portion of both wheels 388 touches an external surface (i.e. ground) behind rear end 112 of base module 102 or platform module 106. Pivot bars 390 thus allow wheels 388 to curve towards the external surface, and wheels 388 may be secured in this deployed position by wheel locking spring 394. When wheel assembly 387 is fully deployed and locked, base module 102 may be tipped backward towards rear end 112 such that the weight of exercise system 100 rests substantially on wheels 388. This position allows for convenient movement of exercise system 100.

FIG. 3M is a rear partial perspective view of base module 102, FIG. 1A. In an exemplary embodiment, base module 102 further includes a drawer assembly 395, for example, between vertical rear base bars 302 and below rear seat bar 312. Drawer assembly 395 may be configured to be easily removed when desired, as described further below with respect to FIG. 3N.

FIG. 3N is a front partial perspective view illustrating additional internal components of base module 102, FIG. 1A. In an exemplary embodiment, drawer assembly 395 is removed from base module 102, exposing two opposing drawer tracks 396, both of which may be directly attached to structural components of base module 102. Because the inclusion of drawer assembly 395 affects the amount of space available for foot paddle springs 366, in some embodiments, an optional L-shaped bar 397 is included within the interior of base module 102 to shield drawer assembly 395 from other internal moving components of base module 102 (e.g., springs). In the exemplary embodiment, L-shaped bar 397 attaches to base side 132 of base module 102 near rear end 112, and extends substantially perpendicular from base side 132 between two opposing base side 132 of base module 102, and then perpendicularly toward front end 110.

FIG. 3O is an additional front partial perspective view of the embodiment depicted in FIG. 3N. In the case where base module 102 includes L-shaped bar 397, one more clip bars 398 may be further included to extend substantially perpendicular to L-shaped bar 397 toward base sides 132. Additionally, foot paddle clips 380, which are attached to foot paddle springs 366, may then be advantageously attached to clip bars 398 when foot paddle springs 366 are not in use. This configuration advantageously prevents unwanted interference between foot paddle springs 366 and drawer assembly 395 when base module 102 includes drawer assembly 395.

Figure 4A:
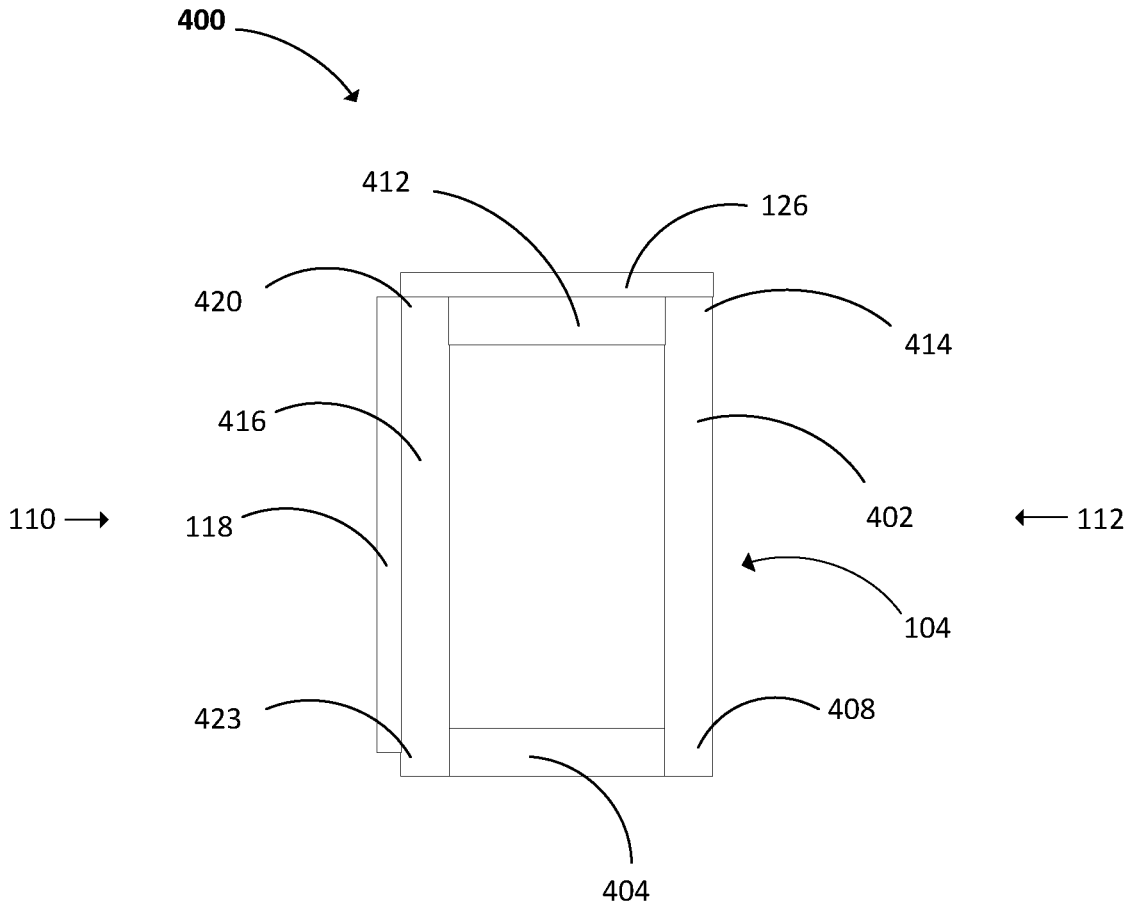
FIG. 4A is a side view of the back module depicted in FIG. 1A, illustrating an exemplary structural framework.

FIG. 4A is a side view of back module 104, FIG. 1A, illustrating an exemplary structural framework 400. Structural framework 400 of back module 104 is similar to structural framework 300 of base module 102, FIG. 3A, in general construction and the use of multiple connected frame bars. In an exemplary embodiment, back module 104 includes two vertical rear back bars 402, two lower side back bars 404, and a lower rear back bar 406 coupled together at rear back corner 408, in a manner similar to that described above with respect to connection point 308.

In an exemplary embodiment, vertical rear back bars 402 extend vertically and, at back top 134, join with an upper rear back bar 410 and upper side back bars 412 at a rear upper corner 414. Upper side back bars 412 extend toward front end 110 of back module 104 and, at front end 110 of upper side back bars 412, join with two vertical forward back bars 416 and upper forward back bar 418 at forward upper corners 420. Also in the exemplary embodiment, vertical forward back bars 416 may extend toward lower side back bars 404 and join lower side back bars 404 and a lower forward back bar 422 at front lower corners 423. This particular configuration is provided by way of example, and is not intended to be limiting. Similar to the framework structures described above, framework 400 may also be formed of similar materials and constructed for similar ease of assembly, disassembly, and shipping.

Figure 4B:
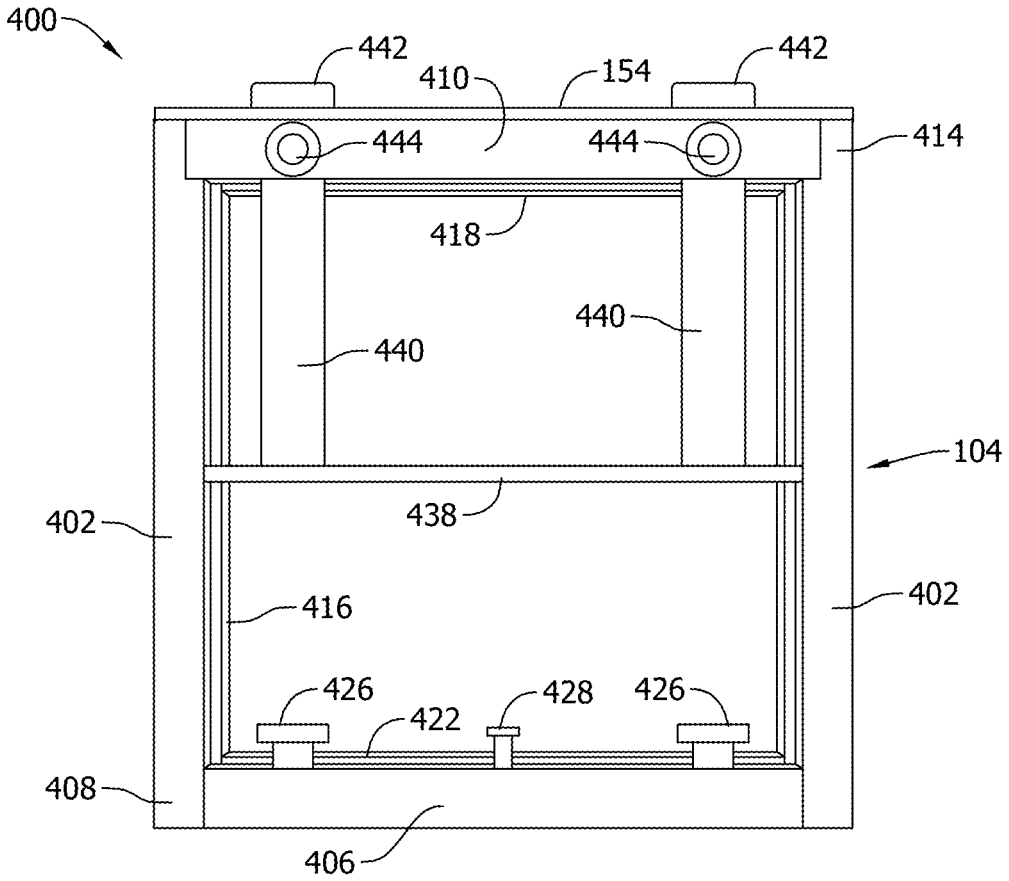
FIG. 4B is a partial rear perspective view of the back module depicted in FIG. 1A, according to an embodiment.

FIG. 4B is a partial rear perspective view of back module 104, FIG. 1A. In an exemplary embodiment, back module 104 includes a coupling plate 424 disposed between two lower side back bars 404, lower rear back bar 406, and lower forward back bar 422. Coupling plate 424 may include one or more coupling knobs 426. In the exemplary embodiment, coupling knobs 426 are disposed near lower rear back bar 406 and lower side back bars 404. In some embodiments, coupling plate 424 further includes a stability knob 428, disposed between lower side back bars 404 near lower forward back bar 422. Stability knob 428 may be disposed along a line connecting coupling knobs 426, or may be offset from coupling knobs 426 along a direction A.

Figure 4C:
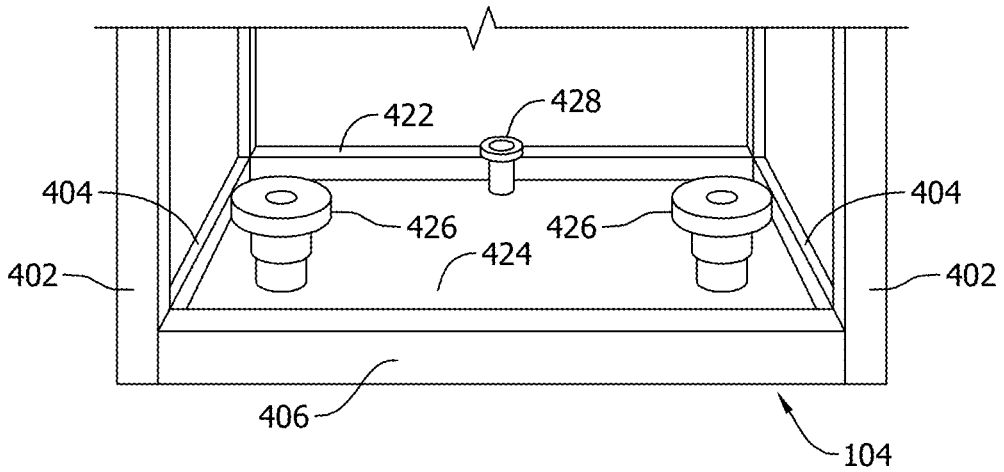
FIG. 4C is a rear view of the back module depicted in FIG. 1A, according to an embodiment.

FIG. 4C is a rear view of back module 104, FIG. 1A. In an exemplary embodiment, back module 104 further includes tower receiving tubes 440. Tower receiving tubes 440 may extend from a stability plate 438 to top back board 154. Tower receiving tubes 440 may be coupled with top back board 154, and also to an upper rear back bar 410. In some embodiments, tower receiving tubes 440 are positioned substantially proximate to stability plate 438 toward rear end 112, and each proximate vertical rear back bar 402. The outer shape of tower receiving tubes 440 is configured to correspond to the respective shape of tower feet 144 of tower module 108. As such, in some embodiments, a horizontal cross section of the tower receiving tubes 440 may be, but is not limed to, a substantially square or rectangular shape, which provides improved stability of tower module 108 in comparison with conventional tower assemblies that use rounded metal rods at the feet.

In an embodiment, tower mating unit 126 further includes top collars 442 about each of tower openings 146. Top collars 442 may, for example, be fabricated from, but not limited to, aluminum, an aluminum alloy, copper or other structurally sound materials. In the exemplary embodiment, top collars 442 each include a respective internal dimension extending through there vertical length for accommodating entry of tower feet 144. The external portions of the top collars 442 may be fabricated (e.g., for aesthetic or structural reasons) to form a variety of shapes, including, but not limited to, rectangular or circular; however, the internal dimensions of top collars 442 are configured to conform an outer cross-sectional shape of tower feet 144 and tower receiving tubes 440 to prevent play of tower module 108 with respect to back module 104 when external forces are exerted against the tower module 108. In some embodiments, back module 104 further includes tower knobs 444 disposed at upper rear back bar 410, and configured to extend into tower receiving tubes 440 two fixedly secure tower feet 144 when inserted into receiving tubes 440.

Figure 4D:
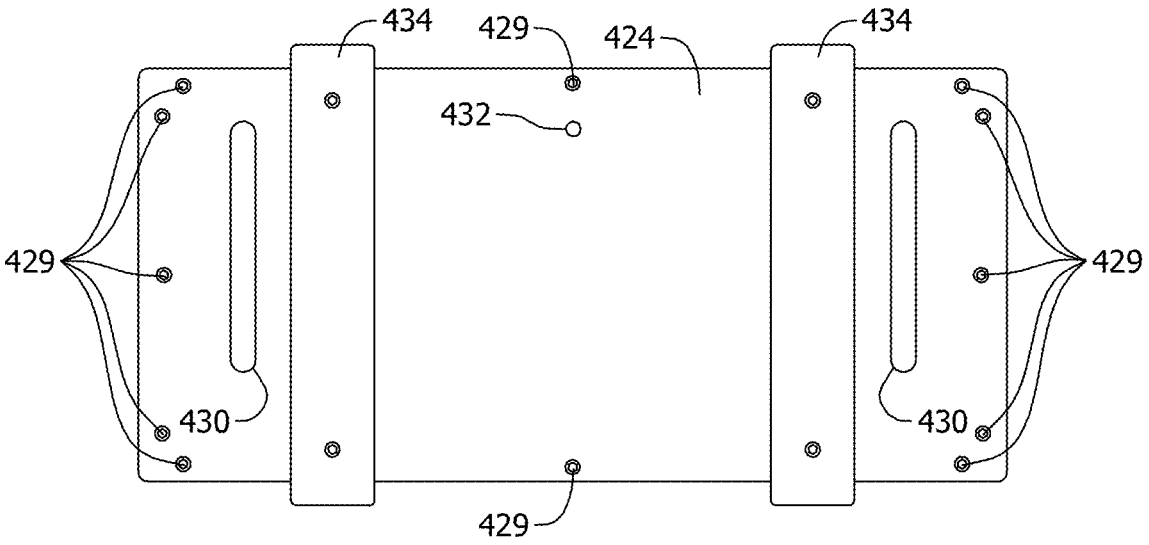
FIG. 4D is a bottom view of the back module depicted in FIG. 1A, according to an alternative embodiment.

FIG. 4D is a bottom view of an alternative configuration for back module 104, FIG. 1A. In an embodiment, coupling plate 424 includes at least one coupling plate screw 429 for joining coupling plate 424 with at least one of lower side back bars 404, lower rear back bar 406, and lower forward back bar 422. Coupling plate 424 may additionally include one or more slots 430, through which one end of a respective coupling knob 426 may travel. Coupling plate 424 a further include a stability knob eyehole 432, through which the end of the stability knob 428 may travel and securely fix thereto. Coupling plate 424 may further include coupling plate runners 434 configured to mate with grooves 316 in rear seat bar 312 and rear base plate 340 of base module 102. In some embodiments, coupling plate runners 434 may be fabricated from, but not limited to, a rubber- or plastic-containing materials.

In exemplary implementation, coupling plate 424 joins to rear seat bar 312 and rear base plate 340 of base module 102 by mating coupling plate runners 434 into the grooves 316. Back module 104 may then be secured to the base module 102 using either one or both coupling knobs 426 secured through the slots 430 and into knob slots 346, and/or stability knob 428 secured through stability knob eyehole 432, or by any combination thereof. In an exemplary embodiment, knobs 426, 428 are threaded and screwed into rear base plate 340. Coupling knobs 426 and stability knob 428 thereby enable back module 104 to be fixedly secured when adjusted horizontally relative to the base module 102. That is, knobs 426, 428 may be tightened to secure the back module 104 in place, but loosened when it is desired to adjust the position of back module 104.

Figure 4E:
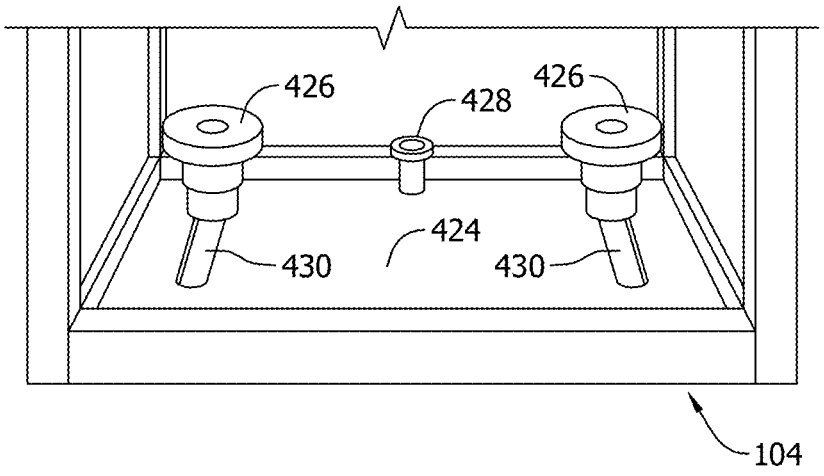
FIG. 4E is a partial rear perspective view of the back module depicted in FIG. 1A, according to an alternative embodiment.

FIG. 4E is a partial rear perspective view of an alternative configuration for back module 104, FIG. 1A. The embodiment illustrated in FIG. 4E is similar to the embodiment illustrated in FIG. 4B, but demonstrates a case where, as back module 104 is slidingly adjusted in direction A, coupling knobs 426 do not move from their original position. In this configuration, coupling knobs 426 are configured to travel through sliding slots 430, whereas stability knob 428 is configured to move with back module 104. To secure the back module 104 in this configuration, coupling knobs 426 are retightened into knob slots 346, while stability knob 428 is tightened into rear eyehole 345.

Figure 4F:
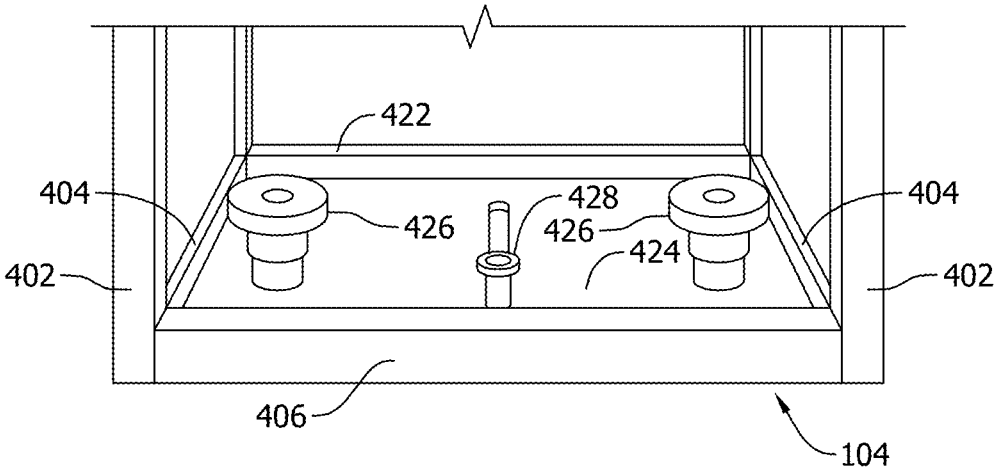
FIG. 4F is a partial rear perspective view of the back module depicted in FIG. 1A, according to an alternative embodiment.

FIG. 4F is a partial rear perspective view of an alternative configuration for back module 104, FIG. 1A. The embodiment illustrated in FIG. 4F is also similar to the embodiment illustrated in FIG. 4B, but demonstrates a case where coupling plate 424 includes stability knob 428 disposed substantially midway between lower side back bars 404 near lower rear back bar 406, substantially in line between coupling knobs 426, as described above.

Figure 4G:
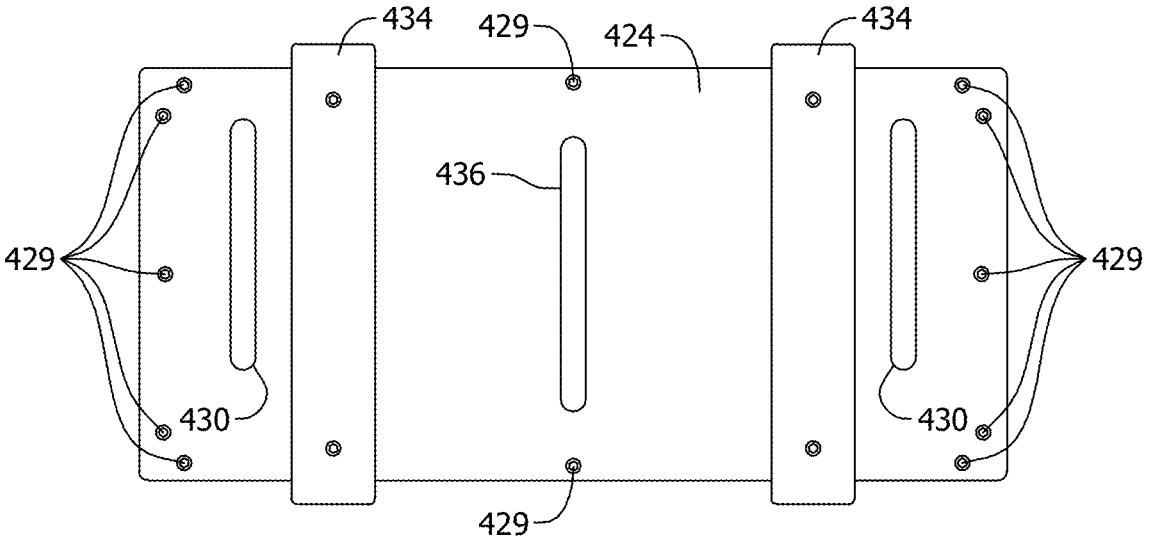
FIG. 4G is a bottom view of the back module depicted in FIG. 1A, according to an alternative embodiment.

FIG. 4G is a bottom view of an alternative configuration for back module 104, FIG. 1A. The embodiment illustrated in FIG. 4G is similar to the embodiment illustrated in FIG. 4D, but demonstrates a case where coupling plate 424 includes stability knob slot 436, through which a portion of stability knob 428 may travel. In in contrast to the embodiment described above with respect to FIG. 4D, stability knob slot 436 is configured to function as an alternative to stability knob eyehole 432.

Figure 4H:
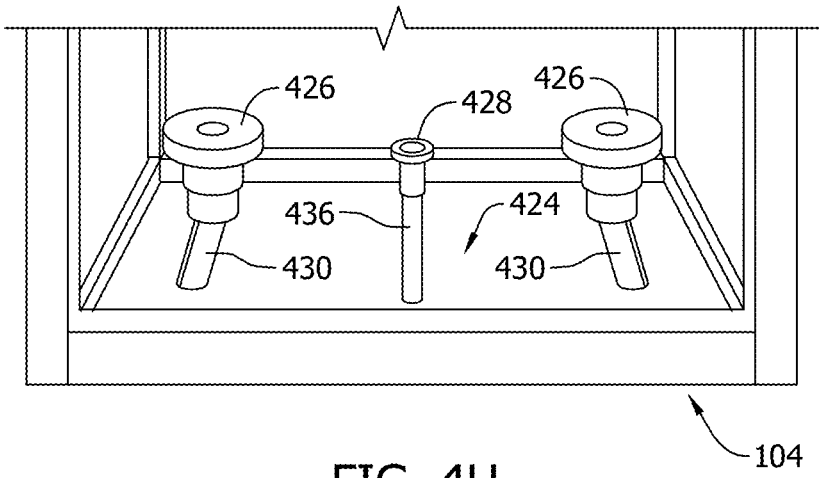
FIG. 4H is a partial rear perspective view of the back module depicted in FIG. 1A, according to an alternative embodiment.

FIG. 4H is a partial rear perspective view of an alternative configuration for back module 104, FIG. 1A. The embodiment illustrated in FIG. 4H is similar to the embodiment illustrated in FIG. 4F, but demonstrates a case where stability knob 428 maintained its position as back module 104 is slidingly adjusted. That is, stability knob 428 remains same position due to the inclusion of stability knob slot 436, and thus allows for a greater range of positions into which stability knob 428 can be secured, thereby providing additional versatility for adjustable seat depth ranges.

Figure 4I:
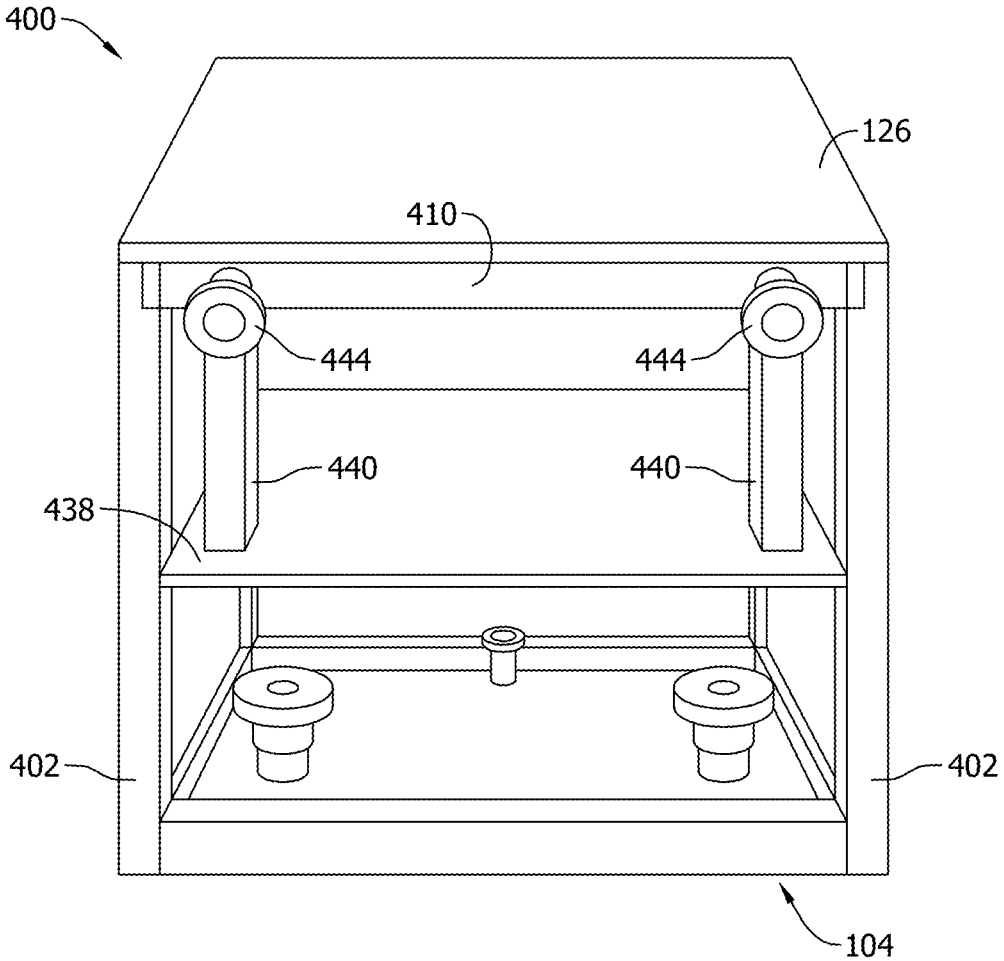
FIG. 4I is a partial rear perspective view of the back module depicted in FIG. 1A, according to an embodiment.

FIG. 4I is a partial rear perspective view of an alternative configuration for back module 104, FIG. 1A. In an exemplary embodiment, stability plate 438 of back module 104 joins with vertical rear back bars 402 and vertical forward back bars 416 substantially between lower rear back bar 406 and upper rear back bar 410. In sum embodiments, the stability plate 438 is disposed nearer to either lower rear back bar 406 or upper rear back bar 410. Stability plate 438 may thus be configured to cover all or part of the area between vertical rear back bars 402 and vertical forward back bars 416 such that, in some embodiments, stability plate 438 is configured to cover the entire area between all of the vertical bar bars 402, 416.

Figure 5:
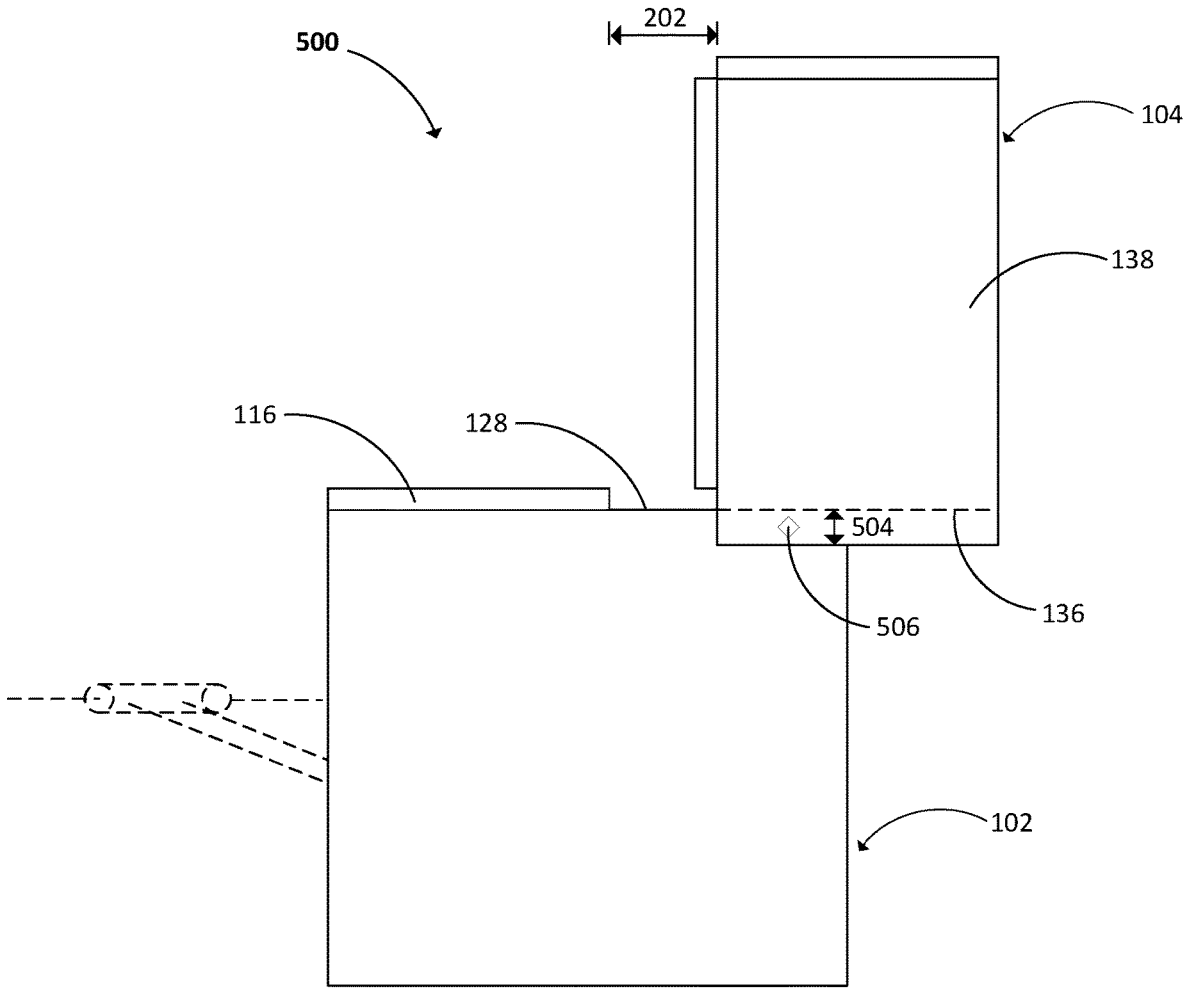
FIG. 5 is a side view of an adjustable high-back chair, according to an alternative embodiment.

FIG. 5 is a side view of an adjustable high-back chair 500. In this embodiment, back module 104 is fabricated such that two opposing back sides 138 (only one shown in FIG. 5) extend a distance 502 below back bottom 136, creating additional back side overhangs 504. In this configuration, back bottom 136 may be coupled to base top 128 with the internal surface of additional back side overhangs 504 substantially abutting the external surface of two opposing base sides 132. In this embodiment, a back affixer 506, such as, but not limited to, a screw or a pin, may be coupled through additional back side overhangs 504 and into base module 102. This configuration may be coupled combined with other features of base module 102 and back module 104 as described above. With this configuration, back module 104 may be shifted an additional seat depth 202 and then tightened into this position by back affixer 506. High-back chair 500 thus represents an alternative configuration to high-back chair 200, described above, in that back module 104 is slidingly adjustable in the same manner, but fixes at respective sides of base module 102, instead of slots in groups in the top portion.

Figure 6:
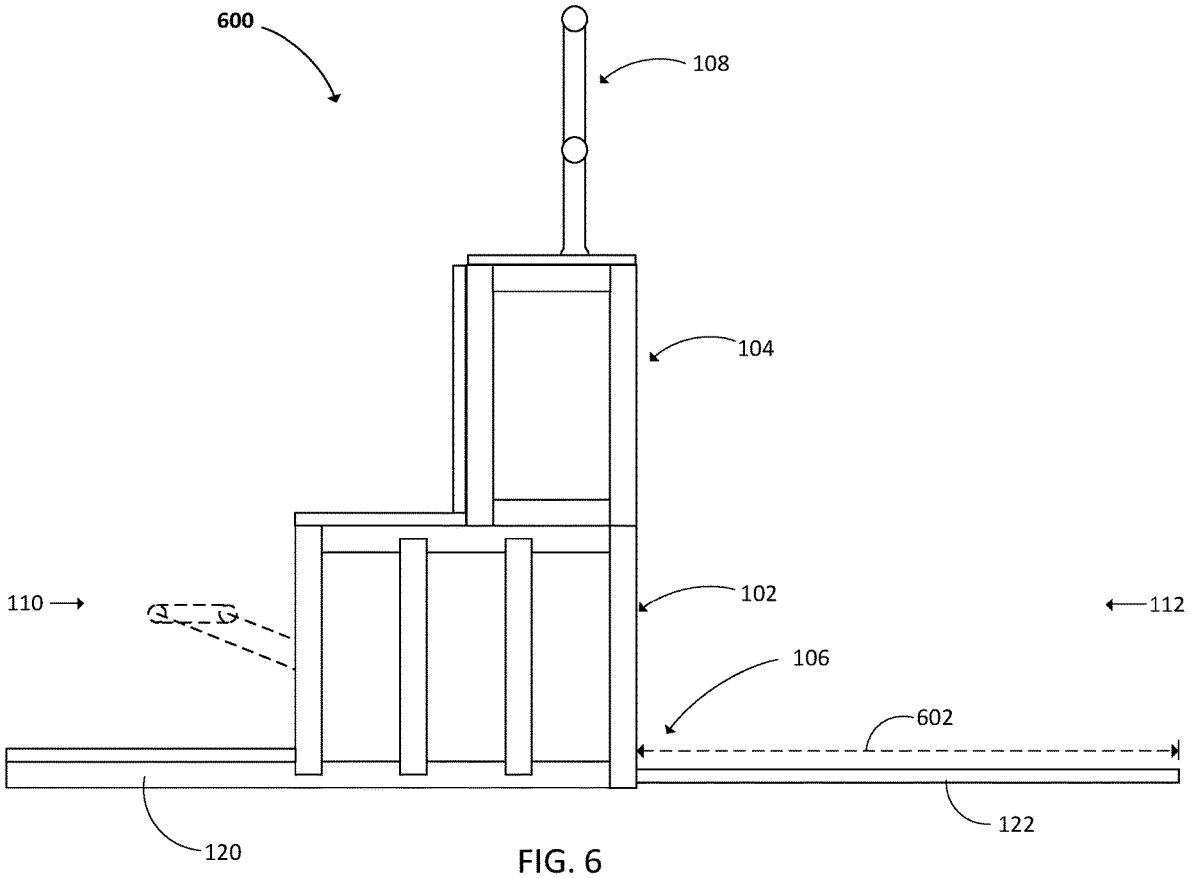
FIG. 6 is a side view of an adjustable tower apparatus, according to an embodiment.

FIG. 6 is a side view of an adjustable tower apparatus 600. In this embodiment, base module 102, back module 104, and platform module 106 may be separate modules coupled together, as described above, or one or more such modules may be one integrally constructed as a single assembly, or any combination thereof. For example, base module 102 and back module 104 maybe integrated as a single seat assembly (e.g., a non-adjustable high-back chair 200).

In an embodiment, rear stabilizer portion 122 may be nested within the platform module 106 or, as described above, rear stabilizer portion 122 may be pulled from rear end 112 of platform module 106 such that all or part of rear stabilizer portion 122 is removed from platform module 106 and moved a rear platform distance 602. Rear stabilizer portion 122 may provide additional space for using exercise system 100. In one embodiment, rear stabilizer portion 122 may be used in conjunction with tower module 108 for exercises performed behind the rear end 112 of exercise system 100, as described above.

Figure 7A:
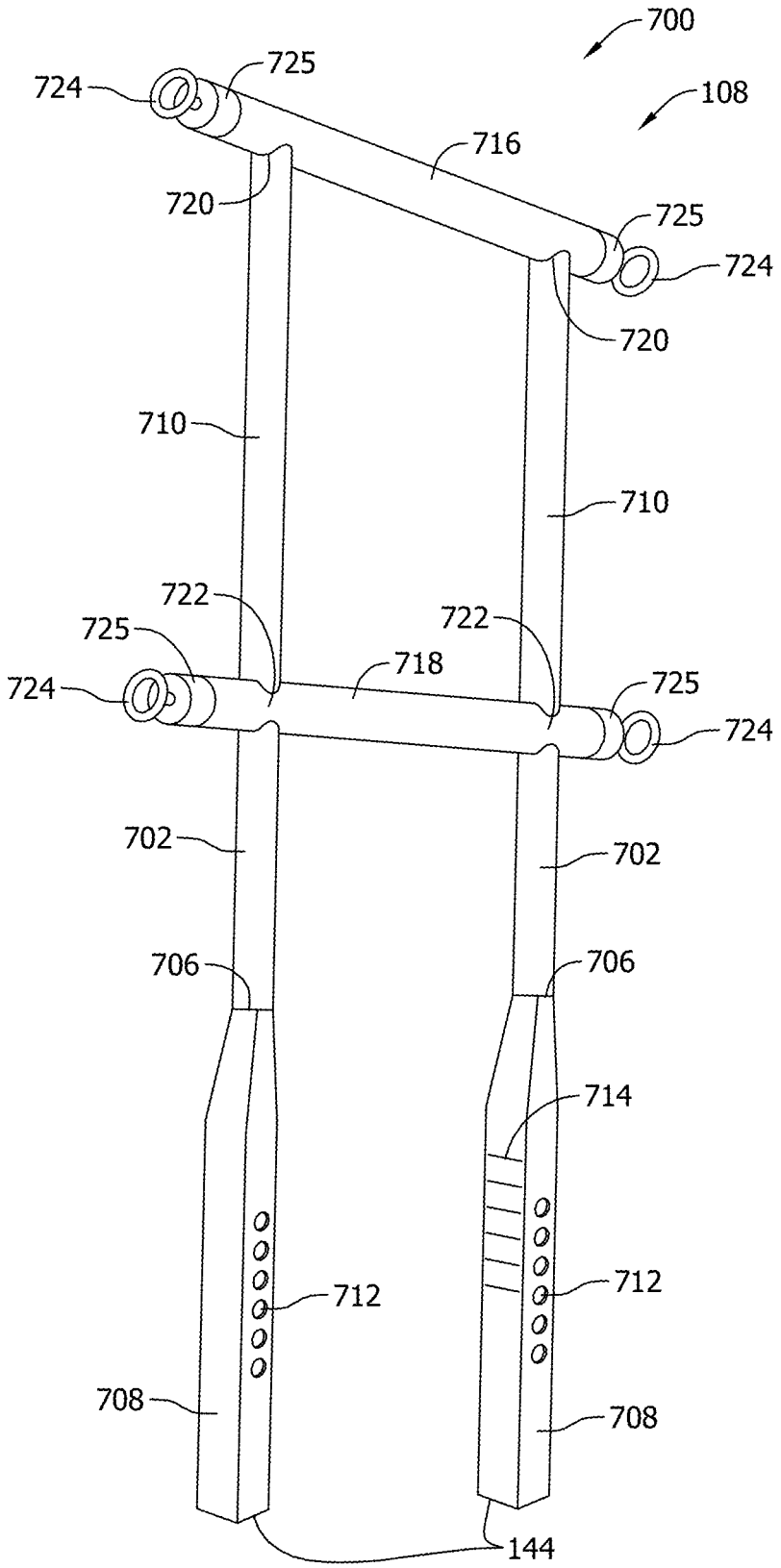
FIG. 7A is a perspective view of the tower module depicted in FIG. 1A, according to an embodiment.

FIG. 7A is a perspective view of tower module 108, FIG. 1A. In some embodiments, tower module 108 comprises two substantially parallel tower bars 702. Tower bars 702 may have a variety of configurations, however, in this example embodiment, at lower end 704 of tower bars 702, tower bars 702 are shaped such that a perpendicular cross section of the tower bar 702 forms substantially a square. This substantially square shape continues through the tower bars 702 until is tapers into a substantially circular shape at a tower junction 706. Between lower end 704 and tower junction 706, the "square section" 708, a perpendicular cross section forms substantially a square, except as square section 708 begins to taper at tower junction 706. After tower junction 706, a perpendicular cross sectional view of tower bars 702 is configured to form substantially a circle. This section is the "circular section" 710 of tower bars 702. In some embodiments, square sections 708 and circular section 710 may be made from one continuous piece of material such that tower bars 702 are each one continuous piece. In other embodiments, square sections 708 and circular sections 710 may be coupled together at tower junction 706. The above components of tower module 108 may be fabricated from, but not limited to, steel, aluminum or aluminum alloys.

Within the square section 708, one or more adjustment holes 512 may be added to tower bars 702. In order to assure the same height during operation, the adjustment holes must be placed in substantially the same place along the face facing rear end 112 of two tower bars 702. Within square section 708, tower bars 702 may additionally contain adjustment notches 714 etched into a side of square section 708. Adjustment notches 714 may be used to gauge the height of tower module 108 during operation. In some embodiments, adjustment notches 714 may be color coded to help determine the height of tower bars 702.

Two tower bars 702 may be joined by at least one crossbar 716, 718 that is substantially perpendicular to two tower bars 702. In an example embodiment, tower bars 702 are coupled together by two crossbars 716, 718, with one upper crossbar 716 coupled to tower top 142 at the end of circular sections 710 of two tower bars 702 at upper tower connection points 720 and another lower crossbar 718 coupled to circular sections 710 of two tower bars 702 at lower tower connection points 722, located between upper crossbar 716 and tower junction 706. In some embodiments, perpendicular cross sections of upper crossbar 716 and lower crossbar 718 are substantially circular. In some embodiments, length of crossbars 716, 718 is substantially the same between the two towers. One or both crossbars 716, 718 may extend outward from two tower bars 702 from tower connection points 720, 722 for a distance. In some embodiments, this outward distance may be substantially the same for both crossbars 716, 718 or one may extend further outward than the other.

Additionally, in some embodiments, crossbars 716, 718 may have tower eyehooks 724 coupled to one or both ends by tower eyehook couplers 725. In some further embodiments, one or more eyehooks and/or one or more tower eyehook coupling systems (FIG. 14, below) may be configured to permanently lock in one position.

Figure 7B:
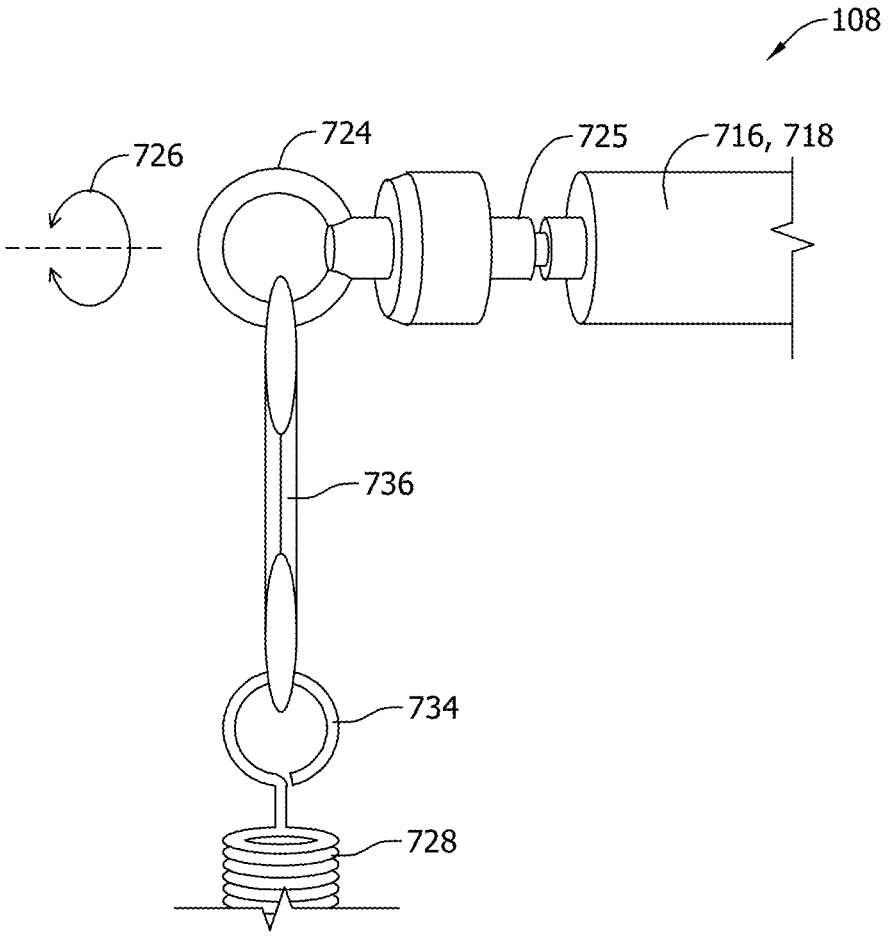
FIG. 7B is a partial perspective view of the coupling system of the tower module depicted in FIG. 7A, according to an embodiment.

FIG. 7B is a partial perspective view of the coupling systems depicted in FIG. 7A. In an exemplary embodiment, each coupling system includes one or more tower eyehooks 724 and/or one or more tower eyehook couplers 725, which may be configured to swivel about an axis 726 parallel to crossbars 716, 718.

Figure 7C:
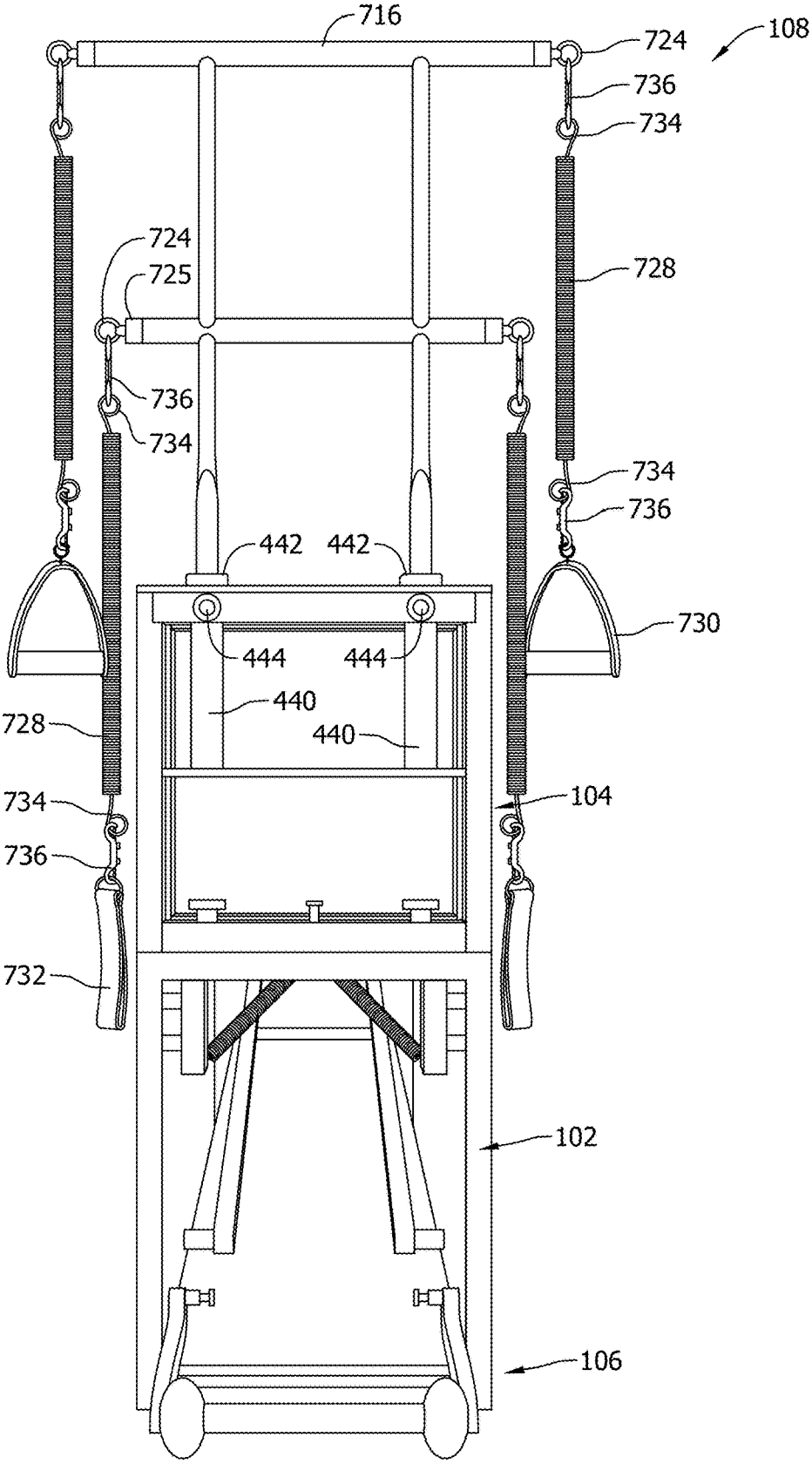
FIG. 7C is a rear perspective view of the modular exercise system depicted in FIG. 1A, according to an embodiment.

FIG. 7C is a rear perspective view of modular exercise system 100, FIG. 1A, incorporating tower module 108. In an exemplary embodiment, tower module 108 may be coupled to back module 104 and back module 104 may be coupled to base module 102 and platform module 106. In the example embodiment, lower end 704 (not shown in FIG. 7C) of tower module 108 is lowered through top collars 442 of back module 104 into tower receiving tubes 440, with adjustment holes 712 (not shown in FIG. 7C) facing towards rear end 112 of the back module 104. In operation, tower knobs 444 may be used to adjust the height of tower module 108 once it passes into tower receiving tubes 440. Tower knobs 444 contain a pin (not shown) that passes through upper rear back bar 410 into tower receiving tubes 440. The pin may be coupled to adjustment holes 512 of tower module 108, securing tower module 108 at a specified height. Accordingly, various types of tower springs 728 and spring grips 730, 732 may be attached to tower module 108 at tower eyehooks 724.

Figure 7D:
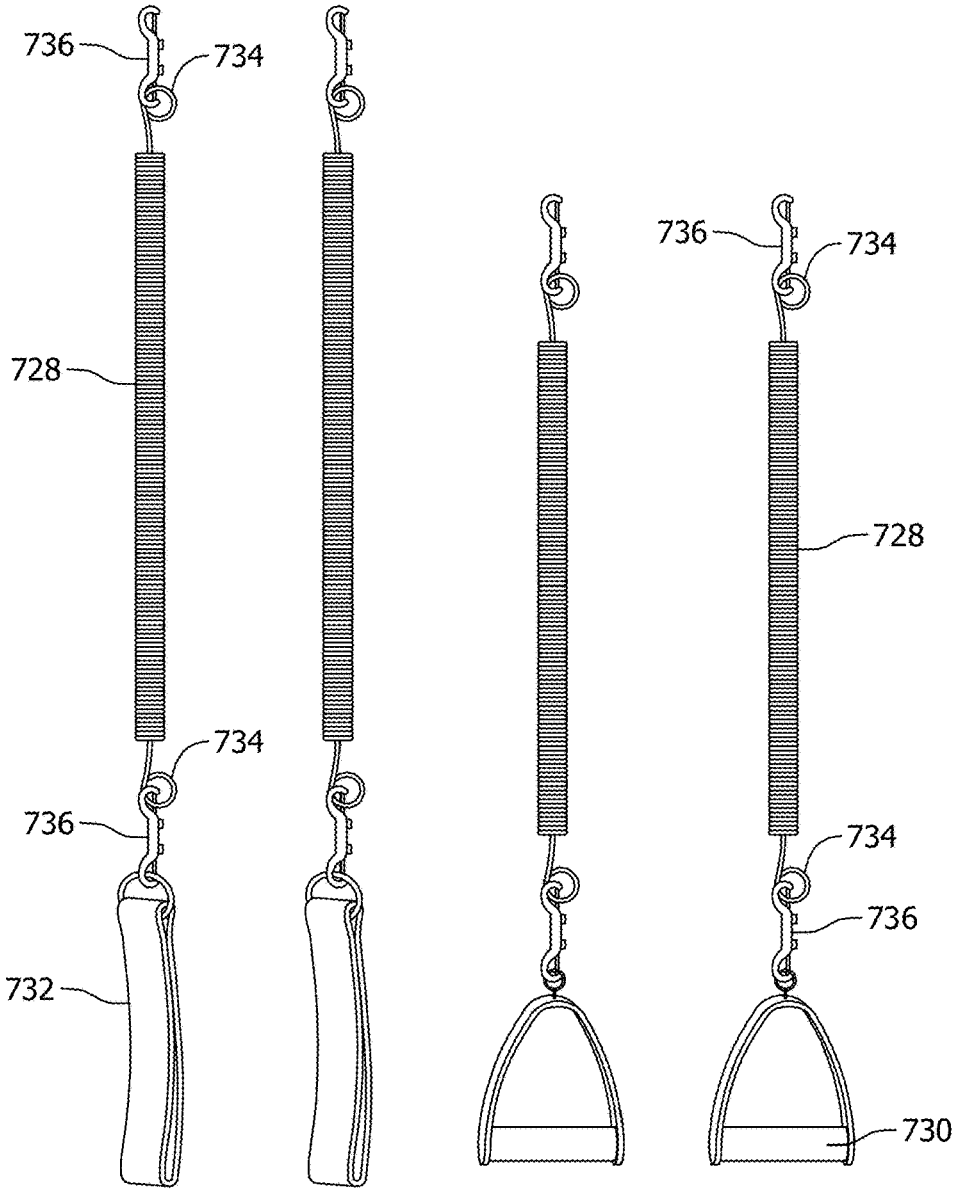
FIG. 7D is a perspective view of the tower springs and tower grips of the tower module of the modular exercise system depicted in FIG. 7C.

FIG. 7D is a perspective view of tower springs 728 and tower grips 730, FIG. 7C. FIG. 7D illustrates an example embodiment of tower springs 728 and spring grips 730, 732. Tower springs 728 may vary in diameter, coil wire thickness, and length to achieve the necessary elasticity and length of tower springs 728 in operation of exercise system 100. Tower springs 728 may be coupled to tower spring eyehooks 534 at one or both ends. Each tower spring eyehooks 734 may be coupled to one or more tower clips 736. At least one spring grip 730, 732 may be coupled to one or more tower clips 736. As shown in FIG. 7C, spring grips 730, 732 may consist of a handle spring grip 730, a strap spring grip 732 or other suitable grips for gripping the tower springs 728 for exercise. In one example embodiment, a spring grip 730, 732 may be attached to one tower clip 736 coupled to tower spring eyehook 734 at one end of a tower spring 728. At the opposing end of tower spring 728 with tower spring eyehook 734, tower clip 736 may be coupled to tower eyehook 724. In one example embodiment, as shown in FIG. 7C, when in operation, four tower springs 728 with spring grips 730, 732 may be coupled to tower module 108 at each of the four tower eyehooks 724. It will be appreciated that more or less tower springs 728 can be attached to tower module 108 depending on the desired operation of exercise system 100.

In one embodiment, as described above, square sections 708 of tower bars 702 contain a substantially square perpendicular cross-section and tower receiving tubes 440 also contain a substantially square perpendicular cross-section. When square sections 708 of tower bars 702 are coupled within the tower receiving tubes 440, the coupling creates a substantially tight fit between the internal faces of tower receiving tubes 440 and the external faces of square sections 708 of tower bars 702. This square configuration both tower bars 702 and tower receiving tubes 440 helps prevent shacking of tower module 108 when force is applied to the tower by the movement of tower springs 728 during use because there are up to four points of contact for tower bars 702 to tower receiving tubes 440. Other towers on the market currently have circular configurations, which, when placed into circular tubes, can create a less stable coupling of these towers to the circular tubes. As such, when in use, these circular towers can shake within the circular tubes, leading to a less smooth motion when the circular tower is in use.

As discussed above, in some embodiments, tower eyehole 724, tower eyehook coupler 725, or both, may swivel. This swivel feature allows tower eyehook 724 to follow the angle of an attached tower spring 728. This feature provides a smooth angle between tower eyehook 724 and attached tower spring 728 and helps prevent a jerking motion when tower spring 728 is in use, providing a smoother motion during operation of exercise system 100.

Figure 7E:
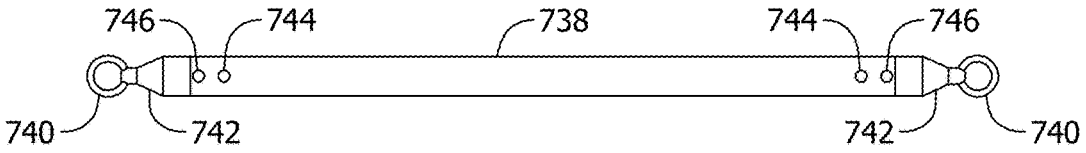
FIG. 7E is a perspective view of a roll bar that may be implemented with the tower module of the modular exercise system depicted in FIG. 7C.

FIG. 7E is a perspective view of a roll bar that may be implemented with the tower module of the modular exercise system depicted in FIG. 7C. In some embodiments, two tower springs 728 attached to the same crossbar 216 or 218 may be coupled to a roll-down bar 738 (not shown). FIG. 7E provides an example embodiment for roll-down bar 738. In this example embodiment, a perpendicular cross-section of the roll-down bar 738 may be substantially circular, however, roll-down bar 738 may be any shape that will allow roll-down bar 738 to function as described here. Further, in roll-down bar 738 may be fabricated from, but not limited to, stainless steel. It may be any length to perform the functions describes herein, however, in the exemplary embodiment, roll-down bar 738 is substantially the same length of the crossbar 216 or 218 it is coupled to. Additionally, roll-down bar 738 may couple to other pieces of equipment within exercise system 100 or other exercise equipment, such as a trapeze table.

In some embodiments, roll-down bar eyehooks 740 may be coupled to the opposing ends of roll-down bar 738 at eyehook interface points 742. Eyehooks 740 may be substantially stationary or may swivel about an axis, as described above for tower eyehooks 724. Additionally, as shown in the exemplary embodiment in FIG. 7E, roll-down bar eyehooks 740 may be configured to both lock into a particular configuration or swivel about an axis at eyehook interface points 742. In this embodiment, eyehooks 740 may be coupled to roll-down bar 738 by inward bolts 744. Each eyehook 740 has an internal member (not shown) that extends into roll-down bar 738. Inward bolts 744 extend through roll-down bar 738 and into or through the internal members of roll-down bar eyehooks 740. In this embodiment, an additional outward bolt 746 is placed between inward bolt 744 and eyehook interface points 742 at each of the opposing ends of roll-down bar 738. Outward bolts 746 extend through roll-down bar 738 and couple to roll-down bar eyehooks 740 such that when outward bolts 746 are tightened, the roll-down bar eyehooks 740 are in a locked configuration and when outward bolts 746 are loosened, the roll-down bar eyehooks 740 swivel about an axis at eyehook interface points 742. The bolts 744, 746 may be, but are not limited to, Allen bolts.

The ability for roll-down bar eyehooks 740 of roll-down bar 738 to both swivel about an axis, and/or remain in a locked configuration, adds additional versatility to roll-down bar 738. For some exercises, the swivel ability of the may provide for a smoother motion is connected to springs or other similar exercise equipment. In other exercises, it may be advantageous to have the roll-down bar eyehooks 740 in a locked position.

Figure 8:
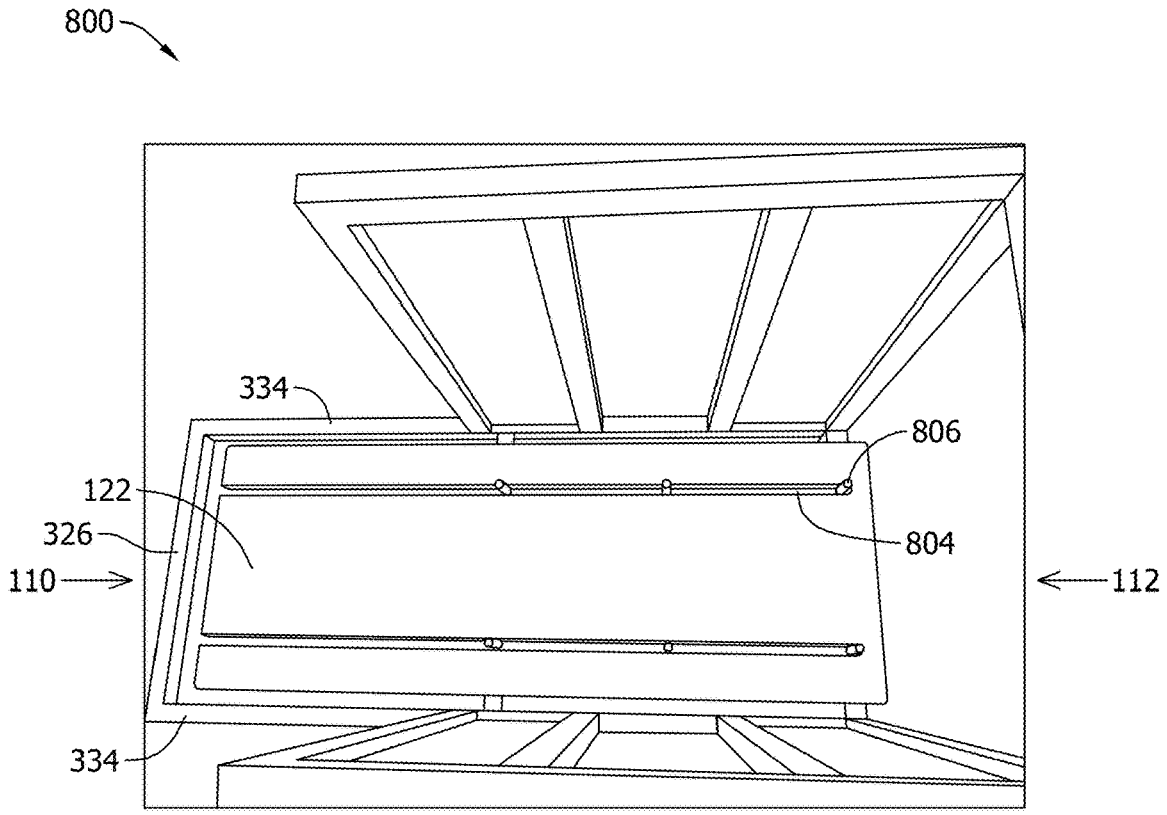
FIG. 8 is an internal top perspective view of the platform module depicted in FIG. 1A, according to an embodiment.

FIG. 8 is an internal top perspective view of platform module 106, FIG. 1A. In an exemplary embodiment, rear stabilizer portion 122 may be fabricated from one sheet of material, such as, but not limited to, aluminum or an aluminum alloy. Rear stabilizer portion 122 may contain one or more platform slots 804, which, in some embodiments, may extend from the forward end 110 of rear stabilizer portion 122 towards the rear end 112. In some embodiments, platform slot 804 vertically through extend through the rear stabilizer portion 122 creating a complete opening for platform slot 804. One or more platform fastening screws 806 may be attached to platform module 106. The one or more platform fastening screws 806 may extend vertically towards base module 102 from platform module 106 and the one or more platform fastening screws 806 may be configured such that the one or more platform fastening screws 806 are within platform slot 804 when rear stabilizer portion 122 is housed within platform module 106. In a further embodiment, platform board 156 may be coupled to platform module 106 above rear stabilizer portion 122 and one or more platform fastening screws 806 may extend through the platform board 156 (not shown). A platform knob or knobs may be coupled to the platform fastening screws 806 above the platform board 156 (not shown). In operation, platform knob or knobs may be tightened to secure rear stabilizer portion 122 in place or may be loosened to allow movement of the rear platform about a forward-rear axis.

Figure 9:
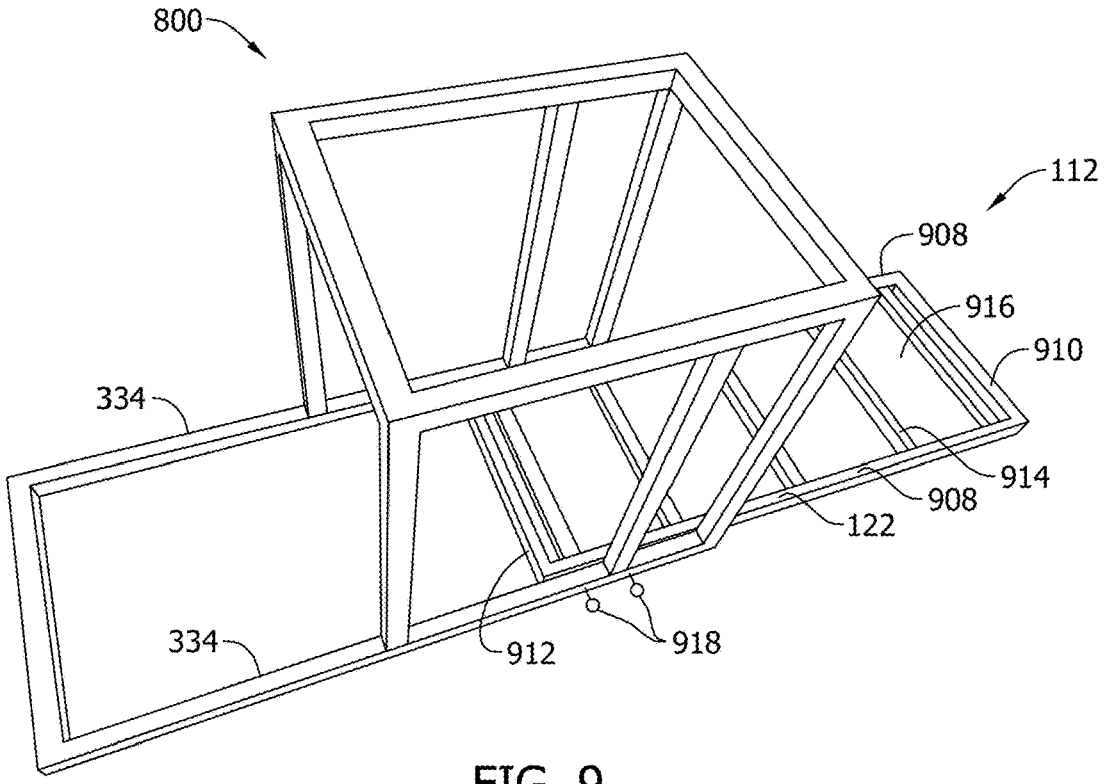
FIG. 9 is a perspective view illustrating an operational relationship of the base module and the platform module depicted in FIG. 1A, according to an embodiment.

FIG. 9 is a perspective view illustrating an operational relationship of base module 102 and platform module 106, FIG. 1A. In this embodiment, rear stabilizer portion 122 has a more modular construction than the embodiment described with reference to FIG. 8, such that rear stabilizer portion 122 may be comprised of two rear platform side bars 908, a rear platform rear bar 910, and a rear platform forward bar 912, wherein rear platform side bars 908 are each coupled to rear platform rear bar 910 and rear platform forward bar 912. All rear platform bars 908, 910, 912 are configured to fit between opposing platform side bars 334 when rear platform bars 908, 910, 912 are assembled. In this embodiment, rear stabilizer portion 122 may contain one or more rear platform crossbars 914 placed substantially perpendicular to rear platform side bars 908 and configured to couple to each opposing rear platform side bar 908. One or more rear platform gaps 916 may be formed between rear platform rear bar 910, rear platform forward bar 912, and/or rear platform crossbars 914. Within these gaps, rear platform boards (not shown) may be placed. The rear platform boards may consist of a solid material suitable for supporting weight, such as, but not limited to, wood, plastic or metal. Additionally, in some further embodiments, the rear platform boards may be coupled to other materials, such as, but not limited to, fabric and/or padding material. Additionally in this embodiment, screws may be coupled through platform side bars 334 such that they may be tightened to secure rear stabilizer portion 122 in place or loosened to adjust the position of rear stabilizer portion 122.

When coupled to seat system 108 with tower module 108 attached, rear stabilizer portion 122 may function to stabilize the seat system 108 when the tower module 108 is engaged during exercise off behind rear end 112. Either embodiment described with reference to FIGS. 8 and 9, or other similar embodiments, may be used to stabilize exercise system 100 with tower module 108 attached. The embodiment described with reference to FIG. 9 provides some additional advantages. Because of its modular construction, the pieces may be broken apart for shipment or storage and later assembled. Further, the modular construction allows rear stabilizer portion 122 to be more lightweight than a solid platform, such as the one described with reference to FIG. 8. This lighter weight makes it easier for a user of exercise system 100 to remove rear stabilizer portion 122 from platform module 106, when finished with the intended use, return rear stabilizer portion 122 into platform 106 module for storage, thus saving space in the area behind rear end 112 and allowing for transport of rear stabilizer portion 122 with the rest of exercise system 100 when wheels 388 are used.

Figure 10:
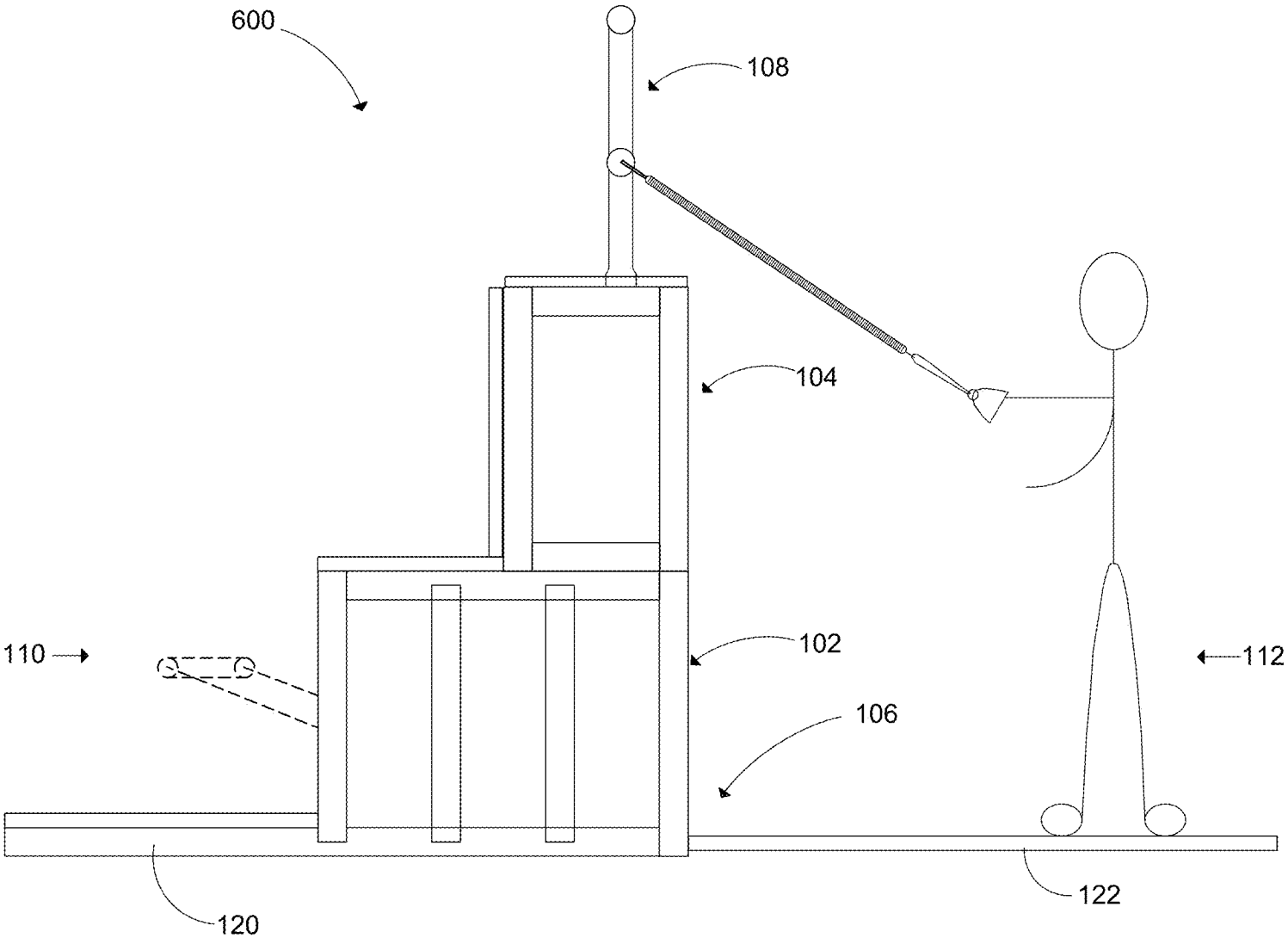
FIG. 10 is a side view illustrating an operational principle of the tower module integrated with the modular exercise system depicted in FIG. 1A, according to an embodiment.

FIG. 10 is a side view illustrating an operational principle 1000 of tower module 108 integrated with modular exercise system 100, FIG. 1A. In one example of operation of exercise system 100 with tower module 108 coupled to back module 104, as illustrated by FIG. 10, a person may stand in the space behind rear end 112 and grip in one hand one spring grip 730, 732 attached to a tower spring 728 coupled to tower module 108. The person may then, for example, step a distance away from exercise system 100 until the spring is taut with a substantially straight line created between their arm stretched straight in front of him and the line of tower spring 728. From this position, the person may pull grip 730, 732 backwards, to a position where their upper arm and elbow is substantially parallel to their torso. This sample exercise may provide exercise for one of the trapezius muscles, the latissimus dorsi, or other muscles. It will be appreciated that this configuration of the tower module 108 provides a variety of possible exercises and is not limited to the one example embodiment.

Figure 11B:
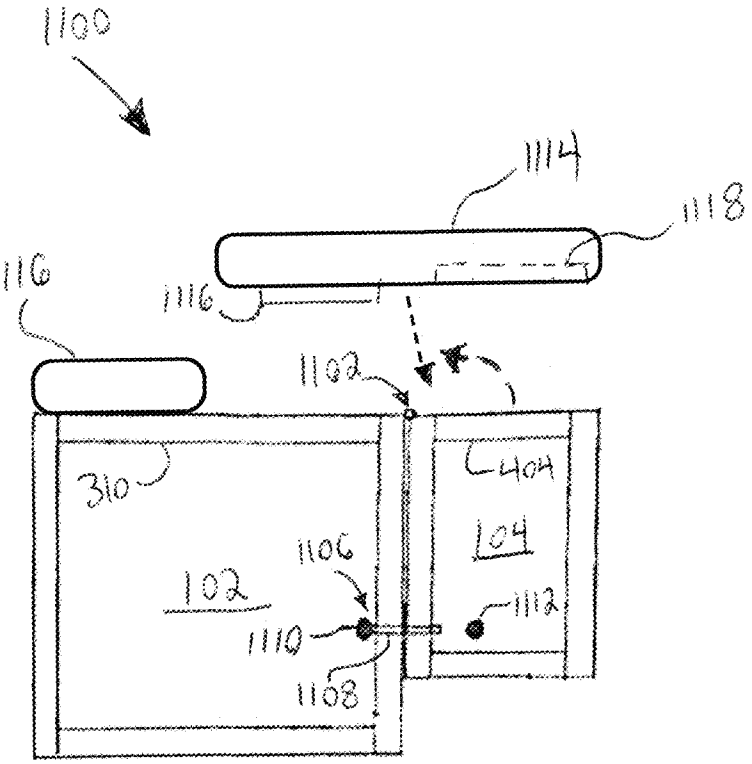
FIG. 11B is a side perspective view illustrating an operational principle of the exemplary high back chair depicted in FIG. 11A, according to an embodiment.
Figure 11A:
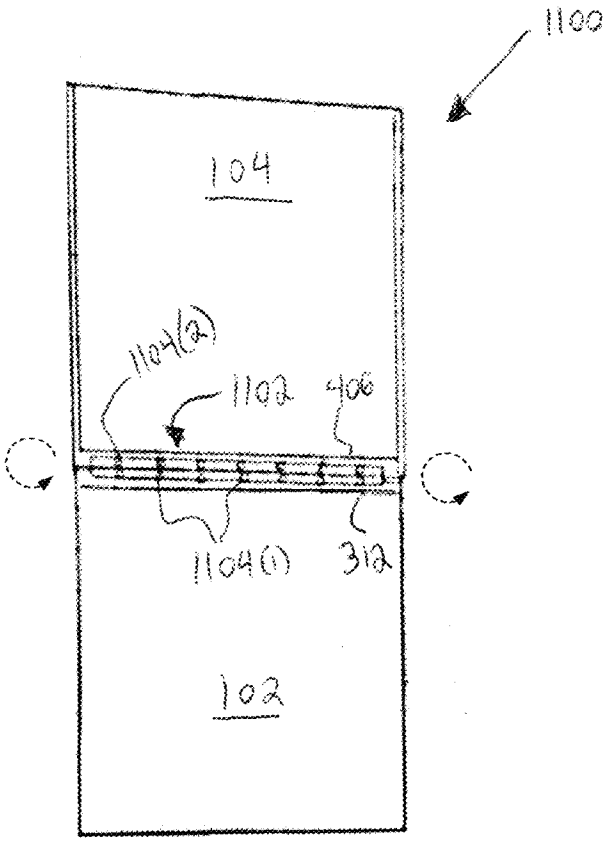
FIG. 11A is a rear perspective view depicting an exemplary high back chair implementing a folding hinge system, according to an embodiment.

FIG. 11A is a rear perspective view depicting an exemplary high back chair 1100 implementing a folding hinge system 1102. High back chair 1100 may be similar to high back chair 200, FIG. 2A, and includes base module 102 and back module 104. Different from high back chair 200, high back chair 1100 includes folding hinge system 1102 to securely connect back module 104 to base module 102. In the embodiment shown in FIG. 11A, folding hinge system 1102 is a continuous hinge mechanism fixed to base module at a plurality of first attachment points 1104(1), and to back module at a plurality of second attachment points 1104(2). In an exemplary embodiment, first attachment points 1104 (1) may be disposed along rear seat bar 312, FIG. 3B, and secured thereto by fixed connectors (e.g., screws, rivets, etc.), and second attachment points 1104(2) may be disposed along rear back bar 406, FIG. 4B, and secured thereto by similar fixed connectors. In operation, folding hinge system 1102 enables back module to tilt backward, toward the rear of high back chair 1100, as shown in FIG. 11B, below.

FIG. 11B is a side perspective view illustrating an operational principle of exemplary high back chair 1100, FIG. 11A. In the embodiment shown in FIG. 11B, back module is shown tilted all the way rearwards about folding hinge system 1102 until the rearmost surface of back module 104 contacts the rearmost surface of base module 102. When so folded together, an upper surface of side seat bar 310, FIG. 3A, aligns with a lower surface of lower side back bar 404, FIG. 4A, along a substantially continual plane parallel to platform module 106, FIG. 1A.

In the folded configuration shown in FIG. 11B, base module 102 may be detachably secured to back module 104 by a folding attachment assembly 1106, which may, for example, include a captive pin 1108 attached to a fixed knob 1110 disposed within base module 102. Captive pin may further include a threaded end configured for mating with a threaded connector 1112, such as a ball knob, disposed within back module 104. Alternatively, captive pin 1108 and fixed knob 1110 are disposed within back module 104, and threaded connector is disposed within base module 102. In some embodiments, at least one captive pin 1108 is secured to one or both of vertical rear base bars 312, FIG. 3A.

In an exemplary embodiment, high back chair further includes a removable extended seat pad 1114 configured to align with first seat pad 116, FIG. 1A, behind first seat pad 116, to fill the substantially continual plane of high back chair 1100 formed by the alignment of the upper surface of side seat bar 310 with the lower surface of lower side back bar 404. That is, similar to second seat pad 204, FIG. 2A, removable extended seat pad is sized to cover entire base top 128 beyond first seat pad 116, as well as the portion of the continual plane that includes lower side back bar 404. Removable extended seat pad 1114 may be constructed similarly to first seat pad 116 and/or second seat pad 204, and include at least one seat runner 1116 configured to mate with a corresponding rear seat connection point 314, FIG. 3G, and at least one seat groove 1118 configured to mate with a corresponding coupling plate runner 434, FIG. 4G.

In an alternative embodiment, folding hinge system 1102 may be configured to securely attach to, instead of directly to rear seat bar 312, an adjustable attachment bar or tray configured to slidingly nest within the top of base module 102, such that the continual plane formed by folding back module 104 onto base module 102 may be adjustably lengthened. In this case, a height of back module 104 may be configured to substantially match the height of base module 102, such that there will be no tilt to base top 128 when a weight (e.g., a reclining person) is placed on top of removable extended seat pad 1114. In this manner, a high back chair may be easily and adjustably converted into a reclining bench or bed, such as a Pilates reformer bed.

Figure 12:
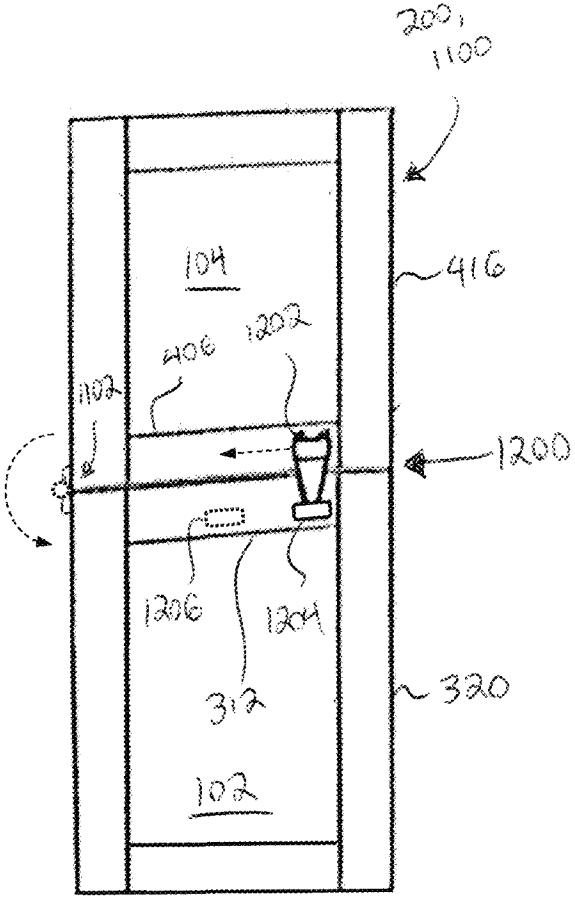
FIG. 12 is a side perspective view of an exemplary adjustable latch system for a high back chair, according to an embodiment.

FIG. 12 is a side perspective view of an exemplary adjustable latch system 1200 for a high back chair, such as high back chair 200, FIG. 2A, or high back chair 1100, FIG. 11. In the embodiment depicted in FIG. 12, adjustable latch system 1200 includes a latching mechanism 1202 fixed to back module 104, and a first catch plate 1204 fixed to base module 102 and configured to detachably secure a front portion of back module 104 to base module 102 when engaged with latching mechanism 1202. Latching mechanism may, for example, be a toggle latch or a latch clamp. In some embodiments, latching mechanism 1202 is fixed to lower side back bar 404, FIG. 4A, and first catch plate is fixed to side seat bar 310, FIG. 3A. In other embodiments, latching mechanism 1202 may be fixed to a lower portion of forward back bar 416, FIG. 4A, and first catch plate may be fixed to an upper portion of vertical forward base bar 320, FIG. 3A.

When implemented with respect to high back chair 1100, adjustable latch system 1200 functions to detachably secure back module 104 to base module 102 when back module 104 is fully unfolded about folding hinge system 1102. When implemented with respect to high back chair 200, adjustable latch system 1200 functions to detachably secure back module 104 to base module 102 when back module 104 is adjusted to first seat depth 201, FIG. 2A. In this case, adjustable latch system may supplement, or substitute for, coupling knobs 426 and/or stability knob 428, FIG. 4B. In at least one embodiment, adjustable latch system 1200 may further include a second catch plate 1206 fixed to side seat bar 310, and configured to detachably secure back module 104 to base module 102 when back module 104 is adjusted to second seat depth 214, FIG. 2A. In some cases, either of high back chairs 200, 1100 may include a pair of adjustable latch systems 1200, disposed opposing one another on both sides, respectively, of the particular high back chair.

Figure 13:
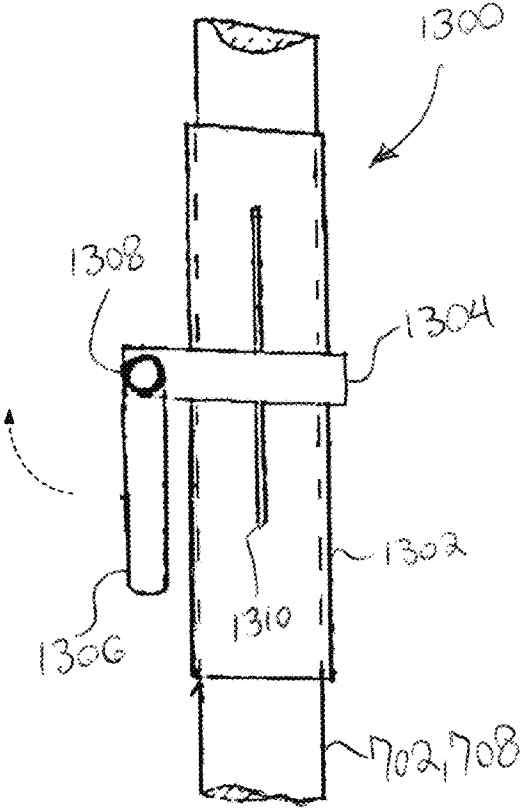
FIG. 13 is a partial perspective view illustrating an exemplary adjustable clamping system for the tower receiving tubes depicted in FIG. 4B, according to an embodiment.

FIG. 13 is a partial perspective view illustrating an exemplary adjustable clamping system 1300 for tower receiving tubes 440, FIG. 4B. In an exemplary embodiment, adjustable clamping system 1300 is disposed within an internal surface of, or immediately above or below, both tower receiving tubes 440, and includes an internal compression sleeve 1302. Internal compression sleeve 1302 is, for example, formed of a polymer lining material enabling a respective tubular tower bar 702 or square section 708, FIG. 7A, to easily glide vertically through an inner dimension thereof that is sized to securely hold the respective bar 702/section 708 and prevent horizontal motion therein (e.g., rattle, play, etc.).

Adjustable clamping system 1300 further includes a compression clamp 1304 disposed about an outer dimension of compression sleeve 1302. In some embodiments, compression clamp 1304 is integral to its respective tower receiving tube 440. In other embodiments, compression clamp 1304 is assembled directly about the outer dimension of compression sleeve 1302. Compression clamp 1304 includes an indexable lock lever 1306 configured to rotate about an indexing joint of compression clamp 1304 to either compress or decompress compression sleeve about the respective tubular tower bar 702/square section 708. In an exemplary embodiment, compression sleeve 1302 further includes at least one compression slot 1310 to enable greater compressibility of clamping sleeve 1302 to clamp the respective tubular tower bar 702/square section 708 in place.

Figure 14:
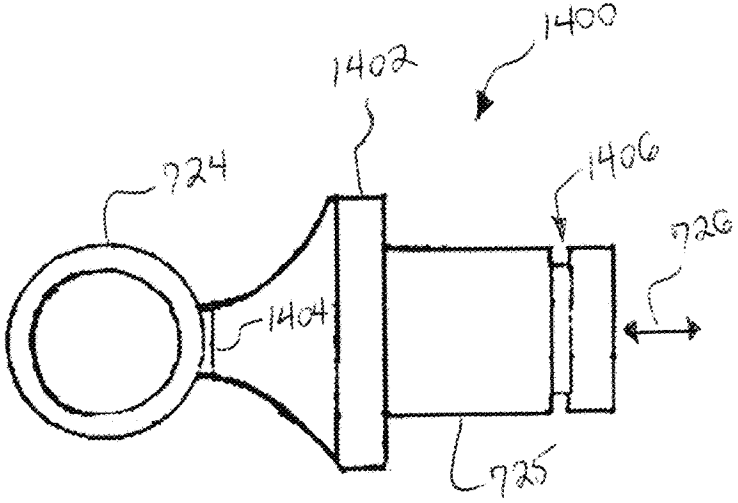
FIG. 14 is a perspective view of an exemplary integrated swivel assembly for the tower crossbars depicted in FIG. 7A, according to an embodiment.

FIG. 14 is a perspective view of an exemplary integrated swivel assembly 1400 for the tower crossbars 716, 718, FIG. 7A. Integrated swivel assembly 1400 may, for example, include the coupling system depicted in FIG. 7B, and includes a tower eyehook 724 and a tower eyehook coupler 725. In an exemplary embodiment, integrated swivel assembly 1400 further includes a cap portion 1402 integrally formed with or fixedly mated to tower eyehook coupler 725 such that cap portion 1402 is not movable with respect to tower eyehook coupler 725, whereas tower eyehook 724 may freely rotate about axis 726 at a swivel joint separating tower eyehook 724 from tower eyehook coupler 725. Tower eyehook coupler 725 further includes a set screw keeper slot 1406 configured to enable an indexing set screw (not shown) to securely and detachably engage therein through a threaded opening (also not shown) in and proximate a respective end of tower crossbar 716 or 718, such that, when engaged with set screw keeper slot 1406, tower eyehook coupler 725 is immovable with respect to crossbar 716 or 718.

Figure 15:
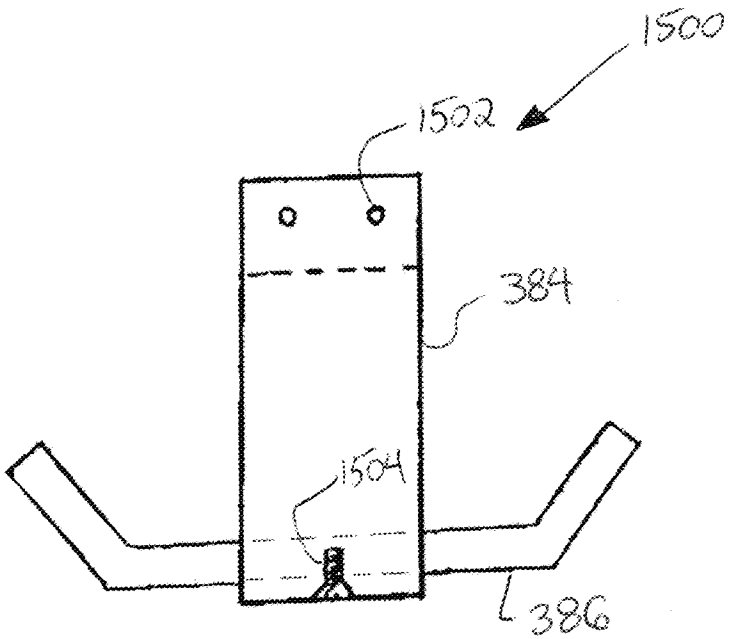
FIG. 15 is a rear perspective view of an exemplary clip bar storage assembly, according to an embodiment.

FIG. 15 is a rear perspective view of an exemplary clip bar storage assembly 1500. In an exemplary embodiment, clip bar storage assembly 1500 includes clip bar 384 and one or more handle bars 386, FIG. 3C, to create a "bow-tie" configuration for clip bar storage assembly 1500 to function as a spring storage rack for paddle springs 366 and foot paddle clips 380. In the exemplary embodiment depicted in FIG. 15, clip bar 384 includes one or more attachment holes 1502 to enable a fastener (e.g., screw, etc., not shown in FIG. 15) to fixedly attach clip bar storage assembly 1500 to a threaded connector (also not shown) disposed within the interior of base module 102 (i.e., below first seat pad 116, FIG. 3A, and/or integrally fixed to rear base plate 340, FIG. 3G). Clip bar storage assembly 1500 may further include at least one bar attachment screw 1504 for securely fixing handle bars 386 to clip bar 384. In at least one embodiment, clip bar 384 is integrally formed with handle bars 386, for example, as a unitary piece, or with both components welded together prior to attachment to base module 102.

Figure 16:
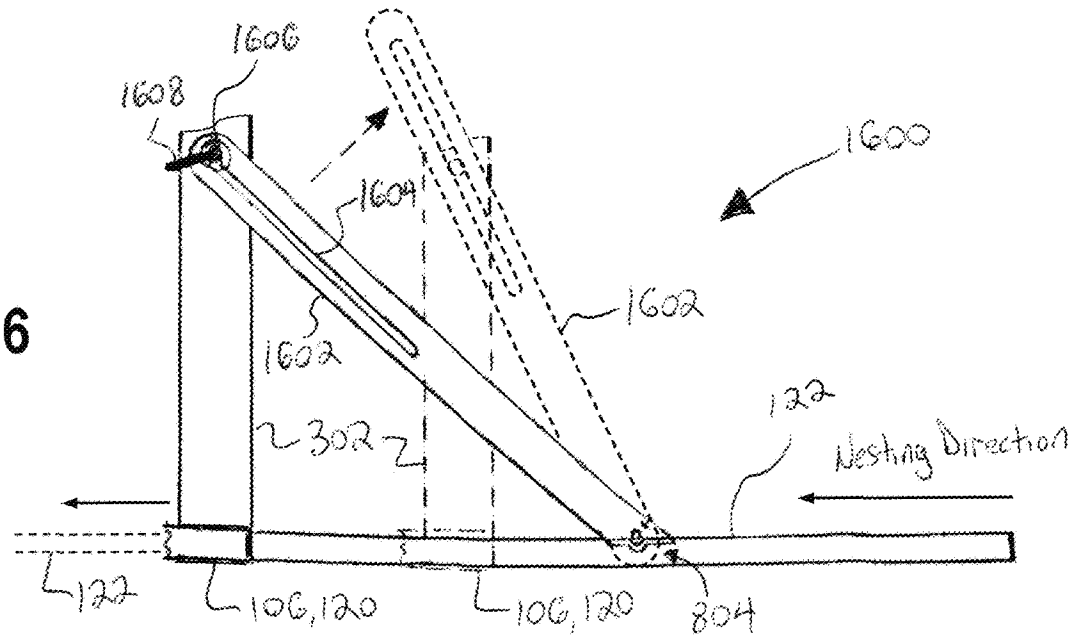
FIG. 16 is a side perspective view of an exemplary brace support system for the retractable rear stabilizer portion depicted in FIG. 1A, according to an embodiment.

FIG. 16 is a side perspective view of an exemplary brace support system 1600 for retractable rear stabilizer portion 122, FIG. 1A. In the embodiment depicted in FIG. 16, rear stabilizer portion 122 is illustrated in a fully extended position rearward from vertical rear base bars 302, FIG. 3A. In an exemplary embodiment, brace support system 1600 includes one or more support arms 1602 configured to securely mate within a respective platform slot 804, FIG. 8, and brace against an internal dimension of that platform slot (e.g., an indexed groove, cross slot, pin, etc.) configured to engage with support arm 1602.

Support arm 1602 includes a base engagement slot 1604 that extends along an internal dimension of support arm 1602, and is configured to slidably engage with a brace attachment member 1606 (e.g., screw, pin, etc.) fixed to an internal portion of vertical rear base bar 302. Brace support system 1600 further includes a locking lever 1608 configured to fixedly engage with brace attachment member 1604 such that support arm 1602 is secured between locking lever 1608 and vertical rear base bar 302 with brace attachment member 1606 disposed through base engagement slot 1604. Locking lever 1608 thus functions to adjustably lock support arm 1602 to vertical rear base bar 302, release support arm 1602 from vertical rear base bar 302 once locked.

In operation, when locking lever 1608 has released support arm 1602 from vertical rear base bar 302, base engagement slot 1604 of support arm 1602 may freely slide about brace attachment member 1606 as rear stabilizer portion 122 is moved toward vertical rear base bar 302 (shown in dashed lines), away from the extended position, in a forward direction to enable rear stabilizer portion 122 to nest within front stabilizer portion of platform module 106, FIG. 1A. In an exemplary embodiment, support arm is formed of a rigid, durable material, such as ⅜ inch stainless steel.

Figure 17:
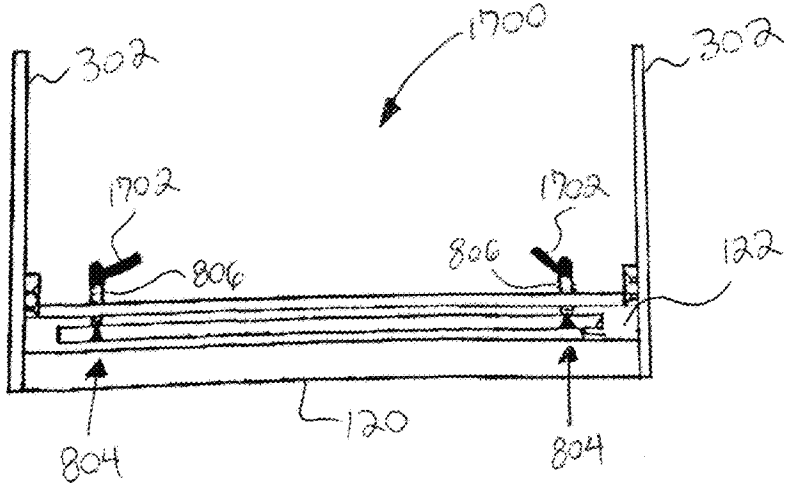
FIG. 17 is a rear perspective view of an exemplary tray lockdown system for the retractable rear stabilizer portion depicted in FIG. 1A, according to an embodiment.

FIG. 17 is a rear perspective view of an exemplary tray lockdown system 1700 for retractable rear stabilizer portion 122, FIG. 1A. In an exemplary embodiment, tray lockdown system 1700 includes two or more indexable locking levers 1702 coupled with a respective fastening screw 806, FIG. 8. In this embodiment, fastening screw may be a threaded rod having a screw (e.g., a flat head screw) bottom-mounted from forward stabilizer portion 120 of platform module 106, FIG. 1A, and extending upward through platform slots 804, FIG. 8. In operation, indexable locking levers 1702 adjustably and rotatably enable upward and downward pressure to lock or unlock slidable rear stabilizer portion 122 to/from forward stabilizer portion 120.

Figure 18A:
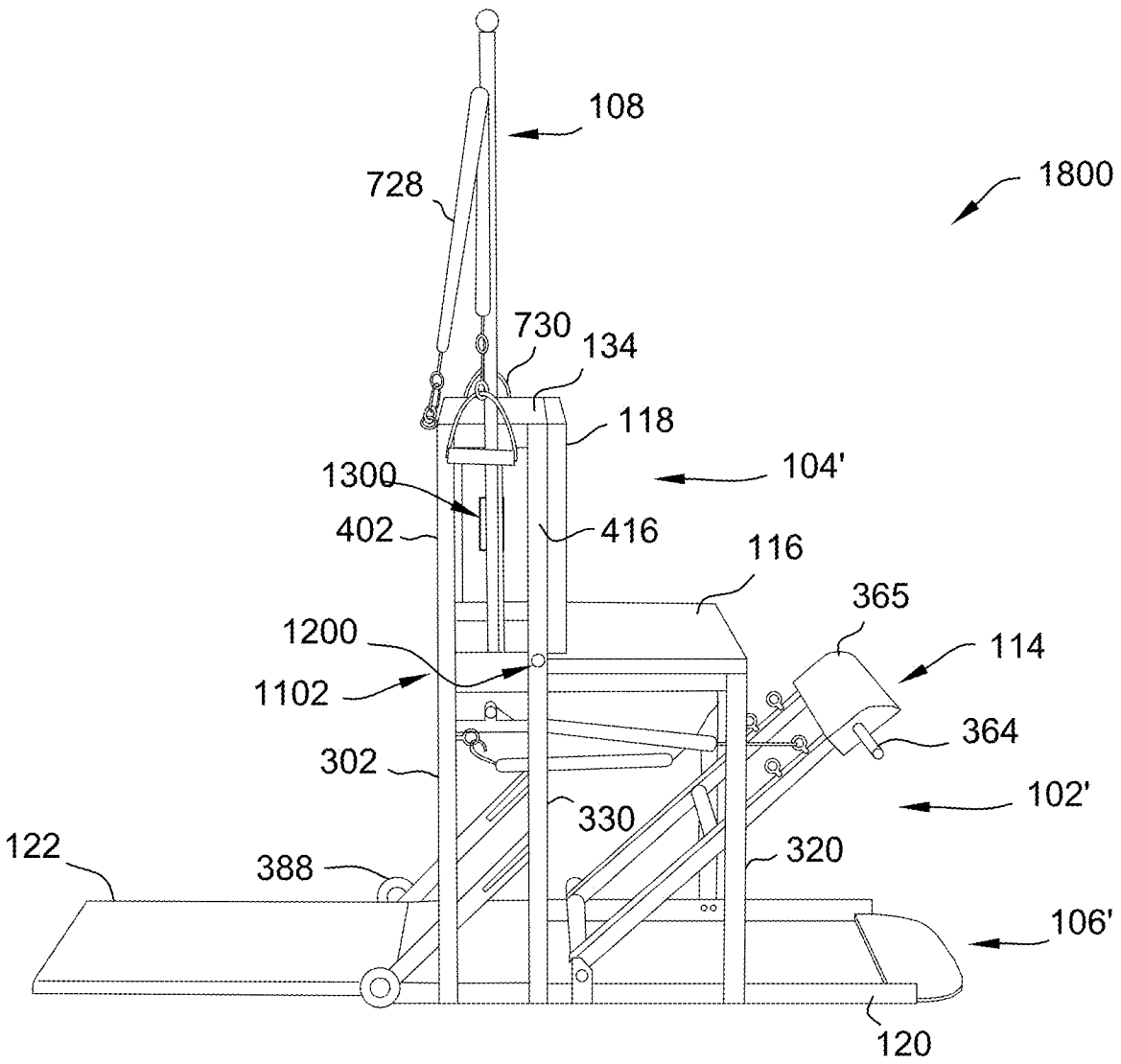
FIG. 18A is a perspective view of an alternative exercise apparatus in a first position, according to an embodiment.

FIG. 18A is a perspective view of an alternative exercise apparatus 1800 in a first position. More particularly, apparatus 1800 is similar, in many aspects to high back chair 1100, FIGS. 11A-11B, and includes a base portion 102' seated on a platform portion 106', and a back portion 104' rotatingly attached to base portion 102' about folding hinge system 1102 and configured to receive tower assembly 108 in the first position depicted in FIG. 18A (i.e., apparatus 1800 configured as a high back chair).

In the exemplary embodiment depicted in FIG. 18A, apparatus 1800 is illustrated as having an integrated frame construction, namely, with rear base bars 302, vertical base bars 330, and vertical forward base bars 320 fixedly attached directly to front stabilizer portion 120. According to this integral construction, the respective frame bar and stabilizer materials may be manufactured from significantly lighter, yet rigid, materials that enable the overall weight of apparatus 1800 to be significantly reduced in comparison to the fully modular, non-integrated embodiments described above. For example, according to this exemplary configuration, side panels 333, FIG. 3A, are optional for structural stability purposes, but may be nevertheless included for aesthetic design.

As may also be seen in the embodiment depicted in FIG. 18A, apparatus 1800 further reduces the overall apparatus weight by minimizing the frame construction platform portion 106' such that front stabilizer portion 120 requires only enough framing material to provide rigid strength and stability to apparatus 1800, yet still accommodate rear stabilizer portion 122 when fully nested within front stabilizer portion 120 (i.e., in the forward nesting direction) or when fully extended rearward to stabilize apparatus 1800 when apparatus 1800 is used as either a high back chair or a high back tower. In this example, foot paddle 365 is illustrated to have an ergonomic shape to accommodate a human foot when a person is seated on apparatus 1800 facing the forward direction.

The person of ordinary skill in the art will appreciate that the other respective components of apparatus 1800 will function substantially we similar to components of the embodiments described above that are labeled and/or numbered similarly.

Figure 18B:
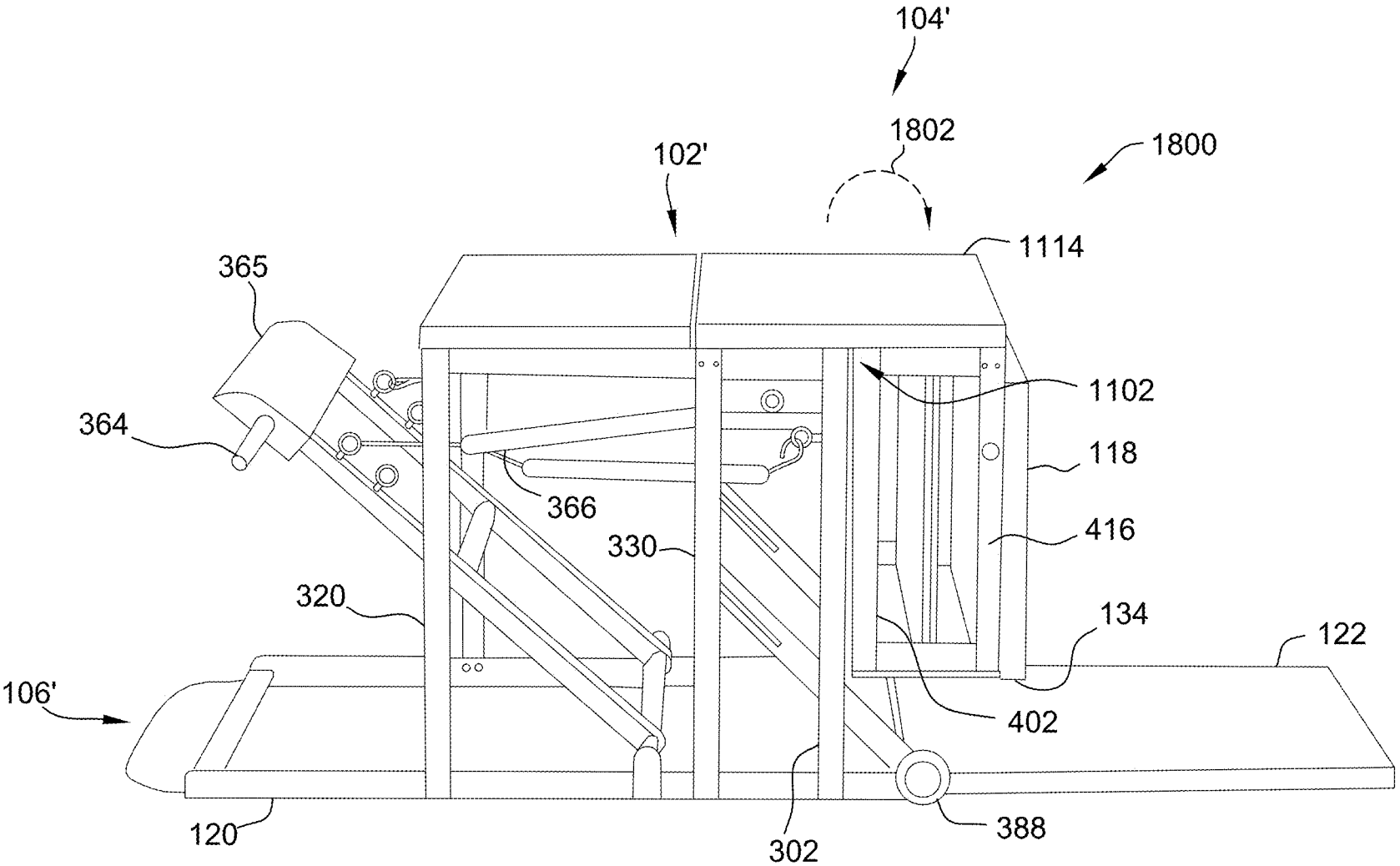
FIG. 18B is a perspective view of the exercise apparatus depicted in FIG. 18A, in a second position.

FIG. 18B is a perspective view of exercise apparatus 1800, FIG. 18A, in a second position. More specifically, similar to high back chair 1100, FIG. 11B, FIG. 18B depicts apparatus as being in the "Pilates chair" position with back portion 104' folded backwards about folding hinge system 1102 toward base portion 102' such that vertical rear back bars 402 mate upside down with respective rear base bars 302, thereby enabling back portion 104' to detachably couple with base portion 102' at a second point (not shown in FIG. 18B) below folding hinge system 1102.

In the second position depicted in FIG. 18B, removable extended seat pad 1114 may then be seated behind first seat pad 1116 in a substantially similar manner to high back chair 1100, FIG. 11B. According to this positional configuration of apparatus teen hundred, apparatus 1800 is fully functional as a traditional Pilates chair (sometimes referred to as a "low chair"). Different from a conventional low chair though, rear stabilizer portion 122 of apparatus 1800 may be optionally extended rearward to provide even further stability to the low chair configuration, which is not available to conventional Pilates chairs.

Figure 18C:
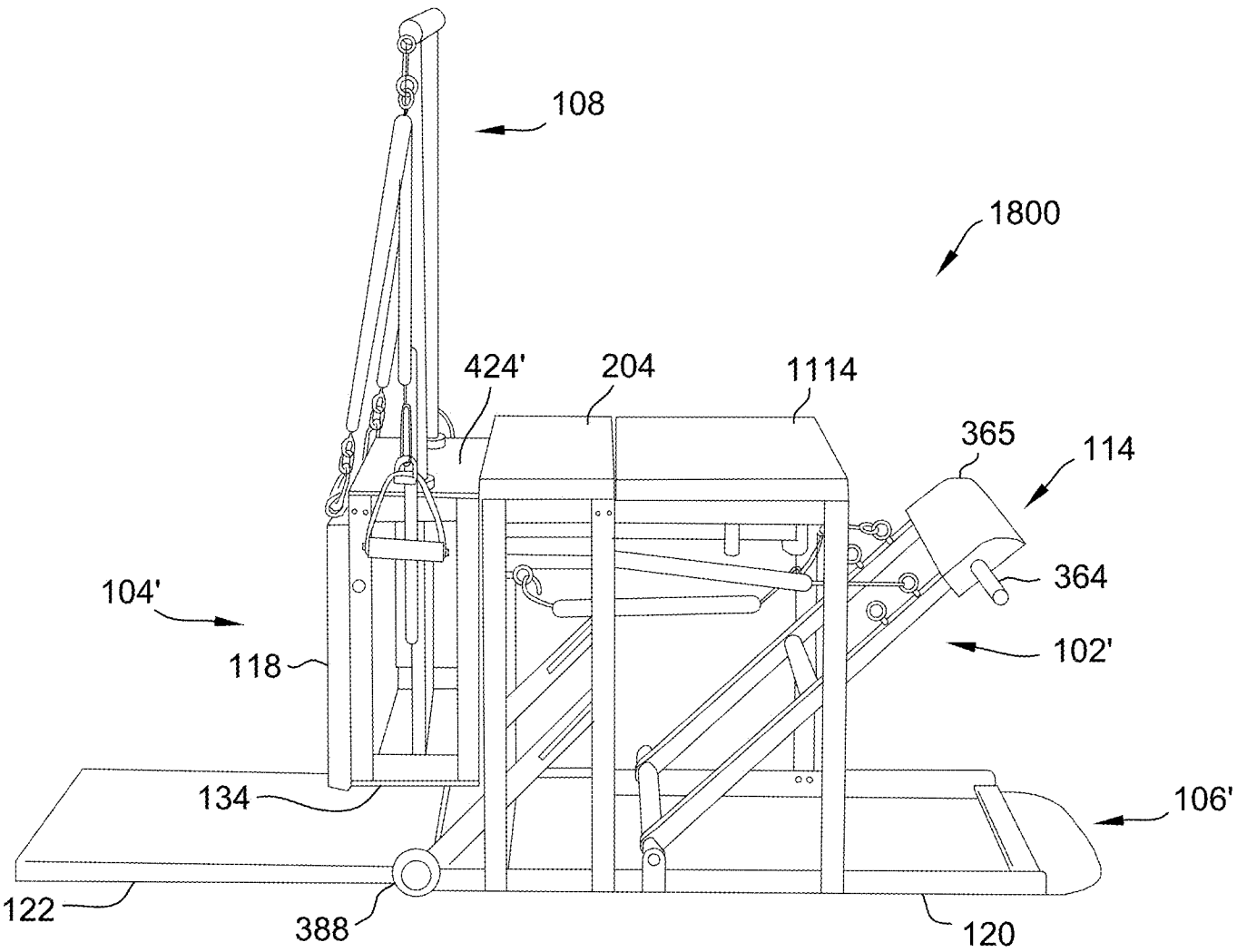
FIG. 18C is a perspective view of the exercise apparatus depicted in FIG. 18A, in an alternative configuration for the second position depicted in FIG. 18B.

FIG. 18C is a perspective view of exercise apparatus 1800, FIG. 18A, in the exemplary embodiment depicted in FIG. 18C, but may be seen that back portion 104' is not only enabled to receive tower assembly 108 when configured as a high back chair (e.g., FIG. 18A), but is also further advantageously enabled to receive tower assembly 108 when apparatus is configured in the second, low chair, position depicted in FIGS. 18B-C.

According to this alternative innovative construction, coupling plate 424' of back portion 104' is constructed similarly to back top 134 of back portion 104', such that parallel tower bars 702 of tower assembly 108 may be easily inserted into and removed from back portion 104' in either position direction, that is, through back top 134 when apparatus 1800 is configured in the first, high back chair, position (FIG. 18A), or through coupling plate 424' when apparatus is configured in the second, low chair, position (FIG. 18C). When configured as depicted in FIG. 18C, second seat pad 204 may be optionally seated behind first seat pad 116 to extend the seat depth of base portion 102'

According to the advantageous configuration depicted in FIG. 18C, apparatus 1800 advantageously functions as a unique "low tower" exercise apparatus. That is, unlike conventional exercise towers that must be used by a person in a standing position, apparatus 1800 enables a person to fully utilize tower assembly 108 from a seated position on base portion 104' and/or on rear stabilizer portion 122. Conventional tower assemblies are known to only provide some adjustability for the height of the standing user, but do not enable full conversion from a high tower configuration to a low tower configuration, as may be seen from a visual comparison of the respective configurations shown in FIGS. 18A and 18C. Moreover, the versatility of this embodiment further enables use of this low tower configuration for persons desiring physical therapy, but who are unable to use conventional high towers in a standing position for such physical therapy.

The person of ordinary skill the art will thus understand that systems and methods according to the embodiments depicted in FIGS. 18A-C enable a user to perform, in a single apparatus, at least 95% or more of the exercises that are achieved only through use of three separate apparatuses, namely, a Pilates/low chair, a high back chair, and a standing tower apparatus. The present embodiments though, additionally realize an advantageous low tower configuration that conventional systems and apparatuses do not provide.

Figure 18D:
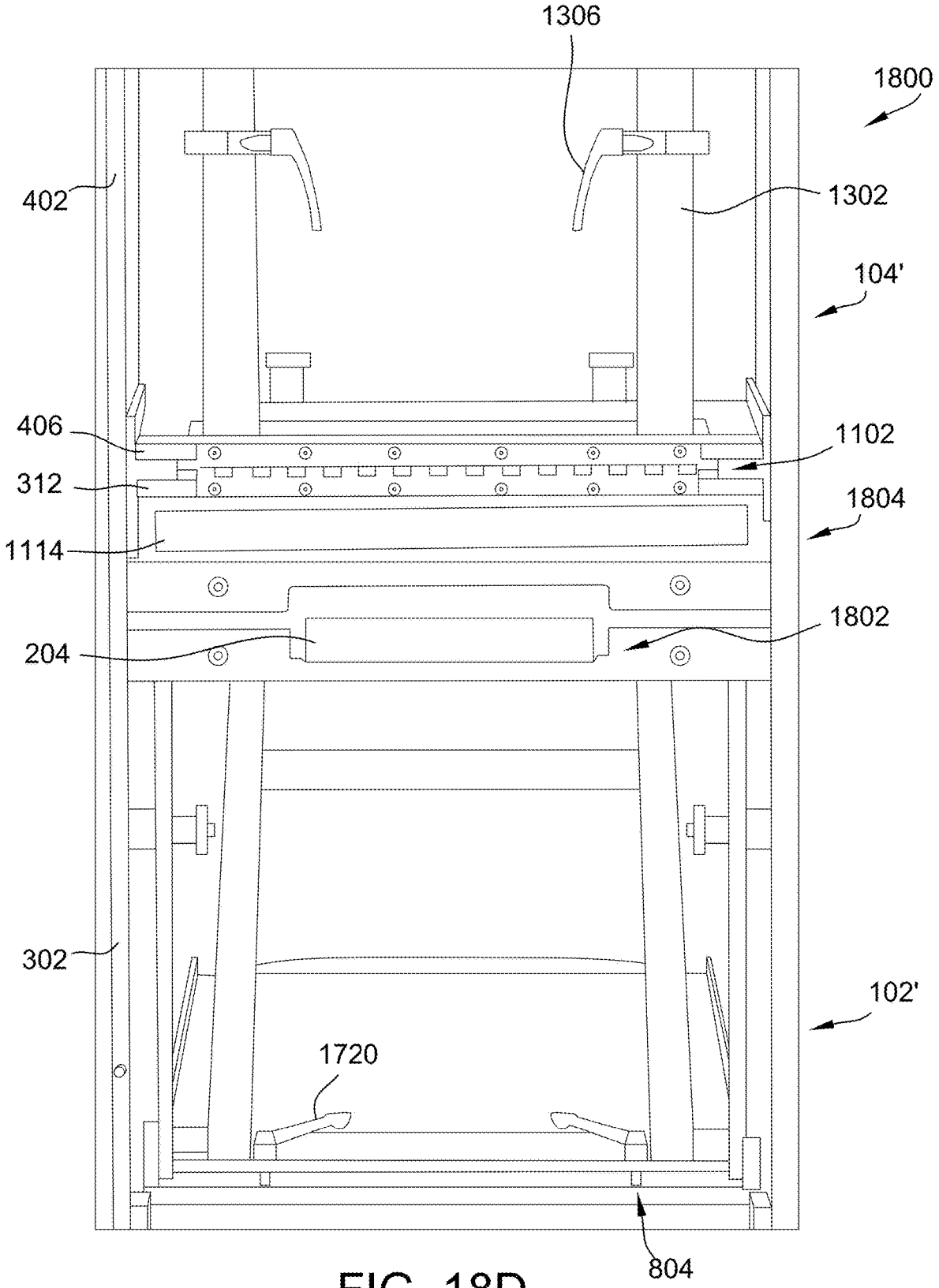
FIG. 18D is a rear view of the exercise apparatus depicted in FIG. 18A, in the first position.
Figure 18E:
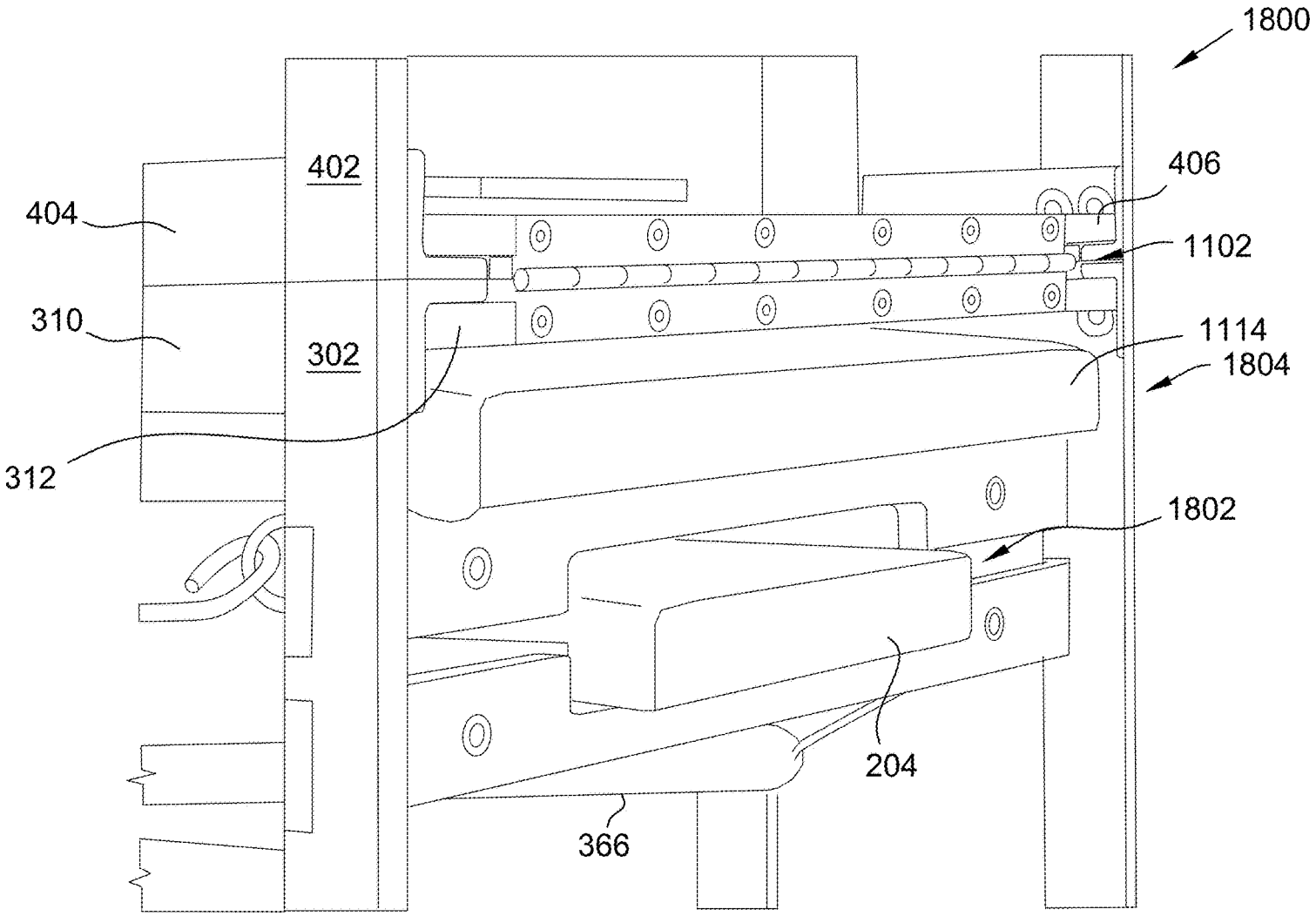
FIG. 18E is a partial closeup perspective rear view of the exercise apparatus depicted in FIG. 18D.

FIG. 18D is a rear view of exercise apparatus 1800, FIG. 18A, in the first position. FIG. 18E is a partial closeup perspective rear view of exercise apparatus 1800, FIGS. 18A, 18D. More particularly, the rear views of apparatus 1800, as illustrated in FIGS. 18D-E, is similar, in many aspects, to the rear view of high back chair 1100, FIG. 11A. Accordingly, the respective components of one embodiment may be considered to function similarly to components of the other embodiment labeled and/or numbered the same. In the exemplary embodiments depicted in FIGS. 18D-E, base portion 102' of apparatus 1800 is further configured to include one or more of a first seat nesting shelf 1802 for storing second seat pad 204, and/or a second seat nesting shelf 1804 for storing removable extended seat pad 1114. In an exemplary embodiment, first and second seat nesting shelves 1802, 1804 are constructed such that either or both of seat pads 204, 1114 may be respectively stored under side seat bar 310 and rear seat bar 312 so as to not interfere with the position and/or operation of foot paddle unit 114 or foot paddle springs 366.

Figure 19:
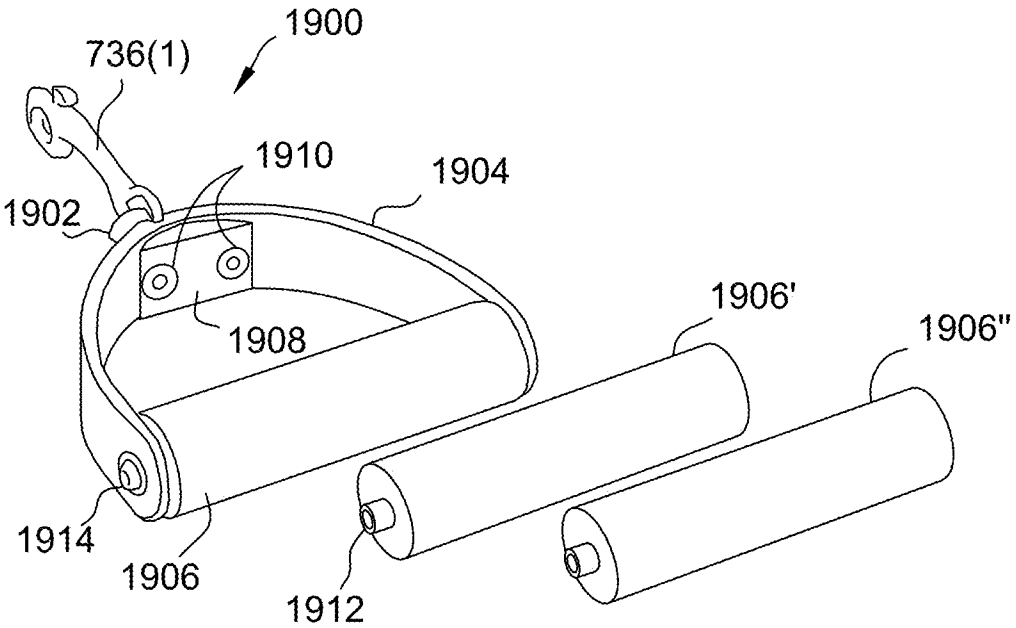
FIG. 19 is a perspective view of an adjustable handle, according to an embodiment.

FIG. 19 is a perspective view of an adjustable handle 1900. In the exemplary embodiment depicted in FIG. 19, adjustable handle 1900 is similar to spring grip 730, FIGS. 7C-D, and may also be configured to attach to a first tower clip 736(1) (e.g., a non-rotating clip configuration) or a second tower clip 736(2) (e.g., a rotatable clip configuration) for use with a number of different exercise apparatuses, of which high back chair 200, FIG. 2A, high back chair 1100, FIGS. 11A-B, and apparatus 1800, FIGS. 18A-E are but some examples.

In an exemplary embodiment, adjustable handle 1900 includes an eye ring 1902, a strap 1904, a grip 1906, and an inner reinforcement plate 1908 configured to secure strap 1904 to eye ring 1902 with strap 1904 secured between inner reinforcement plate 1908 and eye ring 1902. In an exemplary embodiment, inner reinforcement plate is detachably fixed to eye ring 1902 by one or more inner attachment connectors 1910. In the exemplary embodiment, attachment connectors 1910 are flat-head threaded fasteners that remain flush with, or slightly into, the surface of inner reinforcement plate 1908 to avoid contact with a human hand inserted into adjustable handle 1900 between inner reinforcement plate 1908 and grip 1906.

In some embodiments, strap 1904 is constructed of a semi-rigid but flexible material (e.g., leather, plastic, flexible metals, etc.) enabling a single adjustable handle 1900 to accommodate multiple lengths, shapes (e.g., round, hexagonal, etc.), and/or thicknesses of grips 1906 (e.g., 1906', 1906") without requiring a different strap 1904. In the exemplary embodiment depicted in FIG. 19, grip 1906 of adjustable handle 1900 is further configured to include a pair of rotatable coupling ends 1912 configured to detachably fixed to a respective pair of bearing attachments 1914 disposed opposite respective ends of strap 1904. In an exemplary embodiment, bearing attachments 1914 are threaded fasteners configured to detachably connect to coupling ends 1912, but enable grip 1906 to rotate about coupling ends 1912 without causing the threaded fasteners of bearing attachments 1914 to unscrew.

Figure 20:
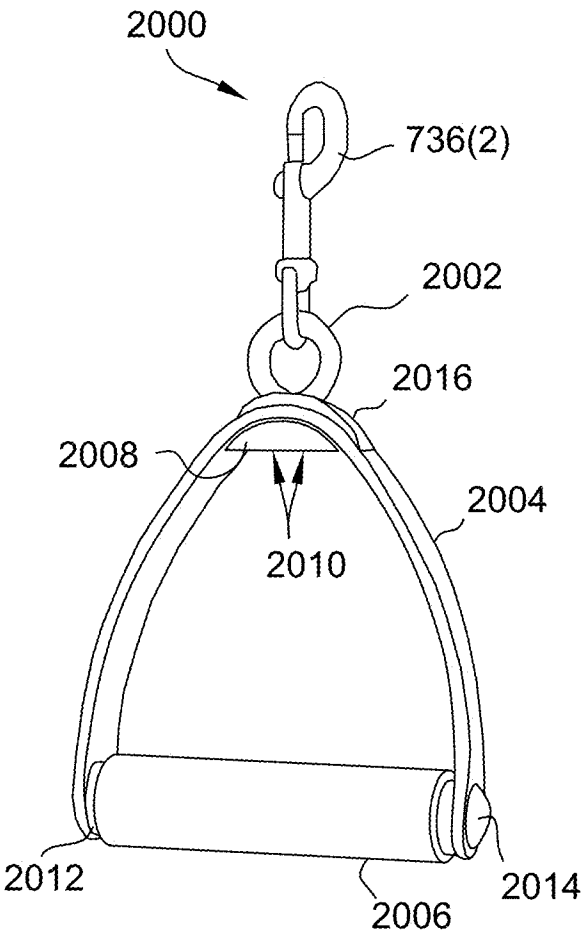
FIG. 20 is a perspective view of an alternative adjustable handle, according to an embodiment.

FIG. 20 is a perspective view of an alternative adjustable handle 2000. In the exemplary embodiment depicted in FIG. 20, adjustable handle 2000 is substantially similar in form and function to adjustable handle 1900, FIG. 19. That is, similar to adjustable handle 1900, adjustable handle 2000 includes an eye ring 2002, a strap 2004, a grip 2006, an inner reinforcement plate 2008, and one or more inner attachment connectors 2010. In this example though, adjustable handle 2000 alternatively includes a pair of rotatable grip bearings 2012 detachably fixed to respective opposing ends of strap 2004 by bearing attachments 2014. Adjustable handle 2000 may further include an optional outer reinforcement plate 2016 to effectively sandwich a portion of strap 2004 between inner reinforcement plate 2008 and outer reinforcement plate 2016 when inner reinforcement plate 2008 is detachably secured to eye ring 2002. According to this exemplary configuration, inner reinforcement plate 2008 and outer reinforcement plate 2016 may be optimally configured to accommodate a new variety of different lengths, shapes, and widths using the same eye ring 2002 and strap 2004.

Figure 21:
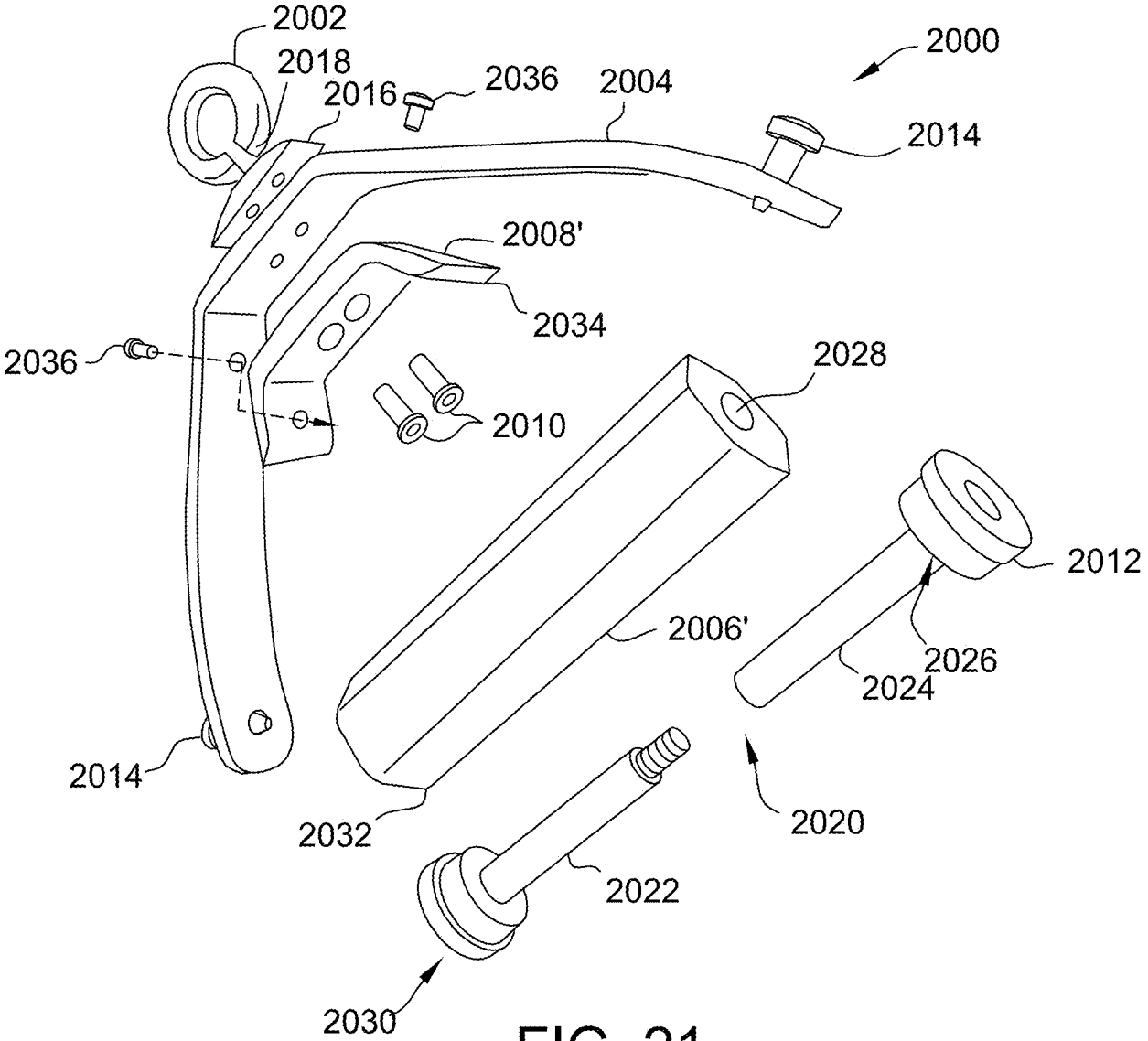
FIG. 21 is an exploded perspective view of the adjustable handle depicted in FIG. 20.

FIG. 21 is an exploded perspective view of adjustable handle 2000, FIG. 20. In the embodiment depicted in FIG. 20, the construction of adjustable handle 2000 is illustrated to depict and inner assembly structure of grip 2006' and rotatable grip bearings 2012 and also to depict how adjustable handle 2000 may accommodate inner reinforcement plates 2008' of different designs (e.g., different than the design of reinforcement plate 2008 depicted in FIG. 20). For example, in an exemplary embodiment, eye ring 2002 may include one or more threaded openings 2018 configured to accommodate threaded portions of inner attachment connectors 2010 detachably screwed therein. In some embodiments, the shape of optional outer reinforcement plate 2016 may be structured to substantially conform to an opposing portion of inner reinforcement plate 2008' for securely sandwiching strap 2004 therebetween.

In the exemplary embodiment depicted in FIG. 21, grip 2006' has a hollowed interior portion configured to accommodate an adjustable shaft 2020 therein between opposing rotatable grip bearings 2012. In an exemplary embodiment, adjustable shaft 2020 includes a first shaft portion 2022 and a second shaft portion 2024. First shaft portion 2022 may, for example, include an interior threaded end configured to mate with a corresponding interior threaded opening of second shaft portion 2024, or vice versa.

In some embodiments, first and second shaft portions 2022, 2024 may be color-coded to readily indicate the respective length of adjustable shaft 2020 when first and second shaft portions 2022, 2024 are assembled together. In at least one embodiment, first shaft portion 2022 has a standard length, and second shaft portion 2024 may have various different lengths (e.g., color-coded to indicate particular length, and/or a particular reinforcement plate 2008 optimal for the particular set shaft portion 2024).

In the exemplary embodiment, outer ends of first and second shaft portions 2022, 2024 configured to attach to respective sealed cartridges 2026 of rotatable grip bearings 2012, which are shaped to conform to an inner dimension (e.g., diameter) 2028 of grip 2006' such that grip 2006' may substantially attach to cartridges 2026 by friction. In an exemplary embodiment, rotatable grip bearings 2012 further include respective contoured end caps 2030 shaped to be larger than inner dimension 2028 of grip 2006', thereby preventing grip 2006' from sliding into strap 2004 past rotatable grip bearings 2012. In some embodiments, the shape of end caps 2030 is smaller than an outer dimension 2032 of grip 2006', thereby providing some margin between grip 2006' and strap 2004 when grasped by a human hand.

In some embodiments, when a length of inner reinforcement plate 2008' is such that greater reinforcement to strap 2004 is desired, extending plate portions 2034 of inner reinforcement plate 2008' may be structured to accommodate secondary strap fasteners 2036 inserted through strap 2004 to detachably connect to respective extending plate portions 2034. Secondary strap fasteners 2036 may, for example, be threaded screws configured to mate with threaded openings of extending plate portions 2034. In this example, secondary strap fasteners 2036 a be further constructed such that a length of the threaded portion thereof does not extend past inner reinforcement plate 2008' when detachably fixed thereto.

Figure 22:
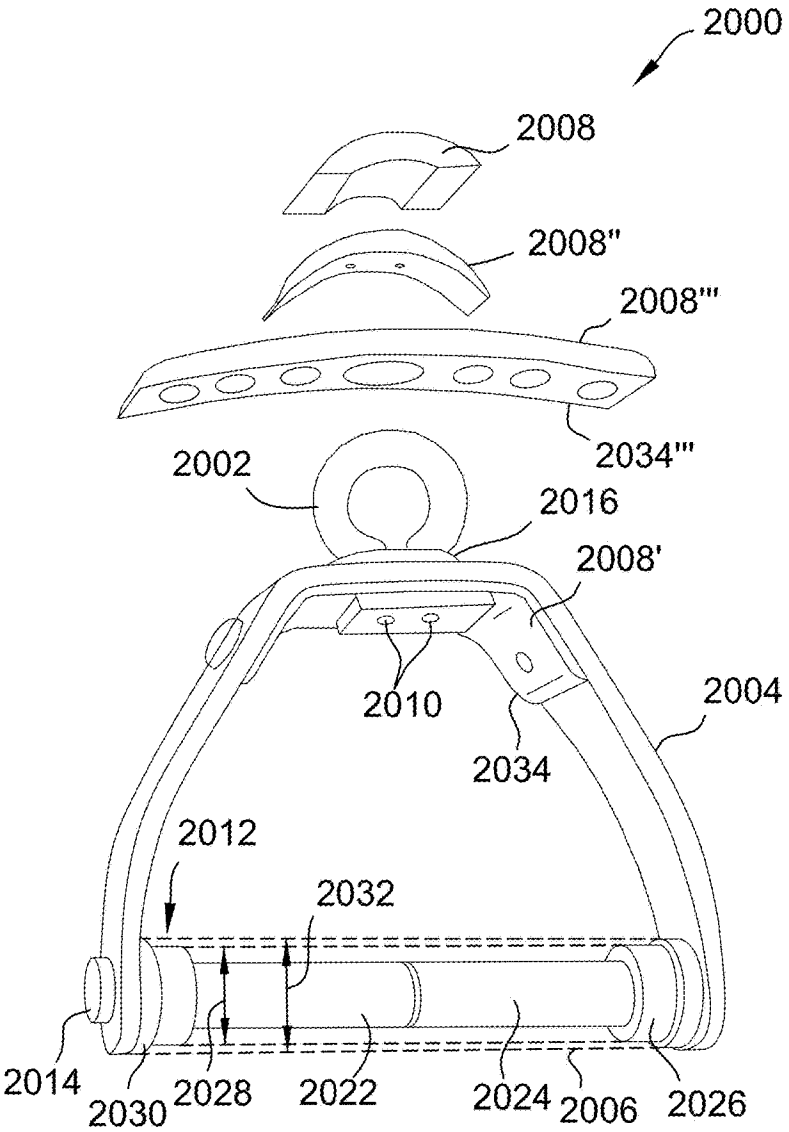
FIG. 22 is a front perspective view of the adjustable handle depicted in FIG. 20.

FIG. 22 is a front perspective view of adjustable handle 2000, FIG. 20. More specifically, the front perspective view of adjustable handle 2000 depicted in FIG. 22 illustrates a near-fully assembled construction of the exploded view of adjustable handle 2000 depicted in FIG. 21 (i.e., with grip 2006 shown in dashed line for ease of explanation). The functionality of the embodiment depicted in FIG. 22 is otherwise substantially similar to the embodiment depicted in FIG. 21, except that, the assembled perspective view illustrated in FIG. 22 further demonstrates how adjustable handle 2000 may be easily reconfigured to accommodate various multiple inner reinforcement plates 2008, 2008', 2008", 2008'", etc., but with only minor substitutions and/or additions to the overall structure thereof to accommodate the different shapes/lengths thereof.

Figure 23:
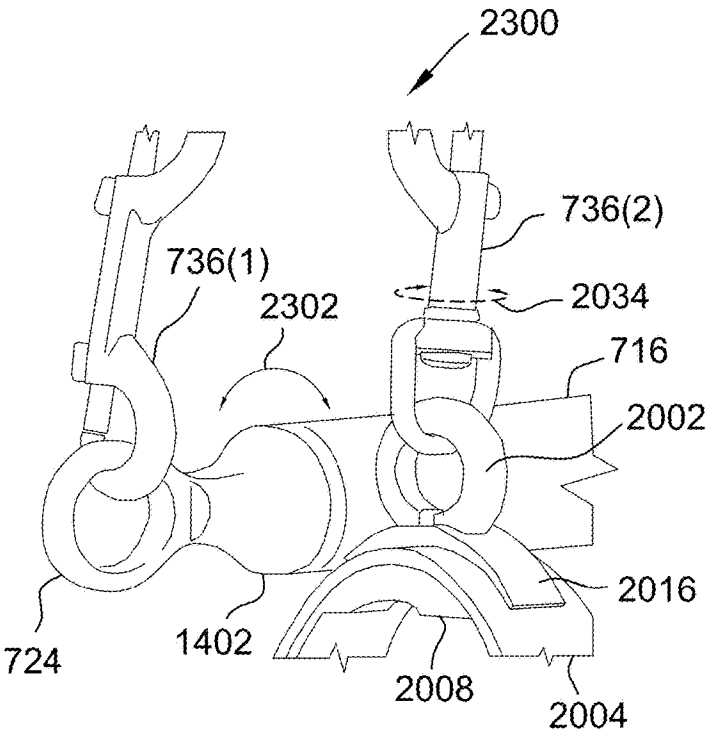
FIG. 23 is a partial closeup perspective view illustrating an operational principle of the adjustable handle depicted in FIG. 20.

FIG. 23 is a partial closeup perspective view illustrating an operational principle 2300 of adjustable handle 2000, FIG. 20. More particularly, operational principle 2300 is illustrated for adjustable handle 2000 with respect to integrated swivel assembly 1400, FIG. 14. That is, as described above with respect to swivel assembly 1400, conventional exercise apparatuses that utilize pull handles attached to springs or straps are known to provide jerking movements to the user when attaching clips (e.g., tower clips 736) are attached to fixed openings or eye rings. This jerking effect is a particular problem that prevents many exercise apparatuses from being used for physical therapy purposes, due to the fact that the jerking effect may aggravate and injury for which the physical therapy is desired.

In contrast, according to operational principle 2300, tower eyehook 724 is able to smoothly rotate in a first rotation direction 2302 substantially parallel to the ground and/or platform module/portion 106/106', whereby the non-rotating eye ring 2002 of adjustable handle 2004 may be attached to a tower clip 736(2) having a rotatable end configured to rotate in a second rotation direction 2304 that is generally, or at least substantially, perpendicular to the plane of the ground. The separate dual rotation directions 2302, 2304 thus complement one another to provide three-dimensional smoothness of movement for the user, which is of particular value where exercise apparatus 2000 is desired for physical therapy purposes. Moreover, the improvements to three-dimensional movement are further enhanced by the adjustable features of adjustable handle 2000, which enable individual users to specifically tailor the overall apparatus configuration to optimize specific gripping ability and movement of that particular user, but without requiring difficult or significant adjustment to apparatus 2000.

Figure 24:
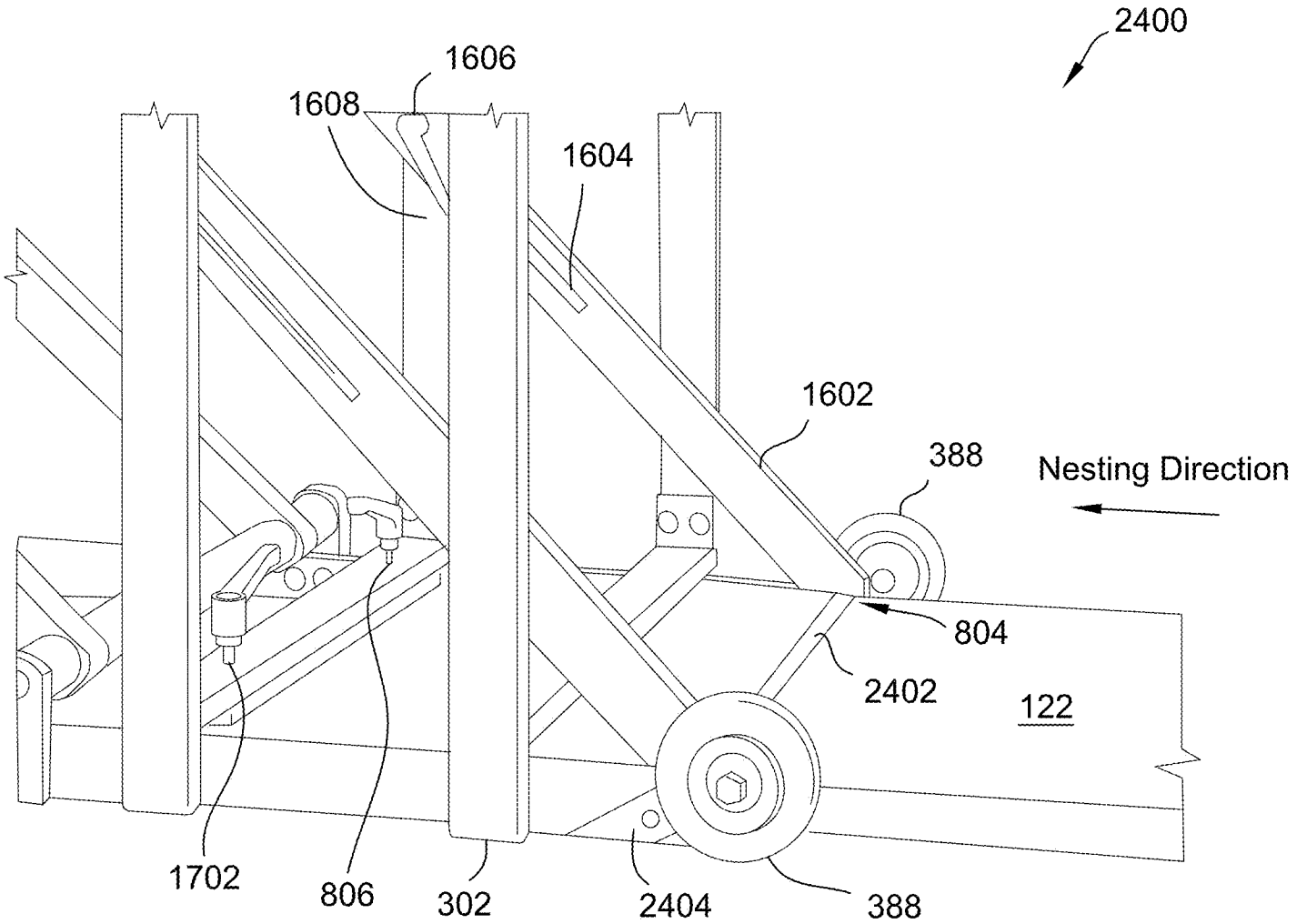
FIG. 24 is a partial side perspective view of an alternative configuration for the brace support system depicted in FIG. 16.

FIG. 24 is a partial side perspective view of an alternative configuration 2400 of brace support system 1600, FIG. 16. That is, configuration 2400 is substantially similar to brace support system 1600, except that configuration 2400 does not require a wheel rotating pin (e.g., wheel rotating pin 391, FIG. 3L) to connect wheels 388 together; instead, opposing support arms 1602 are connected together by a support arm bar 2402, which is configured to engage with, and nest into platform slot 804 when rear stabilizer portion 122 is fully extended. In this alternative embodiment, wheels 388 are fixedly attached directly to rearward and of front stabilizer portion 120 by respective wheel brackets 2404. In the exemplary embodiment, wheel brackets 2404 are structured such that wheels 388 are fixed slightly above the bottom-most surface of front stabilizer portion 120, but to engage with the ground immediately when apparatus 2000 is tilted backwards (i.e., with rear stabilizer portion 122 fully nested), thereby preventing rearmost corners of front stabilizer portion 120 from scratching the ground when apparatus 2000 is tilted and moved.

Exemplary embodiments of modular exercise systems, apparatuses, and related operating methods are described above in detail. The systems and methods of this disclosure though, are not limited to only the specific embodiments described herein, but rather, the components and/or steps of their implementation may be utilized independently and separately from other components and/or steps described herein.

Although specific features of various embodiments of the disclosure may be shown in some drawings and not in others, this convention is for convenience purposes and ease of description only. In accordance with the principles of the disclosure, a particular feature shown in a drawing may be referenced and/or claimed in combination with features of the other drawings.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A high back chair for an exercise system, comprising:

a base module including a seat portion having a seat depth and a support portion having a support depth, wherein the seat depth and the support depth extend in a lengthwise direction from a front portion of the base module toward a rear portion of the base module;

a hinge assembly fixedly attached to the base module at an upper portion of the base module in a heightwise direction; and a back module including a back rest surface extending between a top surface and an opposite bottom surface, wherein the back module is attached to the hinge assembly and enabled to rotate relative to the base module about the hinge assembly between a first position wherein the bottom surface of the back module rests against the support portion and a second position wherein the bottom surface of the back module is rotated away from the support portion and the bottom surface is parallel to the support portion.

2. The high back chair according to claim 1, wherein the back module includes a top surface and wherein the high back chair further comprises a tower module that is selectively translationally coupled to at least one of the top surface when the back module is in the first position and the bottom surface when the back module is in the second position.

3. The high back chair according to claim 1, wherein the high back chair further comprises a tower module including at least one rod and wherein the back module includes at least one cylinder for receiving the rod therein, wherein the at least one rod may translate within the at least one cylinder.

4. The high back chair according to claim 1, wherein the high back chair further comprises a tower module including a pair of rods and wherein the back module includes a pair of cylinders each for receiving one of the rods therein, wherein the pair of rods may translate within the pair of cylinders.

5. The high back chair according to claim 1, wherein the high back chair further comprises a tower module including at least one rod and wherein the back module includes at least one cylinder for receiving the rod therein, wherein the rod may translate within the cylinder, and wherein the cylinder extends through the back module such that a first cylinder opening is exposed on a top surface of the back module and a second cylinder opening is exposed on the bottom surface of the back module.

6. The high back chair according to claim 1, wherein the high back chair further comprises a tower module translationally coupled to the back module and at least one tower spring having a first end selectively attached to the tower module.

7. The high back chair according to claim 1, wherein the high back chair further comprises a tower module, at least one tower spring having a first end selectively attached to the tower module and a second end selectively attached to at least one handle.

8. The high back chair according to claim 1, wherein the high back chair further comprises a front stabilizer extending from a front side of the base module.

9. The high back chair according to claim 1, wherein the high back chair includes a rear stabilizer extending from a rear side of the base module.

10. The high back chair according to claim 1, wherein the high back chair further comprises a rear stabilizer extending from a rear side of the base module, wherein the rear stabilizer includes a plate having a first side that may contact a surface on which the high back chair rests.

11. The high back chair according to claim 1, wherein the high back chair further comprises a rear stabilizer that is translatable relative to a rear side of the base module.

12. The high back chair according to claim 1, wherein the high back chair further comprises a rear stabilizer that is translatable relative to the base module between a nested position wherein the rear stabilizer is positioned under the back module and an extended position wherein the rear stabilizer is extended from a back side of the base module.

13. The high back chair according to claim 1, wherein the high back chair further comprises a tower module that is coupled to the back module, wherein the tower module includes at least one vertical rod extending vertically from the back module and at least one horizontal rod connected and extending perpendicular to the at least one vertical rod.

14. The high back chair according to claim 1, wherein the high back chair further comprises a tower module that is coupled to the back module, wherein the tower module includes at least one vertical rod extending vertically from the back module and a first horizontal rod connected and extending perpendicular to that at least one vertical rod at a first location and a second horizontal rod connected and extending perpendicular to that at least one vertical rod at a second location vertically displaced from the first location.

15. The high back chair according to claim 1, wherein the high back chair further comprises a tower module that is coupled to the back module, wherein the tower module includes at least one vertical rod extending vertically from the back module and at least one horizontal rod connected and extending perpendicular to that at least one vertical rod, wherein the tower module includes a pair of hooks disposed at a first end and a second end of the horizontal rod.

16. The high back chair according to claim 1, wherein the high back chair further comprises a tower module that is translationally coupled to the back module, and wherein the tower module includes a plurality of adjustment holes and at least one pin that may be disposed in at least one of the plurality of adjustment holes to restrict translation of the tower module relative to the back module.

17. The high back chair according to claim 1, wherein the high back chair further comprises a pair of wheels rotationally coupled to the base module.

18. The high back chair according to claim 1, wherein the high back chair further comprises a rear stabilizer extending from a rear side of the base module and wherein the high back chair includes a pair of wheels rotationally coupled to the base module between the rear side of the base module and the rear stabilizer.

19. The high back chair according to claim 1, wherein the high back chair further comprises a nesting shelf and a second seat that may be received within the nesting shelf.

20. A high back chair for an exercise system, comprising:

a base module including a seat portion having a seat depth and a support portion having a support depth, wherein the seat depth and the support depth extend in a lengthwise direction from a front portion of the base module toward a rear portion of the base module;

a hinge assembly fixedly attached to the base module at an upper portion of the base module in a heightwise direction;

a back module including a back rest surface and a bottom surface, wherein the back module is attached to the hinge assembly and enabled to rotate relative to the base module about the hinge assembly between a first position, wherein the bottom surface of the back module rests against the support portion and a second position wherein the bottom surface of the back module is rotated away from the support portion and the bottom surface is parallel to the support portion; and a tower module that is translationally coupled to the back module.

* * * * *